US009040805B2

(12) United States Patent
Kobayashi

(10) Patent No.: US 9,040,805 B2
(45) Date of Patent: May 26, 2015

(54) INFORMATION PROCESSING APPARATUS, SOUND MATERIAL CAPTURING METHOD, AND PROGRAM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 30 days.

(21) Appl. No.: 13/186,832

(22) Filed: Jul. 20, 2011

(65) Prior Publication Data

US 2012/0125179 A1 May 24, 2012

Related U.S. Application Data

(63) Continuation of application No. 12/630,584, filed on Dec. 3, 2009, now abandoned.

(30) Foreign Application Priority Data

Dec. 5, 2008 (JP) ..... P2008-310721

(51) Int. Cl.

| | |
|---|---|
| ***G10H 1/00*** | (2006.01) |
| ***G10H 1/18*** | (2006.01) |
| ***G10H 1/38*** | (2006.01) |

(52) U.S. Cl.

CPC ..... *G10H 1/0025* (2013.01); *G10H 1/38* (2013.01); *G10H 2210/051* (2013.01); *G10H 2210/056* (2013.01); *G10H 2210/076* (2013.01); *G10H 2210/131* (2013.01); *G10H 2210/576* (2013.01)

(58) Field of Classification Search

None

See application file for complete search history.

(56) References Cited

U.S. PATENT DOCUMENTS

| | | | | |
|---|---|---|---|---|
| 5,256,832 | A | 10/1993 | Miyake | |
| 5,808,219 | A | 9/1998 | Usa | |
| 6,506,969 | B1 * | 1/2003 | Baron | 84/609 |
| 7,601,907 | B2 * | 10/2009 | Kobayashi | 84/613 |
| 7,649,137 | B2 * | 1/2010 | Kobayashi | 84/612 |
| 7,825,322 | B1 * | 11/2010 | Classen et al. | 84/622 |
| 7,863,512 | B2 * | 1/2011 | Takeda | 84/612 |
| 8,076,566 | B2 * | 12/2011 | Yamashita et al. | 84/611 |
| 8,101,845 | B2 * | 1/2012 | Kobayashi | 84/616 |
| 8,445,768 | B1 * | 5/2013 | Classen et al. | 84/633 |
| 8,604,328 | B2 * | 12/2013 | De Waele et al. | 84/615 |
| 2007/0107584 | A1 | 5/2007 | Kim et al. | |
| 2007/0289434 | A1 | 12/2007 | Yamada et al. | |
| 2008/0034948 | A1 * | 2/2008 | Sumita | 84/636 |
| 2008/0041220 | A1 * | 2/2008 | Foust et al. | 84/625 |
| 2008/0092722 | A1 * | 4/2008 | Kobayashi | 84/661 |
| 2008/0245215 | A1 * | 10/2008 | Kobayashi | 84/661 |
| 2009/0287323 | A1 * | 11/2009 | Kobayashi | 700/94 |
| 2009/0288546 | A1 * | 11/2009 | Takeda | 84/612 |
| 2010/0126332 | A1 | 5/2010 | Kobayashi | |
| 2010/0170382 | A1 * | 7/2010 | Kobayashi | 84/613 |
| 2010/0313739 | A1 * | 12/2010 | Lupini et al. | 84/611 |

(Continued)

FOREIGN PATENT DOCUMENTS

JP 2008-164932 7/2008

*Primary Examiner* — Marlon Fletcher

(74) *Attorney, Agent, or Firm* — Finnegan Henderson Farabow Garrett & Dunner LLP

(57) ABSTRACT

An information processing apparatus is provided which includes a music analysis unit for analyzing an audio signal serving as a capture source for a sound material and for detecting beat positions of the audio signal and a presence probability of each instrument sound in the audio signal, and a capture range determination unit for determining a capture range for the sound material by using the beat positions and the presence probability of each instrument sound detected by the music analysis unit.

11 Claims, 76 Drawing Sheets

(56) References Cited

U.S. PATENT DOCUMENTS

2011/0000359 A1* 1/2011 Yoshida et al. ..... 84/601
2011/0214554 A1* 9/2011 Nakadai et al. ..... 84/477 R
2012/0125179 A1* 5/2012 Kobayashi ..... 84/611
2012/0222540 A1* 9/2012 Usui et al. ..... 84/622

* cited by examiner

FIG.4

TABLE 1: EXAMPLE OF SOUND SOURCE SEPARATION

| COMPONENT TO BE SEPARATED | BAND TO PASS THROUGH BAND PASS FILTER 146 |
|---|---|
| LEFT | PHASE DIFFERENCE BETWEEN LEFT AND RIGHT: SMALL<br>LEFT VOLUME > RIGHT VOLUME |
| CENTRE | PHASE DIFFERENCE BETWEEN LEFT AND RIGHT: SMALL<br>SMALL VOLUME DIFFERENCE BETWEEN LEFT AND RIGHT |
| RIGHT | PHASE DIFFERENCE BETWEEN LEFT AND RIGHT: SMALL<br>LEFT VOLUME < RIGHT VOLUME |
| BACKGROUND SOUND | PHASE DIFFERENCE BETWEEN LEFT AND RIGHT: LARGE |

- INPUT DATA: PARTIAL LOG SPECTRUM WITH SPECIFIC WINDOW WIDTH
- TEACHER DATA: BEAT PROBABILITY (1: BEAT, 0: NOT BEAT)
- LEARNING RESULT: BEAT PROBABILITY FORMULA $$\text{BEAT SCORE } BS(k,d) = \sum_{n} P(F_{k+nd}), \{F_{k+nd} \in F\}$$

NUMBER OF SUPPLEMENTARY BEATS $B_{fill} = Round\left(\frac{F_{h+1} - F_h}{d_h}\right) - 1$

- INPUT DATA:
  LOG SPECTRA OF A PLURALITY OF MUSIC PIECES
- TEACHER DATA:
  TEMPO DECIDED TO BE CORRECT BY HUMAN BEING LISTENING TO EACH MUSIC PIECE
- LEARNING RESULT:
  ESTIMATED TEMPO DISCRIMINATION FORMULA $$\text{AVERAGE BEAT PROBABILITY} \quad BP_{AVG}(r) = \frac{\sum_{F(h) \in F(r)} BP(h)}{m(r)}$$

F(r): GROUP OF BEAT POSITIONS AFTER REVISION ACCORDING TO BASIC MULTIPLIER r
m(r): NUMBER OF BEAT POSITIONS INCLUDED IN F(r)

FIG.31

TABLE 2: EXAMPLE OF BEAT DETECTION RESULT

| TIME [ms] | BAR NUMBER: BEAT POSITION | CHORD / KEY |
|---|---|---|
| 4694 | 4:01 | Fm / Cm |
| 5193 | 4:02 | Fm / Cm |
| 5693 | 4:03 | Fm / Cm |
| 6192 | 4:04 | Fm / Cm |
| 6691 | 5:01 | G / Cm |
| 7190 | 5:02 | G / Cm |

FIG.42

• INDEPENDENT VARIABLE:
ROOT FQ FOR EACH OF A PLURALITY OF BEAT SECTIONS WHOSE CORRECT CHORDS ARE KNOWN

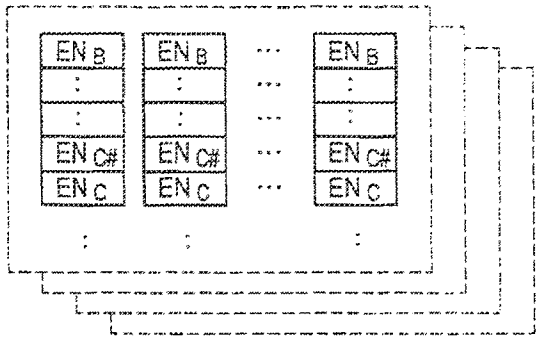

• DUMMY DATA (TEACHER DATA):

| | |
|---|---|
| WHEN LEARNING FOR MAJOR CHORD | ··· 1 WHEN MAJOR CHORD, OTHERWISE 0 |
| WHEN LEARNING FOR MINOR CHORD | ··· 1 WHEN MINOR CHORD, OTHERWISE 0 |
| WHEN LEARNING FOR 7th CHORD | ··· 1 WHEN 7th CHORD, OTHERWISE 0 |
| WHEN LEARNING FOR 9th CHORD | ··· 1 WHEN 9th CHORD, OTHERWISE 0 |

⇩

LOGISTIC REGRESSION ANALYSIS

⇩

• CHORD PROBABILITY FORMULA

MAJOR CHORD → CP major (x1, x2, ...) = ...
MINOR CHORD → CP minor (x1, x2, ...) = ...
7th CHORD → CP seven (x1, x2, ...) = ...
9th CHORD → CP nine (x1, x2, ...) = ...

| KEY TYPE | | Maj | m |
|---|---|---|---|
| ROOT | B | 0.00 | 0.00 |
| | : | : | : |
| | : | : | : |
| | C# | 0.00 | 0.00 |
| | C | 0.90 | 0.03 |

KEY PROBABILITY

FIG.51

51A

KEY PROBABILITY $KP_C \sim KP_{Bm}$

| KEY TYPE | | Maj | m |
|---|---|---|---|
| ROOT | B | 0.00 | 0.00 |
| | A# | 0.00 | 0.00 |
| | A | 0.02 | 0.05 |
| | : | : | : |
| | : | : | : |
| | C# | 0.00 | 0.00 |
| | C | 0.90 | 0.03 |

51B

SIMPLE KEY PROBABILITY $SKP_C \sim SKP_B$

| | |
|---|---|
| 0.00 | B |
| 0.00 | A# |
| 0.00 | A |
| : | : |
| : | : |
| 0.00 | C# |
| 0.95 | C |

ADD UP KEY PROBABILITIES OF KEYS
IN RELATIVE KEY RELATIONSHIP

FIG.53

KEY TRANSITION PROBABILITY (Maj → Maj) Pr (Δk)

| KEY TYPE | MODULATION AMOUNT | PROBABILITY VALUE |
|---|---|---|
| Maj → Maj | +5 (-7) | 0.0001 |
| Maj → Maj | +4 (-8) | 0.0001 |
| Maj → Maj | +3 (-9) | 0.0001 |
| Maj → Maj | +2 (-10) | 0.0001 |
| Maj → Maj | +1 (-11) | 0.0002 |
| Maj → Maj | 0 | 0.9987 |

| KEY TYPE | MODULATION AMOUNT | PROBABILITY VALUE |
|---|---|---|
| Maj → Maj | +11 (-1) | 0.0000 |
| Maj → Maj | +10 (-2) | 0.0001 |
| Maj → Maj | +9 (-3) | 0.0001 |
| Maj → Maj | +8 (-4) | 0.0001 |
| Maj → Maj | +7 (-5) | 0.0001 |
| Maj → Maj | +6 (-6) | 0.0000 |

KEY TRANSITION PROBABILITY (Maj → m)

:

KEY TRANSITION PROBABILITY (m → Maj)

:

KEY TRANSITION PROBABILITY (m → m)

:

FIG.61

- INDEPENDENT VARIABLE:
  A PLURALITY OF FIRST AND SECOND FQ OF AUDIO SIGNAL WHOSE CORRECT METRES (X) AND CORRECT ORDINALS OF BEATS (Y) ARE KNOWN

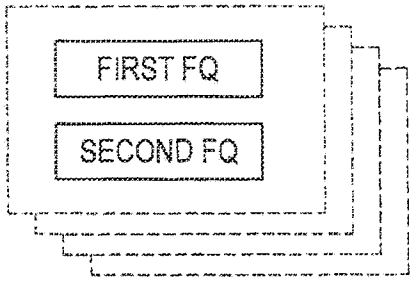

- DUMMY DATA (TEACHER DATA):
  WHEN LEARNING FORMULA FOR 1st BEAT IN 1/4 METRE ··· 1 WHEN 1st BEAT IN 1/4 METRE, OTHERWISE 0
  WHEN LEARNING FORMULA FOR 1st BEAT IN 2/4 METRE ··· 1 WHEN 1st BEAT IN 2/4 METRE, OTHERWISE 0
  : :

⇩

LOGISTIC REGRESSION ANALYSIS

⇩

- BAR PROBABILITY FORMULA
  FOR DISCRIMINATING 1st BEAT IN 1/4 METRE → $BR_{1,1}$ (FIRST FQ, SECOND FQ) = ...
  FOR DISCRIMINATING 1st BEAT IN 2/4 METRE → $BR_{2,1}$ (FIRST FQ, SECOND FQ) = ...
  : :

FIG.64

| | AFTER CHANGE | | | |
|---|---|---|---|---|
| BEFORE CHANGE | SINGLE METRE | DUPLE METRE | TRIPLE METRE | QUADRUPLE METRE |
| SINGLE METRE | 0.50 | 0.10 | 0.20 | 0.20 |
| DUPLE METRE | 0.50 | 0.10 | 0.20 | 0.20 |
| TRIPLE METRE | 0.05 | 0.03 | 0.90 | 0.02 |
| QUADRUPLE METRE | 0.05 | 0.03 | 0.02 | 0.90 |

FIG.69

- INDEPENDENT VARIABLE:
  EXTENDED ROOT FQ FOR RESPECTIVE BEAT SECTIONS WHOSE CORRECT CHORDS ARE KNOWN

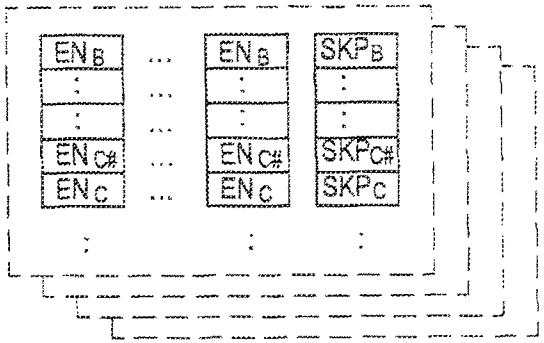

- DUMMY DATA (TEACHER DATA):
  - WHEN LEARNING FOR MAJOR CHORD ··· 1 WHEN MAJOR CHORD, OTHERWISE 0
  - WHEN LEARNING FOR MINOR CHORD ··· 1 WHEN MINOR CHORD, OTHERWISE 0
  - WHEN LEARNING FOR 7th CHORD ··· 1 WHEN 7th CHORD, OTHERWISE 0
  - WHEN LEARNING FOR 9th CHORD ··· 1 WHEN 9th CHORD, OTHERWISE 0

⇩

LOGISTIC REGRESSION ANALYSIS

⇩

- EXTENDED CHORD PROBABILITY FORMULA

MAJOR CHORD → CP' major (x1, x2, ...) = ...
MINOR CHORD → CP' minor (x1, x2, ...) = ...
7th CHORD → CP' seven (x1, x2, ...) = ...
9th CHORD → CP' nine (x1, x2, ...) = ...

INFORMATION PROCESSING APPARATUS, SOUND MATERIAL CAPTURING METHOD, AND PROGRAM

This is a continuation of U.S. Application Ser. No. 12/630,584, filed Dec. 3, 2009, which claims the benefit of priority based on Japanese Patent Application No. 2008-310721, filed Dec. 5, 2008, the subject matter of both of which is incorporated herein by reference.

BACKGROUND OF THE INVENTION

1. Field of the Invention

The present invention relates to an information processing apparatus, a sound material capturing method, and a program.

2. Description of the Related Art

To remix music, sound materials to be used for the remixing have to be provided. To perform remixing, it has been common to use sound materials picked up from material collection on the market or to use sound materials that one has captured using a waveform editing software or the like. However, it is troublesome to find a material collection including sound materials matching one's intentions. It is also troublesome to look for a part which may serve as the desired sound material from massive amounts of music data, or to capturing the part with high accuracy. Moreover, there is a description relating to remixed playback of music in JP-A-2008-164932, for example. In JP-A-2008-164932, a technology is disclosed for combining a plurality of sound materials by a simple operation and creating music with high degree of perfection.

SUMMARY OF THE INVENTION

However, JP-A-2008-164932 does not disclose a technology for automatically detecting, with high accuracy, a feature quantity included in each music piece and automatically capturing a sound material based on the feature quantity. Thus, in light of the foregoing, it is desirable to provide a novel and improved information processing apparatus, sound material capturing method and program that are capable of accurately extracting a feature quantity from music data and capturing a sound material based on the feature quantity.

According to an embodiment of the present invention, there is provided an information processing apparatus including a music analysis unit for analyzing an audio signal serving as a capture source for a sound material and for detecting beat positions of the audio signal and a presence probability of each instrument sound in the audio signal, and a capture range determination unit for determining a capture range for the sound material by using the beat positions and the presence probability of each instrument sound detected by the music analysis unit.

Furthermore, the information processing apparatus may further include a capture request input unit for inputting a capture request including, as information, at least one of length of a range to be captured as the sound material, types of instrument sounds and strictness for capturing. In this case, the capture range determination unit determines the capture range for the sound material so that the sound material meets the capture request input by the capture request input unit.

Furthermore, the information processing apparatus may further include a material capturing unit for capturing the capture range determined by the capture range determination unit from the audio signal and for outputting the capture range as the sound material.

Furthermore, the information processing apparatus may further include a sound source separation unit for separating, in case signals of a plurality of types of sound sources are included in the audio signal, the signal of each sound source from the audio signal.

Furthermore, the music analysis unit may further detect a chord progression of the audio signal by analyzing the audio signal. In this case, the capture range determination unit determines the capture range for the sound material and outputs, along with information on the capture range, a chord progression in the capture range.

Furthermore, the music analysis unit may further detect a chord progression of the audio signal by analyzing the audio signal. In this case, the material capturing unit outputs, as the sound material, an audio signal of the capture range, and also outputs a chord progression in the capture range.

Furthermore, the music analysis unit may generate a calculation formula for extracting information relating to the beat positions and information relating to the presence probability of each instrument sound by using a calculation formula generation apparatus capable of automatically generating a calculation formula for extracting feature quantity of an arbitrary audio signal, and detect the beat positions of the audio signal and the presence probability of each instrument sound in the audio signal by using the calculation formula, the calculation formula generation apparatus automatically generating the calculation formula by using a plurality of audio signals and the feature quantity of each of the audio signals.

Furthermore, the capture range determination unit may include a material score computation unit for totalling presence probabilities of instrument sounds of types specified by the capture request for each range of the audio signal and for computing, as a material score, a value obtained by dividing the totalled presence probability by a total of presence probabilities of all instrument sounds in the range, each range having a length of the capture range specified by the capture request, and determine, as a capture range meeting the capture request, a range where the material score computed by the material score computation unit is higher than a value of the strictness for capturing.

Furthermore, the sound source separation unit may separate a signal for foreground sound and a signal for background sound from the audio signal and also may separate from each other a centre signal localized around a centre, a left-channel signal and a right-channel signal in the signal for foreground sound.

According to another embodiment of the present invention, there is provided a sound material capturing method including, when an audio signal serving as a capture source for a sound material is input to an information processing apparatus, the steps of analyzing the audio signal and detecting beat positions of the audio signal and a presence probability of each instrument sound in the audio signal, and determining a capture range for the sound material by using the beat positions and the presence probability of each instrument sound detected by the step of analyzing and detecting. The steps are performed by the information processing apparatus.

According to another embodiment of the present invention, there is provided a program for causing a computer to realize, when an audio signal serving as a capture source for a sound material is input, a music analysis function for analyzing the audio signal and for detecting beat positions of the audio signal and a presence probability of each instrument sound in the audio signal, and a capture range determination function for determining a capture range for the sound material by using the beat positions and the presence probability of each instrument sound detected by the music analysis function.

According to another embodiment of the present invention, there may be provided a recording medium which stores the program and which can be read by a computer.

According to the embodiments of the present invention described above, it becomes possible to accurately extract a feature quantity from music data and to capture a sound material based on the feature quantity.

BRIEF DESCRIPTION OF THE DRAWINGS

FIG. 4 is an explanatory diagram showing types of sound sources according to the present embodiment;

FIG. 31 is an explanatory diagram showing an example of a detection result of beats detected by the beat detection method according to the present embodiment;

FIG. 42 is an explanatory diagram showing examples of the chord probability detection method and the key detection method according to the present embodiment;

FIG. 51 is an explanatory diagram showing examples of the chord probability detection method and the key detection method according to the present embodiment;

FIG. 53 is an explanatory diagram showing examples of the chord probability detection method and the key detection method according to the present embodiment;

FIG. 61 is an explanatory diagram showing an example of the bar detection method according to the present embodiment;

FIG. 64 is an explanatory diagram showing an example of the bar detection method according to the present embodiment;

FIG. 69 is an explanatory diagram showing an example of the chord progression estimation method according to the present embodiment;

DETAILED DESCRIPTION OF THE EMBODIMENT(S)

Figure 1:
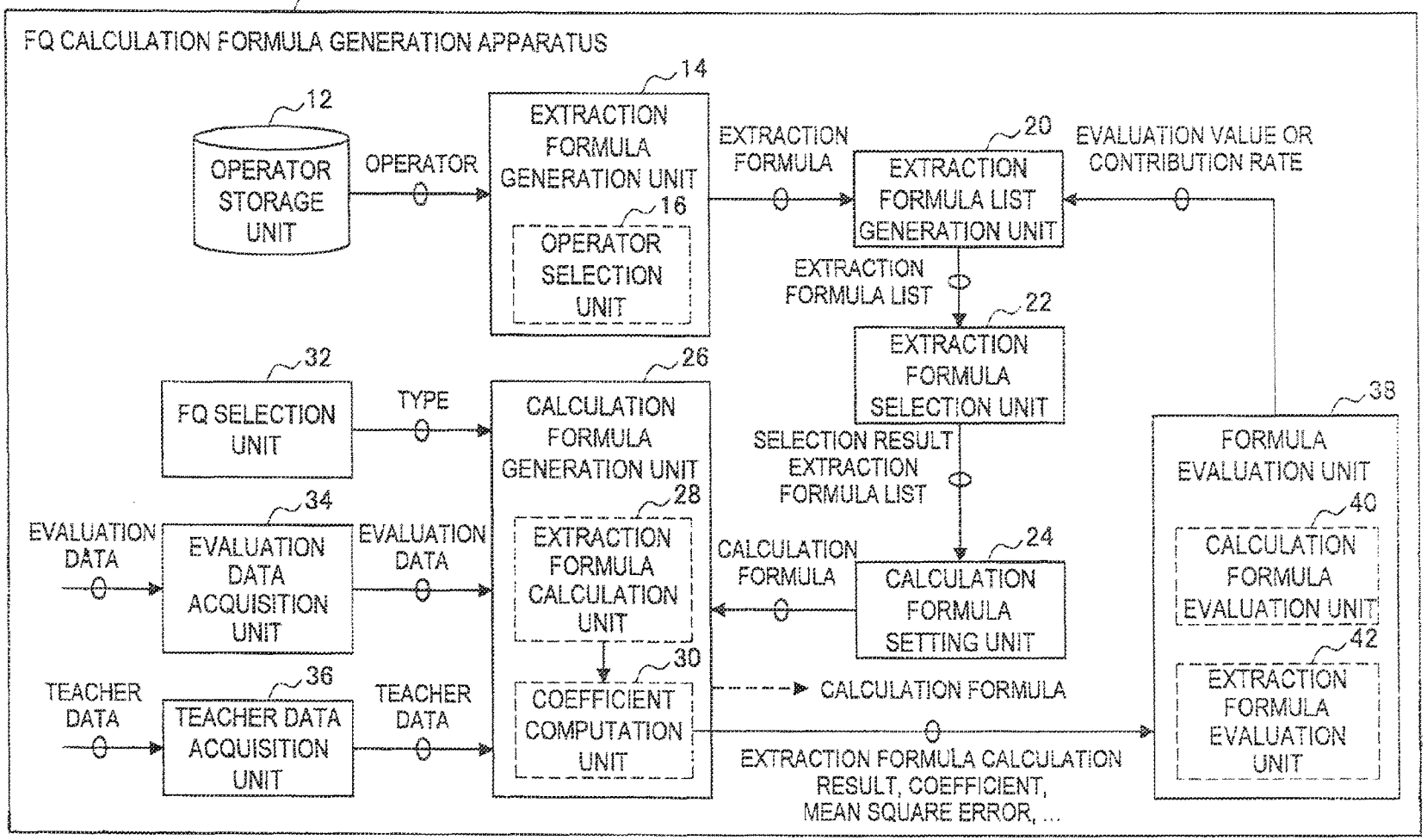
FIG. 1 is an explanatory diagram showing a configuration example of a feature quantity calculation formula generation apparatus for automatically generating an algorithm for calculating feature quantity.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

In this specification, explanation will be made in the order shown below.

EXPLANATION ITEMS

1. Infrastructure Technology 1-1. Configuration Example of Calculation Formula Generation Apparatus 10

2. Embodiment 2-1. Overall Configuration of Information Processing Apparatus 100

2-2. Configuration of Sound Source Separation Unit 104

2-3. Configuration of Log Spectrum Analysis Unit 106

2-4. Configuration of Music Analysis Unit 108

2-4-1. Configuration of Beat Detection Unit 132

2-4-2. Configuration of Chord Progression Detection Unit 134

2-4-3. Configuration of Instrument Sound Analysis Unit 136

2-5. Configuration of Capture Range Determination Unit 110

2-6. Conclusion

1. Infrastructure Technology

First, before describing a technology according to an embodiment of the present invention, an infrastructure technology used for realizing the technological configuration of the present embodiment will be briefly described. The infrastructure technology described here relates to an automatic generation method of an algorithm for quantifying in the form of feature quantity (also referred to as "FQ") the feature of arbitrary input data. Various types of data such as a signal waveform of an audio signal or brightness data of each colour included in an image may be used as the input data, for example. Furthermore, when taking a music piece for an example, by applying the infrastructure technology, an algorithm for computing feature quantity indicating the cheerfulness of the music piece or the tempo is automatically generated from the waveform of the music data. Moreover, a learning algorithm disclosed in JP-A-2008-123011 can also be used instead of the configuration example of a feature quantity calculation formula generation apparatus 10 described below.

(1-1. Configuration Example of Feature Quantity Calculation Formula Generation Apparatus 10)

First, referring to FIG. 1, a functional configuration of the feature quantity calculation formula generation apparatus 10 according to the above-described infrastructure technology will be described. FIG. 1 is an explanatory diagram showing a configuration example of the feature quantity calculation formula generation apparatus 10 according to the above-described infrastructure technology. The feature quantity calculation formula generation apparatus 10 described here is an example of means (learning algorithm) for automatically generating an algorithm (hereinafter, a calculation formula) for quantifying in the form of feature quantity, by using arbitrary input data, the feature of the input data.

As shown in FIG. 1, the feature quantity calculation formula generation apparatus 10 mainly has an operator storage unit 12, an extraction formula generation unit 14, an extraction formula list generation unit 20, an extraction formula selection unit 22, and a calculation formula setting unit 24. Furthermore, the feature quantity calculation formula generation apparatus 10 includes a calculation formula generation unit 26, a feature quantity selection unit 32, an evaluation data acquisition unit 34, a teacher data acquisition unit 36, and a formula evaluation unit 38. Moreover, the extraction formula generation unit 14 includes an operator selection unit 16. Also, the calculation formula generation unit 26 includes an extraction formula calculation unit 28 and a coefficient computation unit 30. Furthermore, the formula evaluation unit 38 includes a calculation formula evaluation unit 40 and an extraction formula evaluation unit 42.

First, the extraction formula generation unit 14 generates a feature quantity extraction formula (hereinafter, an extraction formula), which serves a base for a calculation formula, by combining a plurality of operators stored in the operator storage unit 12. The "operator" here is an operator used for executing specific operation processing on the data value of the input data. The types of operations executed by the operator include a differential computation, a maximum value extraction, a low-pass filtering, an unbiased variance computation, a fast Fourier transform, a standard deviation computation, an average value computation, or the like. Of course, it is not limited to these types of operations exemplified above, and any type of operation executable on the data value of the input data may be included.

Furthermore, a type of operation, an operation target axis, and parameters used for the operation are set for each operator. The operation target axis means an axis which is a target of an operation processing among axes defining each data value of the input data. For example, when taking music data as an example, the music data is given as a waveform for volume in a space formed from a time axis and a pitch axis (frequency axis). When performing a differential operation on the music data, whether to perform the differential operation along the time axis direction or to perform the differential operation along the frequency axis direction has to be determined. Thus, each parameter includes information relating to an axis which is to be the target of the operation processing among axes forming a space defining the input data.

Furthermore, a parameter becomes necessary depending on the type of an operation. For example, in case of the low-pass filtering, a threshold value defining the range of data values to be passed has to be fixed as a parameter. Due to these reasons, in addition to the type of an operation, an operation target axis and a necessary parameter are included in each operator. For example, operators are expressed as F#Differential, F#MaxIndex, T#LPF_1;0.861, T#UVariance, . . . . F and the like added at the beginning of the operators indicate the operation target axis. For example, F means frequency axis, and T means time axis.

Differential and the like added, being divided by #, after the operation target axis indicate the types of the operations. For example, Differential means a differential computation operation, MaxIndex means a maximum value extraction operation, LPF means a low-pass filtering, and UVariance means an unbiased variance computation operation. The number following the type of the operation indicates a parameter. For example, LPF_1;0.861 indicates a low-pass filter having a range of 1 to 0.861 as a passband. These various operators are stored in the operator storage unit 12, and are read and used by the extraction formula generation unit 14. The extraction formula generation unit 14 first selects arbitrary operators by the operator selection unit 16, and generates an extraction formula by combining the selected operators.

For example, F#Differential, F#MaxIndex, T#LPF_1; 0.861 and T#UVariance are selected by the operator selection unit 16, and an extraction formula f expressed as the following equation (1) is generated by the extraction formula generation unit 14. However, 12 Tones added at the beginning indicates the type of input data which is a processing target. For example, when 12 Tones is described, signal data (log spectrum described later) in a time-pitch space obtained by analyzing the waveform of input data is made to be the operation processing target. That is, the extraction formula expressed as the following equation (1) indicates that the log spectrum described later is the processing target, and that, with respect to the input data, the differential operation and the maximum value extraction are sequentially performed along the frequency axis (pitch axis direction) and the low-pass filtering and the unbiased variance operation are sequentially performed along the time axis.

[Equation 1]

$$f=\{12\text{Tones},F\#\text{Differential},F\#\text{MaxIndex},T\#LPF_1;0.861,T\#U\text{Variance}\} \quad (1)$$

As described above, the extraction formula generation unit 14 generates an extraction formula as shown as the above-described equation (1) for various combinations of the operators. The generation method will be described in detail. First, the extraction formula generation unit 14 selects operators by using the operator selection unit 16. At this time, the operator selection unit 16 decides whether the result of the operation by the combination of the selected operators (extraction formula) on the input data is a scalar or a vector of a specific size or less (whether it will converge or not).

Moreover, the above-described decision processing is performed based on the type of the operation target axis and the type of the operation included in each operator. When combinations of operators are selected by the operator selection unit 16, the decision processing is performed for each of the combinations. Then, when the operator selection unit 16 decides that an operation result converges, the extraction formula generation unit 14 generates an extraction formula by using the combination of the operators, according to which the operation result converges, selected by the operator selection unit 16. The generation processing for the extraction formula by the extraction formula generation unit 14 is performed until a specific number (hereinafter, number of selected extraction formulae) of extraction formulae are generated. The extraction formulae generated by the extraction formula generation unit 14 are input to the extraction formula list generation unit 20.

When the extraction formulae are input to the extraction formula list generation unit 20 from the extraction formula generation unit 14, a specific number of extraction formulae are selected from the input extraction formulae (hereinafter, number of extraction formulae in list≤number of selected extraction formulae) and an extraction formula list is generated. At this time, the generation processing by the extraction formula list generation unit 20 is performed until a specific number of the extraction formula lists (hereinafter, number of lists) are generated. Then, the extraction formula lists generated by the extraction formula list generation unit 20 are input to the extraction formula selection unit 22.

A concrete example will be described in relation to the processing by the extraction formula generation unit 14 and the extraction formula list generation unit 20. First, the type of the input data is determined by the extraction formula generation unit 14 to be music data, for example. Next, operators $OP_1$, $OP_2$, $OP_3$ and $OP_4$ are randomly selected by the operator selection unit 16. Then, the decision processing is performed as to whether or not the operation result of the music data converges by the combination of the selected operators. When it is decided that the operation result of the music data converges, an extraction formula $f_1$ is generated with the combination of $OP_1$ to $OP_4$. The extraction formula $f_1$ generated by the extraction formula generation unit 14 is input to the extraction formula list generation unit 20.

Furthermore, the extraction formula generation unit 14 repeats the processing same as the generation processing for the extraction formula $f_1$ and generates extraction formulae $f_2$, $f_3$ and $f_4$, for example. The extraction formulae $f_2$, $f_3$ and $f_4$ generated in this manner are input to the extraction formula list generation unit 20. When the extraction formulae $f_1$, $f_2$, $f_3$ and $f_4$ are input, the extraction formula list generation unit 20 generates an extraction formula list $L_1=\{f_1, f_2, f_4)$, and an extraction formula list $L_2=\{f_1, f_3, f_4)$, for example. The extraction formula lists $L_1$ and $L_2$ generated by the extraction formula list generation unit 20 are input to the extraction formula selection unit 22. As described above with a concrete example, extraction formulae are generated by the extraction formula generation unit 14, and extraction formula lists are generated by the extraction formula list generation unit 20 and are input to the extraction formula selection unit 22. However, although a case is described in the above-described example where the number of selected extraction formulae is 4, the number of extraction formulae in list is 3, and the number of lists is 2, it should be noted that, in reality, extremely large numbers of extraction formulae and extraction formula lists are generated.

Now, when the extraction formula lists are input from the extraction formula list generation unit 20, the extraction formula selection unit 22 selects, from the input extraction formula lists, extraction formulae to be inserted into the calculation formula described later. For example, when the extraction formulae $f_1$ and $f_4$ in the above-described extraction formula list $L_1$ are to be inserted into the calculation formula, the extraction formula selection unit 22 selects the extraction formulae $f_1$ and $f_4$ with regard to the extraction formula list $L_1$. The extraction formula selection unit 22 performs the above-described selection processing for each of the extraction formula lists. Then, when the selection processing is complete, the result of the selection processing by the extraction formula selection unit 22 and each of the extraction formula lists are input to the calculation formula setting unit 24.

When the selection result and each of the extraction formula lists are input from the extraction formula selection unit 22, the calculation formula setting unit 24 sets a calculation formula corresponding to each of the extraction formula, taking into consideration the selection result of the extraction formula selection unit 22. For example, as shown as the following equation (2), the calculation formula setting unit 24 sets a calculation formula $F_m$ by linearly coupling extraction formula $f_k$ included in each extraction formula list $L_m=\{f_1, \ldots, f_K\}$. Moreover, m=1, . . . , M (M is the number of lists), k=1, . . . , K (K is the number of extraction formulae in list), and $B_0, \ldots, B_K$ are coupling coefficients.

[Equation 2]

$$F_m=B_0+B_1f_1+\ldots+B_Kf_K \tag{2}$$

Moreover, the calculation formula $F_m$ can also be set to a non-linear function of the extraction formula $f_k$ (k=1 to K). However, the function form of the calculation formula $F_m$ set by the calculation formula setting unit 24 depends on a coupling coefficient estimation algorithm used by the calculation formula generation unit 26 described later. Accordingly, the calculation formula setting unit 24 is configured to set the function form of the calculation formula $F_m$ according to the estimation algorithm which can be used by the calculation formula generation unit 26. For example, the calculation formula setting unit 24 may be configured to change the function form according to the type of input data. However, in this specification, the linear coupling expressed as the above-described equation (2) will be used for the convenience of the explanation. The information on the calculation formula set by the calculation formula setting unit 24 is input to the calculation formula generation unit 26.

Furthermore, the type of feature quantity desired to be computed by the calculation formula is input to the calculation formula generation unit 26 from the feature quantity selection unit 32. The feature quantity selection unit 32 is means for selecting the type of feature quantity desired to be computed by the calculation formula. Furthermore, evaluation data corresponding to the type of the input data is input to the calculation formula generation unit 26 from the evaluation data acquisition unit 34. For example, in a case the type of the input data is music, a plurality of pieces of music data are input as the evaluation data. Also, teacher data corresponding to each evaluation data is input to the calculation formula generation unit 26 from the teacher data acquisition unit 36. The teacher data here is the feature quantity of each evaluation data. Particularly, the teacher data for the type selected by the feature quantity selection unit 32 is input to the calculation formula generation unit 26. For example, in a case where the input data is music data and the type of the feature quantity is tempo, correct tempo value of each evaluation data is input to the calculation formula generation unit 26 as the teacher data.

When the evaluation data, the teacher data, the type of the feature quantity, the calculation formula and the like are input, the calculation formula generation unit 26 first inputs each evaluation data to the extraction formulae $f_1, \ldots, f_K$ included in the calculation formula $F_m$ and obtains the calculation result by each of the extraction formulae (hereinafter, an extraction formula calculation result) by the extraction formula calculation unit 28. When the extraction formula calculation result of each extraction formula relating to each evaluation data is computed by the extraction formula calculation unit 28, each extraction formula calculation result is input from the extraction formula calculation unit 28 to the coefficient computation unit 30. The coefficient computation unit 30 uses the teacher data corresponding to each evaluation data and the extraction formula calculation result that is input, and computes the coupling coefficients expressed as $B_0, \ldots, B_K$ in the above-described equation (2). For example, the coefficients $B_0, \ldots, B_K$ can be determined by using a least-squares method. At this time, the coefficient computation unit 30 also computes evaluation values such as a mean square error.

The extraction formula calculation result, the coupling coefficient, the mean square error and the like are computed for each type of feature quantity and for the number of the lists. The extraction formula calculation result computed by the extraction formula calculation unit 28, and the coupling coefficients and the evaluation values such as the mean square error computed by the coefficient computation unit 30 are input to the formula evaluation unit 38. When these computation results are input, the formula evaluation unit 38 computes an evaluation value for deciding the validity of each of the calculation formulae by using the input computation results. As described above, a random selection processing is included in the process of determining the extraction formulae configuring each calculation formula and the operators configuring the extraction formulae. That is, there are uncertainties as to whether or not optimum extraction formulae and optimum operators are selected in the determination processing. Thus, evaluation is performed by the formula evaluation unit 38 to evaluate the computation result and to perform recalculation or correct the calculation result as appropriate.

The calculation formula evaluation unit 40 for computing the evaluation value for each calculation formula and the extraction formula evaluation unit 42 for computing a contribution degree of each extraction formula are provided in the formula evaluation unit 38 shown in FIG. 1. The calculation formula evaluation unit 40 uses an evaluation method called AIC or BIC, for example, to evaluate each calculation formula. The AIC here is an abbreviation for Akaike Information Criterion. On the other hand, the BIC is an abbreviation for Bayesian Information Criterion. When using the AIC, the evaluation value for each calculation formula is computed by using the mean square error and the number of pieces of the teacher data (hereinafter, the number of teachers) for each calculation formula. For example, the evaluation value is computed based on the value (AIC) expressed by the following equation (3).

[Equation 3]

$$\text{AIC}=\text{number of teachers}\times\{\log 2n+1+\log(\text{mean square error})\}+2(K+1) \quad (3)$$

According to the above-described equation (3), the accuracy of the calculation formula is higher as the AIC is smaller. Accordingly, the evaluation value for a case of using the AIC is set to become larger as the AIC is smaller. For example, the evaluation value is computed by the inverse number of the AIC expressed by the above-described equation (3). Moreover, the evaluation values are computed by the calculation formula evaluation unit 40 for the number of the types of the feature quantities. Thus, the calculation formula evaluation unit 40 performs averaging operation for the number of the types of the feature quantities for each calculation formula and computes the average evaluation value. That is, the average evaluation value of each calculation formula is computed at this stage. The average evaluation value computed by the calculation formula evaluation unit 40 is input to the extraction formula list generation unit 20 as the evaluation result of the calculation formula.

On the other hand, the extraction formula evaluation unit 42 computes, as an evaluation value, a contribution rate of each extraction formula in each calculation formula based on the extraction formula calculation result and the coupling coefficients. For example, the extraction formula evaluation unit 42 computes the contribution rate according to the following equation (4). The standard deviation for the extraction formula calculation result of the extraction formula $f_K$ is obtained from the extraction formula calculation result computed for each evaluation data. The contribution rate of each extraction formula computed for each calculation formula by the extraction formula evaluation unit 42 according to the following equation (4) is input to the extraction formula list generation unit 20 as the evaluation result of the extraction formula.

[Equation 4]

$$\text{Contribution rate of } f_k = \frac{B_k \times StDev(FQ \text{ of estimation target})}{StDev(\text{calculation result of } f_k) \times \text{Pearson}(\text{calculation result of } f_k, \text{ estimation target } FQ)} \quad (4)$$

Here, StDev( . . . ) indicates the standard deviation. Furthermore, the feature quantity of an estimation target is the tempo or the like of a music piece. For example, in a case where log spectra of 100 music pieces are given as the evaluation data and the tempo of each music piece is given as the teacher data, StDev(feature quantity of estimation target) indicates the standard deviation of the tempos of the 100 music pieces. Furthermore, Pearson( . . . ) included in the above-described equation (4) indicates a correlation function. For example, Pearson(calculation result of $f_K$, estimation target FQ) indicates a correlation function for computing the correlation coefficient between the calculation result of $f_K$ and the estimation target feature quantity. Moreover, although the tempo of a music piece is indicated as an example of the feature quantity, the estimation target feature quantity is not limited to such.

When the evaluation results are input from the formula evaluation unit 38 to the extraction formula list generation unit 20 in this manner, an extraction formula list to be used for the formulation of a new calculation formula is generated. First, the extraction formula list generation unit 20 selects a specific number of calculation formulae in descending order of the average evaluation values computed by the calculation formula evaluation unit 40, and sets the extraction formula lists corresponding to the selected calculation formulae as new extraction formula lists (selection). Furthermore, the extraction formula list generation unit 20 selects two calculation formulae by weighting in the descending order of the average evaluation values computed by the calculation formula evaluation unit 40, and generates a new extraction formula list by combining the extraction formulae in the extraction formula lists corresponding to the calculation formulae (crossing-over). Furthermore, the extraction formula list generation unit 20 selects one calculation formula by weighting in the descending order of the average evaluation values computed by the calculation formula evaluation unit 40, and generates a new extraction formula list by partly changing the extraction formulae in the extraction formula list corresponding to the calculation formula (mutation). Furthermore, the extraction formula list generation unit 20 generates a new extraction formula list by randomly selecting extraction formulae.

In the above-described crossing-over, the lower the contribution rate of an extraction formula, the better it is that the extraction formula is set unlikely to be selected. Also, in the above-described mutation, a setting is preferable where an extraction formula is apt to be changed as the contribution rate of the extraction formula is lower. The processing by the extraction formula selection unit 22, the calculation formula setting unit 24, the calculation formula generation unit 26 and the formula evaluation unit 38 is again performed by using the extraction formula lists newly generated or newly set in this manner. The series of processes is repeatedly performed until the degree of improvement in the evaluation result of the formula evaluation unit 38 converges to a certain degree. Then, when the degree of improvement in the evaluation result of the formula evaluation unit 38 converges to a certain degree, the calculation formula at the time is output as the computation result. By using the calculation formula that is output, the feature quantity representing a target feature of input data is computed with high accuracy from arbitrary input data different from the above-described evaluation data.

As described above, the processing by the feature quantity calculation formula generation apparatus 10 is based on a genetic algorithm for repeatedly performing the processing while proceeding from one generation to the next by taking into consideration elements such as the crossing-over or the mutation. A computation formula capable of estimating the feature quantity with high accuracy can be obtained by using the genetic algorithm. However, in the embodiment described later; a learning algorithm for computing the calculation formula by a method simpler than that of the genetic algorithm can be used. For example, instead of performing the processing such as the selection, crossing-over and mutation described above by the extraction formula list generation unit 20, a method can be conceived for selecting a combination for which the evaluation value by the calculation formula evaluation unit 40 is the highest by changing the extraction formula to be used by the extraction formula selection unit 22. In this case, the configuration of the extraction formula evaluation unit 42 can be omitted. Furthermore, the configuration can be changed as appropriate according to the operational load and the desired estimation accuracy.

2. Embodiment

Hereunder, an embodiment of the present invention will be described. The present embodiment relates to a technology for automatically extracting, from an audio signal of a music piece, a feature amount of the music piece with high accuracy, and for capturing a sound material by using the feature amount. The sound material captured by the technology enables to change the arrangement of another music piece by being combined with the other music piece while being synchronized with the beats of the other music piece. Moreover, in the following, the audio signal of a music piece may also be referred to as music data.

(2-1. Overall Configuration of Information Processing Apparatus 100)

Figure 2:
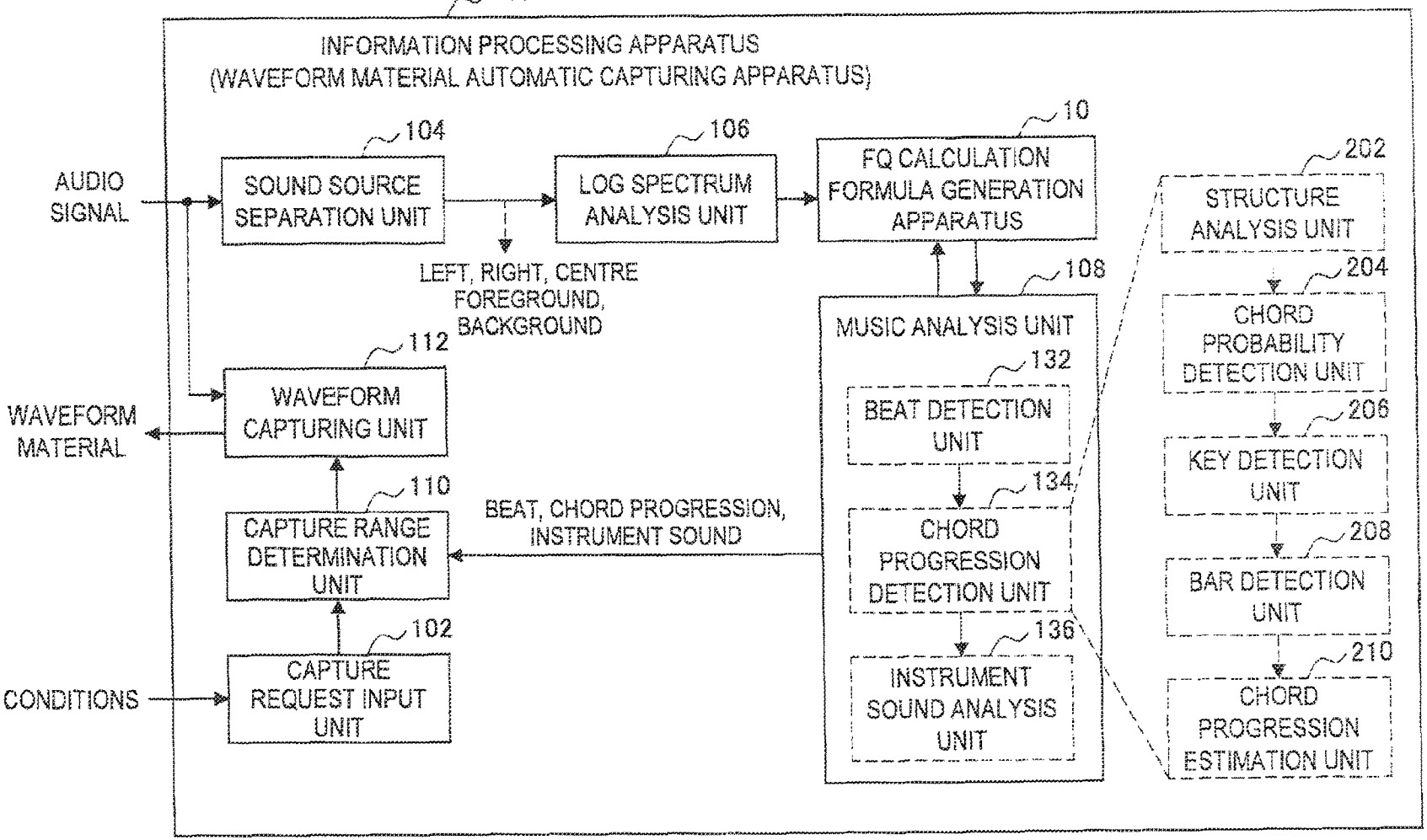
FIG. 2 is an explanatory diagram showing a functional configuration example of an information processing apparatus (waveform material automatic capturing apparatus) according to an embodiment of the present invention.

First, referring to FIG. 2, the functional configuration of an information processing apparatus 100 according to the present embodiment will be described. FIG. 2 is an explanatory diagram showing a functional configuration example of the information processing apparatus 100 according to the present embodiment. Moreover, the information processing apparatus 100 described here has its feature in a configuration of accurately detecting various feature quantities included in music data and capturing a waveform for serving as a sound material by using the feature quantities. For example, beats of a music piece, a chord progression, the type of an instrument, or the like will be detected as the feature quantity. In the following, after describing the overall configuration of the information processing apparatus 100, a detailed configuration of each structural element will be individually described.

As shown in FIG. 2, the information processing apparatus 100 mainly includes a capture request input unit 102, a sound source separation unit 104, a log spectrum analysis unit 106, a music analysis unit 108, a capture range determination unit 110, and a waveform capturing unit 112. Furthermore, the music analysis unit 108 includes a beat detection unit 132, a chord progression detection unit 134, and an instrument sound analysis unit 136.

Furthermore, a feature quantity calculation formula generation apparatus 10 is included in the information processing apparatus 100 illustrated in FIG. 2. However, the feature quantity calculation formula generation apparatus 10 may be provided within the information processing apparatus 100 or may be connected to the information processing apparatus 100 as an external device. In the following, for the sake of convenience, the feature quantity calculation formula generation apparatus 10 is assumed to be built in the information processing apparatus 100. Furthermore, instead of being provided with the feature quantity calculation formula generation apparatus 10, the information processing apparatus 100 can also use various learning algorithms capable of generating a calculation formula for feature quantity.

Overall flow of the processing is as described next. First, capture conditions (hereinafter, capture request) for a waveform are input to the capture request input unit 102. The type of instrument to be captured, the length of a waveform material to be captured, strictness of the capture conditions to be used at the time of capturing, or the like is input as the capture request. The capture request input to the capture request input unit 102 is input to the capture range determination unit 110, and is used in a capturing, process for the waveform material.

For example, drums, guitar or the like is specified as the type of instrument. Also, the length of a waveform material can be specified in terms of frames or bars. For example, one bar, two bars, four bars or the like is specified as the length of a waveform material. Furthermore, the strictness of the capture conditions is specified by continuous values, e.g. from 0.0 (lenient) to 1.0 (strict). For example, when the strictness of the capture conditions is specified to be 0.9 or the like (up to 1.0), only the waveform material meeting the capture conditions is captured. On the contrary, when the strictness of the capture conditions is specified to be 0.1 or the like (down to 0.0), even if a portion is included which does not exactly meet the capture conditions, that section is captured as the waveform material.

On the other hand, music data is input to the sound source separation unit 104. The music data is separated, by the sound source separation unit 104, into a left-channel component (foreground component), a right-channel component (foreground component), a centre component (foreground component), and a background component. Then, the music data separated into each component is input to the log spectrum analysis unit 106. Each component of the music data is converted to a log spectrum described later by the log spectrum analysis unit 106. The log spectrum output from the log spectrum analysis unit 106 is input to the feature quantity calculation formula generation apparatus 10 or the like. Moreover, the log spectrum may be used by structural elements other than the feature quantity calculation formula generation apparatus 10. In this case, a desired log spectrum is provided as appropriate to each structural element directly or indirectly from the log spectrum analysis unit 106.

The music analysis unit 108 analyses the waveform of the music data, and extracts beat positions, chord progression and each of instrument sounds included in the music data. The beat positions are detected by the beat detection unit 132. The chord progression is detected by the chord progression detection unit 134. Each of the instrument sounds is extracted by the instrument sound analysis unit 136. At this time, the music analysis unit 108 generates, by using the feature quantity calculation formula generation apparatus 10, calculation formulae for feature quantities used for detecting the beat positions, the chord progression and each of the instrument sounds, and detects the beat positions, the chord progression and each of the instrument sounds from the feature quantities computed by the calculation formulae. The analysis processing by the music analysis unit 108 will be described later in detail. The beat positions, the chord progression and each of the instrument sounds obtained by the analysis processing by the music analysis unit 108 are input to the capture range determination unit 110.

The capture range determination unit 110 determines a range to be captured as a sound material from the music data, based on the capture request input from the capture request input unit 102 and the analysis result of the music analysis unit 108. Then, the information on the capture range determined by the capture range determination unit 110 is input to the waveform capturing unit 112. The waveform capturing unit 112 captures from the music data the waveform of the capture range determined by the capture range determination unit 110 as the sound material. Then, the waveform material captured by the waveform capturing unit 112 is recorded in a storage device provided externally or internally to the information processing apparatus 100. A rough flow relating to the capturing process for a waveform material is as described above. In the following, the configurations of the sound source separation unit 104, the log spectrum analysis unit 106 and the music analysis unit 108, which are the main structural elements of the information processing apparatus 100, will be described in detail.

(2-2. Configuration Example of Sound Source Separation Unit 104)

Figure 3:
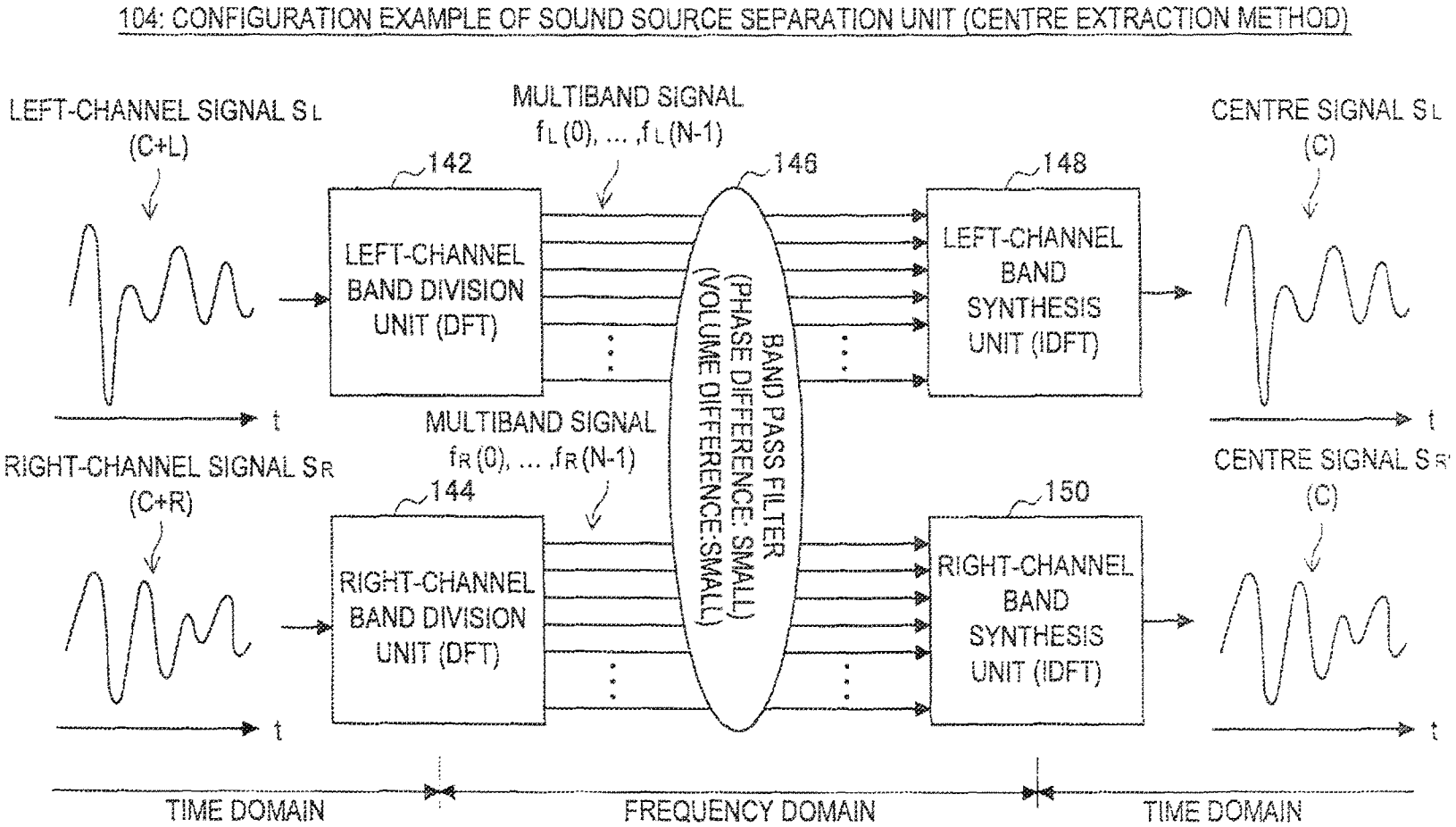
FIG. 3 is an explanatory diagram showing an example of a sound source separation method (centre extraction method) according to the present embodiment.

First, the sound source separation unit 104 will be described. The sound source separation unit 104 is means for separating sound source signals localized at the left, right and centre (hereunder, a left-channel signal, a right-channel signal, a centre signal), and a sound source signal for background sound. Here, referring to an extraction method of the sound source separation unit 104 for a centre signal, a sound source separation method of the sound source separation unit 104 will be described in detail. As shown in FIG. 3, the sound source separation unit 104 is configured, for example, from a left-channel band division unit 142, a right-channel band division unit 144, a band pass filter 146, a left-channel band synthesis unit 148 and a right-channel band synthesis unit 150. The conditions for passing the band pass filter 146 illustrated in FIG. 3 (phase difference: small, volume difference: small) are used in a case of extracting the centre signal. Here, a method for extracting the centre signal is described as an example.

First, a left-channel signal $s_L$ of the stereo signal input to the sound source separation unit 104 is input to the left-channel band division unit 142. A non-centre signal L and a centre signal C of the left channel are present in a mixed manner in the left-channel signal $s_L$. Furthermore, the left-channel signal $s_L$ is a volume level signal changing over time. Thus, the left-channel band division unit 142 performs a DFT processing on the left-channel signal $s_L$ that is input and converts the same from a signal in a time domain to a signal in a frequency domain (hereinafter, a multi-band signal $f_L(0), \ldots, f_L(N-1)$). Here, $f_L(K)$ is a sub-band signal corresponding to the k-th (k=0, . . . , N−1) frequency band. Moreover, the above-described DFT is an abbreviation for Discrete Fourier Transform. The left-channel multi-band signal output from the left-channel band division unit 142 is input to the band pass filter 146.

In a similar manner, a right-channel signal $s_R$ of the stereo signal input to the sound source separation unit 104 is input to the right-channel band division unit 144. A non-centre signal R and a centre signal C of the right channel are present in a mixed manner in the right-channel signal $s_R$. Furthermore, the right-channel signal $s_R$ is a volume level signal changing over time. Thus, the right-channel band division unit 144 performs the DFT processing on the right-channel signal $s_R$ that is input and converts the same from a signal in a time domain to a signal in a frequency domain (hereinafter, a multi-band signal $f_R(0), \ldots, f_R(N-1)$). Here, $f_R(k')$ is a sub-band signal corresponding to the k'-th (k'=0, . . . , N−1) frequency band. The right-channel multi-band signal output from the right-channel band division unit 144 is input to the band pass filter 146. Moreover, the number of bands into which the multi-band signals of each channel are divided is N (for example, N=8192).

As described above, the multi-band signals $f_L(k)$ (k=0, . . . , N−1) and $f_R(k')$ (k'=0, . . . , N−1) of respective channels are input to the band pass filter 146. In the following, frequency is labeled in the ascending order such as k=0, . . . , N−1, or k'=0, . . . , N−1. Furthermore, each of the signal components $f_L(k)$ and $f_R(k')$ are referred to as a sub-channel signal. First, in the band pass filter 146, the sub-channel signals $f_L(k)$ and $f_R(k')$ (k'=k) in the same frequency band are selected from the multi-band signals of both channels, and a similarity a(k) between the sub-channel signals is computed. The similarity a(k) is computed according to the following equations (5) and (6), for example. Here, an amplitude component and a phase component are included in the sub-channel signal. Thus, the similarity for the amplitude component is expressed as ap(k), and the similarity for the phase component is expressed as ai(k).

[Equation 5]

$$ai(k) = \cos\theta = \frac{\mathrm{Re}[f_R(k) f_L(k)^*]}{|f_R(k)||f_L(k)|} \tag{5}$$

$$ap(k) = \begin{cases} \dfrac{|f_R(k)|}{|f_L(k)|}, & |f_R(k)| \le |f_L(k)| \\ \dfrac{|f_L(k)|}{|f_R(k)|}, & |f_R(k)| > |f_L(k)| \end{cases} \tag{6}$$

Here, | . . . | indicates the norm of " . . . ". θ indicates the phase difference ($0 \le |\theta| \le \pi$) between $f_L(k)$ and $f_R(k)$. The superscript * indicates a complex conjugate. Re[ . . . ] indicates the real part of " . . . ". As is clear from the above-described equation (6), the similarity ap(k) for the amplitude component is 1 in case the norms of the sub-channel signals $f_L(k)$ and $f_R(k)$ agree. On the contrary, in case the norms of the sub-channel signals $f_L(k)$ and $f_R(k)$ do not agree, the similarity ap(k) takes a value less than 1. On the other hand, regarding the similarity ai(k) for the phase component, when the phase difference θ is 0, the similarity ai(k) is 1; when the phase difference θ is π/2, the similarity ai(k) is 0; and when the phase difference θ is π, the similarity ai(k) is −1. That is, the similarity ai(k) for the phase component is 1 in case the phases of the sub-channel signals $f_L(k)$ and $f_R(k)$ agree, and takes a value less than 1 in case the phases of the sub-channel signals $f_L(k)$ and $f_R(k)$ do not agree.

When a similarity a(k) for each frequency band k (k=0, . . . , N−1) is computed by the above-described method, a frequency band q corresponding to the similarities ap(q) and ai(q) (o≤q≤N−1) less than a specific threshold value is extracted by the band pass filter 146. Then, only the sub-channel signal in the frequency band q extracted by the band pass filter 146 is input to the left-channel band synthesis unit 148 or the right-channel band synthesis unit 150. For example, the sub-channel signal $f_L(q)$ ($q=q_0, \ldots, q_{n-1}$) is input to the left-channel band synthesis unit 148. Thus, the left-channel band synthesis unit 148 performs an IDFT processing on the sub-channel signal $f_L(q)$ ($q=q_0, \ldots, q_{n-1}$) input from the band pass filter 146, and converts the same from the frequency domain to the time domain. Moreover, the above-described IDFT is an abbreviation for Inverse Discrete Fourier Transform.

In a similar manner, the sub-channel signal $f_R(q)$ ($q=q_0, \ldots, q_{n-1}$) is input to the right-channel band synthesis unit 150. Thus, the right-channel band synthesis unit 150 performs the IDFT processing on the sub-channel signal $f_R(q)$ ($q=q_0, \ldots, q_{n-1}$) input from the band pass filter 146, and converts the same from the frequency domain to the time domain. A centre signal component $s_{L'}$ included in the left-channel signal $s_L$ is output from the left-channel band synthesis unit 148. On the other hand, a centre signal component $s_{R'}$ included in the right-channel signal $s_R$ is output from the right-channel band synthesis unit 150. The sound source separation unit 104 can extract the centre signal from the stereo signal by the above-described method.

Furthermore, the left-channel signal, the right-channel signal and the signal for background sound can be separated in the same manner as for the centre signal by changing the conditions for passing the band pass filter 146 as shown in FIG. 4. As shown in FIG. 4, in case of extracting the left-channel signal, a band according to which the phase difference between the left and the right is small and the left volume is higher than the right volume is set as the passband of the band pass filter 146. The volume here corresponds to the amplitude component described above. Similarly, in case of extracting the right-channel signal, a band in which the phase difference between the left and the right is small and the right volume is higher than the left volume is set as the passband of the band pass filter 146.

The left-channel signal, the right-channel signal and the centre signal are foreground signals. Thus, either of the signals is in a band according to which the phase difference between the left and the right is small. On the other hand, the signal for background sound is a signal in a band according to which the phase difference between the left and the right is large. Thus, in case of extracting the signal for background sound, the passband of the band pass filter 146 is set to a band according to which the phase difference between the left and the right is large. The left-channel signal, the right-channel signal, the centre signal and the signal for background sound separated by the sound source separation unit 104 in this manner are input to the log spectrum analysis unit 106 (refer to FIG. 2).

(2-3. Configuration Example of Log Spectrum Analysis Unit 106)

Next, the log spectrum analysis unit 106 will be described. The log spectrum analysis unit 106 is means for converting the input audio signal to an intensity distribution of each pitch. Twelve pitches (C, C#, D, D#, E, F, F#, G, G#, A, A#, B) are included in the audio signal per octave. Furthermore, a centre frequency of each pitch is logarithmically distributed. For example, when taking a centre frequency $f_{A3}$ of a pitch A3 as the standard, a centre frequency of A#3 is expressed as $f_{A\#3}=f_{A3}*2^{1/12}$. Similarly, a centre frequency $f_{B3}$ of a pitch B3 is expressed as $f_{B3}=f_{A\#3}*2^{1/12}$. In this manner, the ratio of the centre frequencies of the adjacent pitches is $1:2^{1/12}$. However, when handling an audio signal, taking the audio signal as a signal intensity distribution in a time-frequency space will cause the frequency axis to be a logarithmic axis, thereby complicating the processing on the audio signal. Thus, the log spectrum analysis unit 106 analyses the audio signal, and converts the same from a signal in the time-frequency space to a signal in a time-pitch space (hereinafter, a log spectrum).

Figure 5:
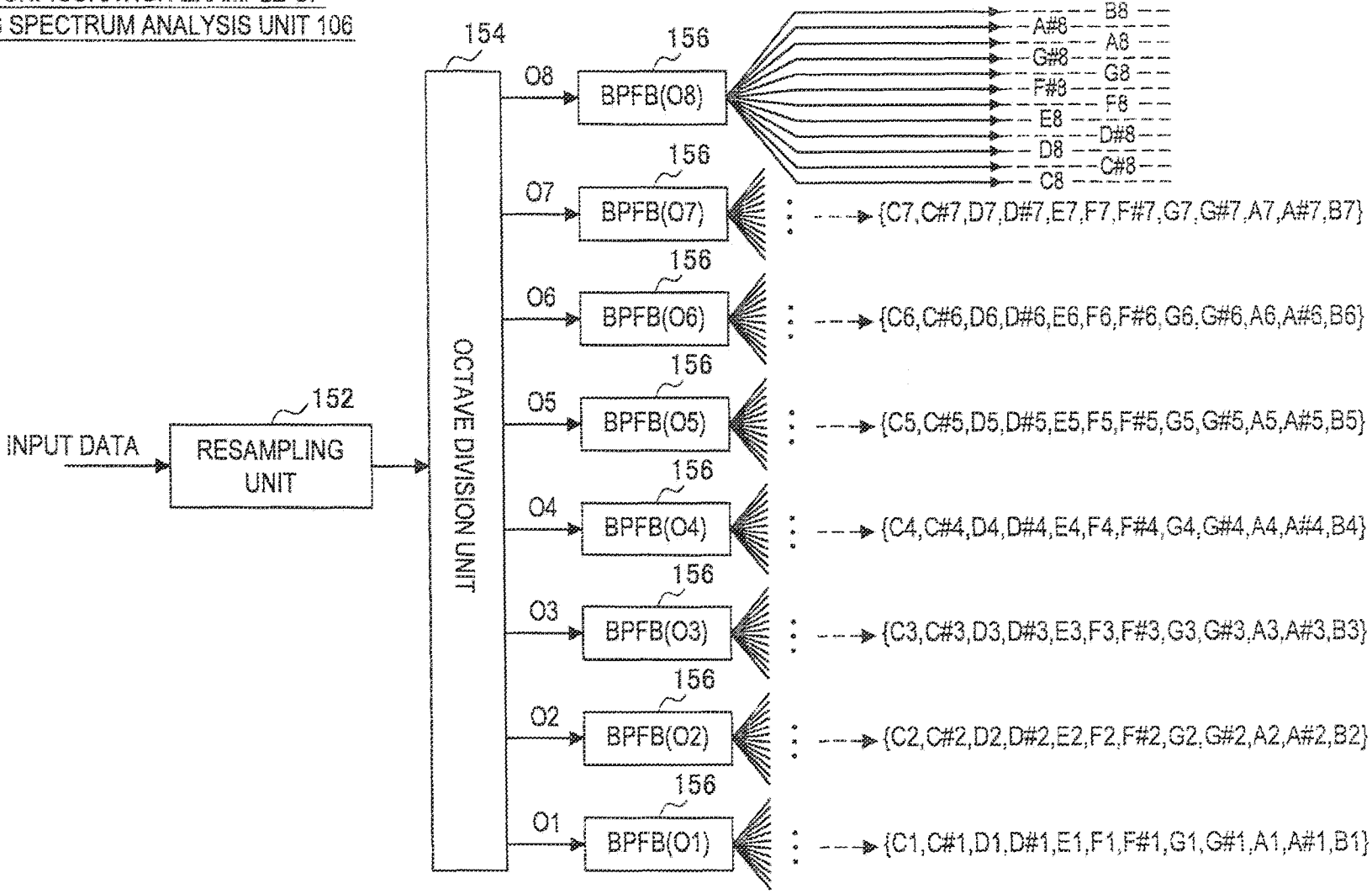
FIG. 5 is an explanatory diagram showing an example of a log spectrum generation method according to the present embodiment.

Referring to FIG. 5, the configuration of the log spectrum analysis unit 106 will be described in detail. As shown in FIG. 5, the log spectrum analysis unit 106 can be configured from a resampling unit 152, an octave division unit 154, and a plurality of band pass filter banks (BPFB) 156.

First, the audio signal is input to the resampling unit 152. Then, the resampling unit 152 converts a sampling frequency (for example, 44.1 kHz) of the input audio signal to a specific sampling frequency. A frequency obtained by taking a frequency at the boundary between octaves (hereinafter, a boundary frequency) as the standard and multiplying the boundary frequency by a power of two is taken as the specific sampling frequency. For example, the sampling frequency of the audio signal takes a boundary frequency 1016.7 Hz between an octave 4 and an octave 5 as the standard and is converted to a sampling frequency $2^5$ times the standard (32534.7 Hz). By converting the sampling frequency in this manner, the highest and lowest frequencies obtained as a result of a band division processing and a down sampling processing that are subsequently performed by the resampling unit 152 will agree with the highest and lowest frequencies of a certain octave. As a result, a process for extracting a signal for each pitch from the audio signal can be simplified.

The audio signal for which the sampling frequency is converted by the resampling unit 152 is input to the octave division unit 154. Then, the octave division unit 154 divides the input audio signal into signals for respective octaves by repeatedly performing the band division processing and the down sampling processing. Each of the signals obtained by the division by the octave division unit 154 is input to a band pass filter bank 156 (BPFB (O1), BPFB (O8)) provided for each of the octaves (O1, . . . , O8). Each band pass filter bank 156 is configured from 12 band pass filters each having a passband for one of 12 pitches so as to extract a signal for each pitch from the input audio signal for each octave. For example, by passing through the band pass filter bank 156 (BPFB (O8)) of octave 8, signals for 12 pitches (C8, C#8, D8, D#8, E8, F8, F#8, G8, G#8, A8, A#8, B) are extracted from the audio signal for the octave 8.

Figure 6:
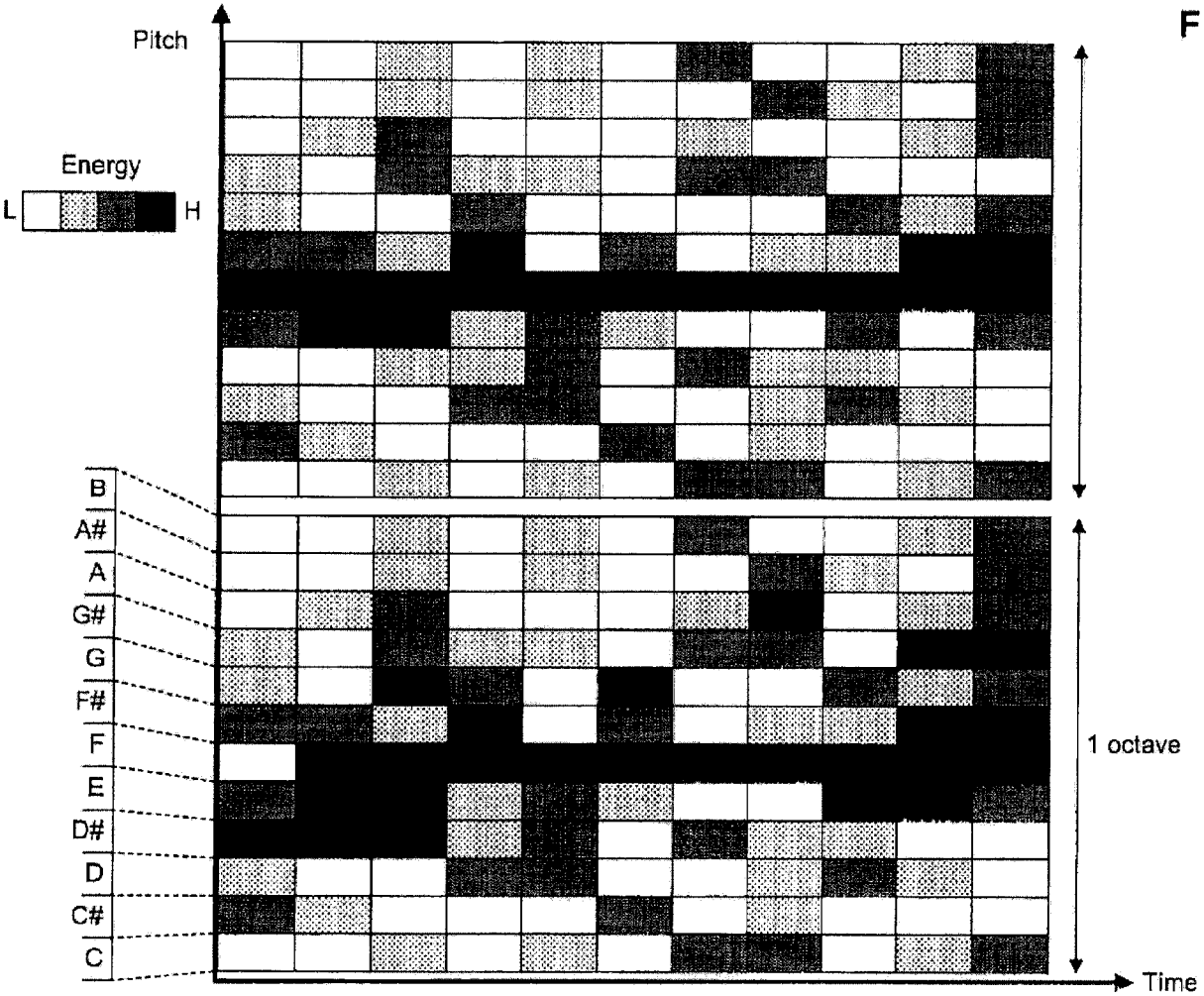
FIG. 6 is an explanatory diagram showing a log spectrum generated by the log spectrum generation method according to the present embodiment.

A log spectrum showing signal intensities (hereinafter, energies) of 12 pitches in each octave can be obtained by the signals output from each band pass filter bank 156. FIG. 6 is an explanatory diagram showing an example of the log spectrum output from the log spectrum analysis unit 106.

Referring to the vertical axis (pitch) of FIG. 6, the input audio signal is divided into 7 octaves, and each octave is further divided into 12 pitches: "C," "C#," "D," "D#," "E," "F," "F#," "G," "G#," "A," "A#," and "B." On the other hand, the horizontal axis (time) of FIG. 6 shows frame numbers at times of sampling the audio signal along the time axis. For example, when the audio signal is resampled at a sampling frequency 127.0888 (Hz) by the resampling unit 152, 1 frame will be a time period corresponding to 1 (sec)/127.0888=7.8686 (msec). Furthermore, the intensity of colours of the log spectrum shown in FIG. 6 indicates the intensity of the energy of each pitch at each frame. For example, a position S1 is shown with a dark colour, and thus it can be understood that note at the pitch (pitch F) corresponding to the position S1 is produced strongly at the time corresponding to the position S1. Moreover, FIG. 6 is an example of the log spectrum obtained when a certain audio signal is taken as the input signal. Accordingly, if the input signal is different, a different log spectrum is obtained. The log spectrum obtained in this manner is input to the feature quantity calculation formula generation apparatus 10 or the like, and is used for music analysis processing performed by the music analysis unit 108 (refer to FIG. 2).

(2-4. Configuration Example of Music Analysis Unit 108)

Next, the configuration of the music analysis unit 108 will be described. The music analysis unit 108 is means for analyzing music data by using a learning algorithm, and extracting feature quantity included in the music data. Particularly, the music analysis unit 108 extracts the beats, the chord progression and each of the instrument sounds included in the music data. Therefore, the music analysis unit 108 includes the beat detection unit 132, the chord progression detection unit 134, and the instrument sound analysis unit 136 as shown in FIG. 2.

Figure 7:
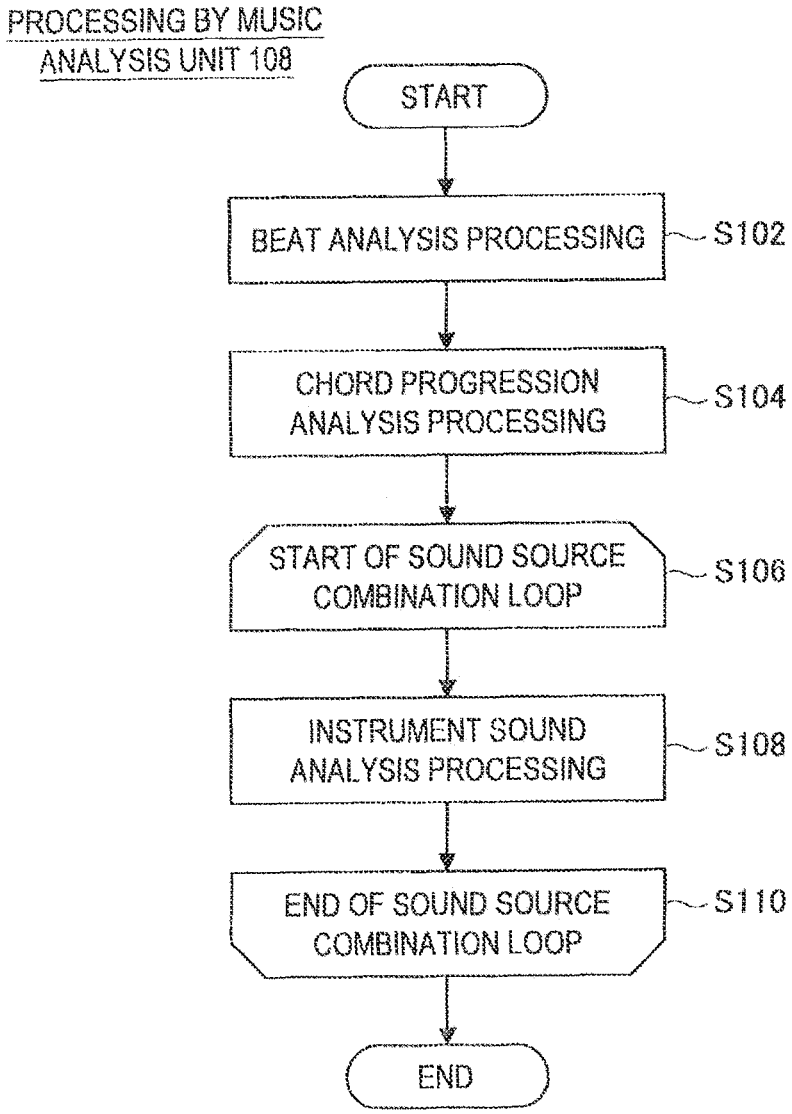
FIG. 7 is an explanatory diagram showing a flow of a series of processes according to a music analysis method according to the present embodiment.

The flow of processing by the music analysis unit 108 is as shown in FIG. 7. As shown in FIG. 7, the music analysis unit 108 first performs beat analysis processing by the beat detection unit 132 and detects beats in the music data (S102). Next, the music analysis unit 108 performs chord progression analysis processing by the chord progression detection unit 134 and detects chord progression of the music data (S104). Then, the music analysis unit 108 starts loop processing relating to combination of sound sources (S106).

All the four sound sources (left-channel sound, right-channel sound, centre sound and background sound) are used as the sound sources to be combined. The combination may be, for example, (1) all the four sound sources, (2) only the foreground sounds (left-channel sound, right-channel sound and centre sound), (3) left-channel sound+right-channel sound+background sound, or (4) centre sound+background sound. Furthermore, other combination may be, for example, (5) left-channel sound+right-channel sound, (6) only the background sound, (6) only the left-channel sound, (8) only the right-channel sound, or (9) only the centre sound. The processing within the loop started at step S106 is performed for the above-described (1) to (9), for example.

Next, the music analysis unit 108 performs instrument sound analysis processing by the instrument sound analysis unit 136 and extracts each of the instrument sounds included in the music data (S108). The type of each of the instrument sounds extracted here is vocals, a guitar sound, a bass sound, a keyboard sound, a drum sound, strings sounds or a brass sound, for example. Of course, other types of instrument sounds can also be extracted. When the instrument sound analysis processing is performed for all the combinations of the sound sources, the music analysis unit 108 ends the loop processing relating to the combinations of the sound sources (S110), and a series of processes relating to the music analysis is completed. When the series of processes is completed, the beats, the chord progression and each of the instrument sounds are input to the capture range determination unit 110 from the music analysis unit 108.

Hereunder, the configurations of the beat detection unit 132, the chord progression detection unit 134 and the instrument sound analysis unit 136 will be described in detail.

(2-4-1. Configuration Example of Beat Detection Unit 132)

Figure 8:
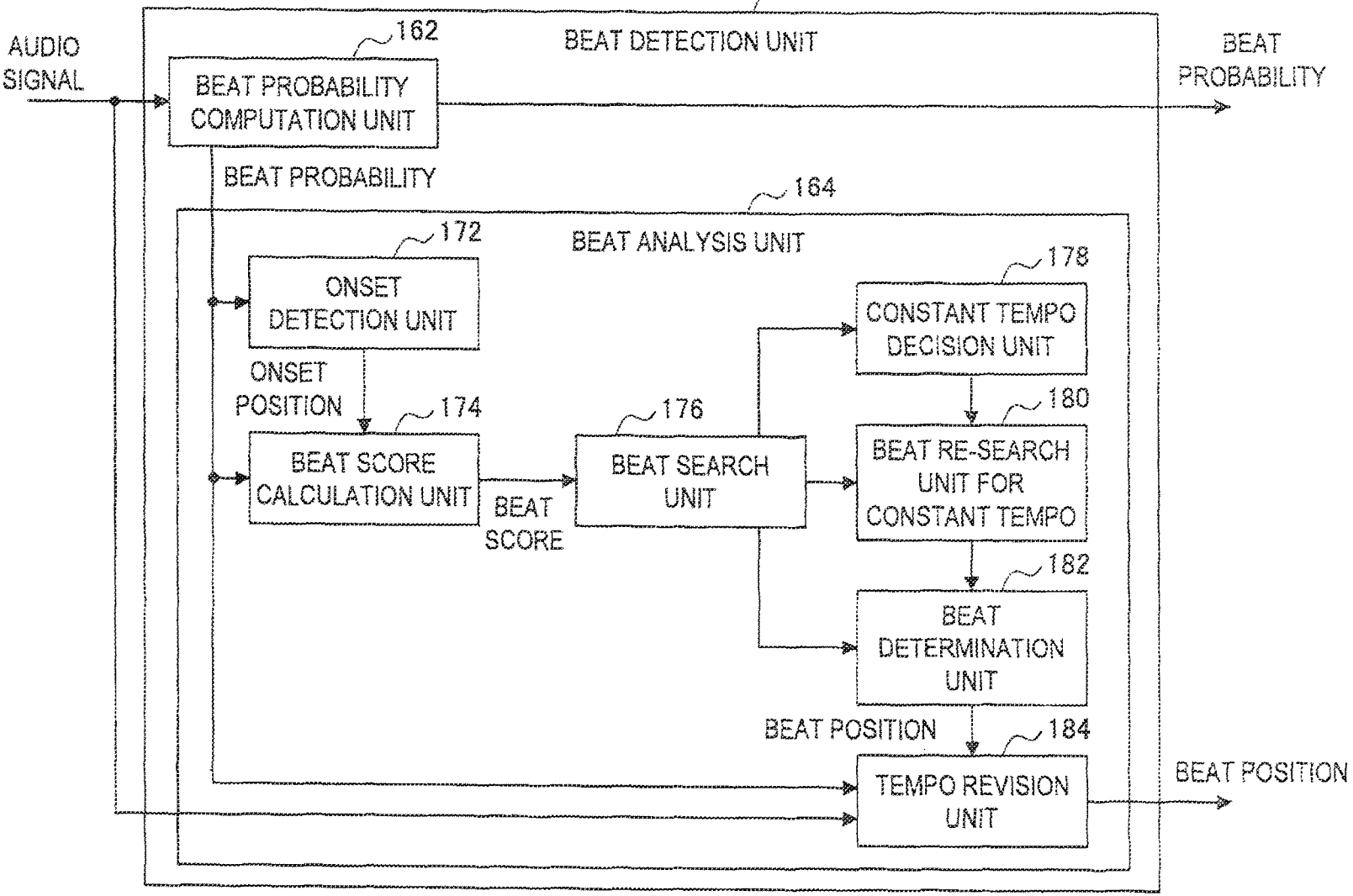
FIG. 8 is an explanatory diagram showing an example of a beat detection method according to the present embodiment.

First, the configuration of the beat detection unit 132 will be described. As shown in FIG. 8, the beat detection unit 132 is configured from a beat probability computation unit 162 and a beat analysis unit 164. The beat probability computation unit 162 is means for computing the probability of each frame being a beat position, based on the log spectrum of music data. Also, the beat analysis unit 164 is means for detecting the beat positions based on the beat probability of each frame computed by the beat probability computation unit 162. In the following, the functions of these structural elements will be described in detail.

Figure 9:
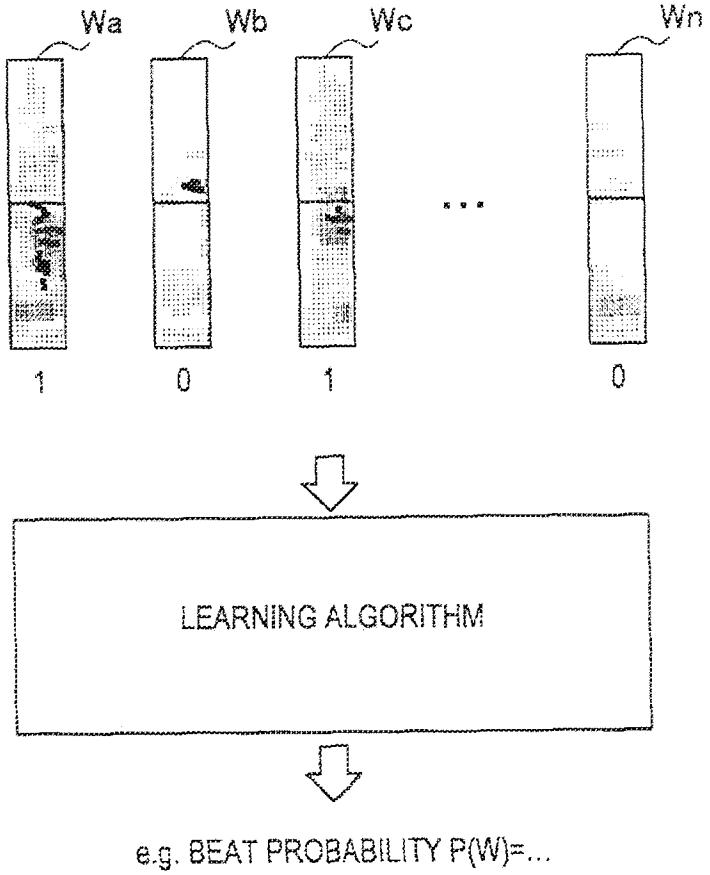
FIG. 9 is an explanatory diagram showing an example of the beat detection method according to the present embodiment.

First, the beat probability computation unit 162 will be described. The beat probability computation unit 162 computes, for each of specific time units (for example, 1 frame) of the log spectrum input from the log spectrum analysis unit 106, the probability of a beat being included in the time unit (hereinafter referred to as "beat probability"). Moreover, when the specific time unit is 1 frame, the beat probability may be considered to be the probability of each frame coinciding with a beat position (position of a beat on the time axis). A formula to be used by the beat probability computation unit 162 to compute the beat probability is generated by using the learning algorithm by the feature quantity calculation formula generation apparatus 10. Also, data such as those shown in FIG. 9 are given to the feature quantity calculation formula generation apparatus 10 as the teacher data and evaluation data for learning. In FIG. 9, the time unit used for the computation of the beat probability is 1 frame.

As shown in FIG. 9, fragments of log spectra (hereinafter referred to as "partial log spectrum") which has been converted from an audio signal of a music piece whose beat positions are known and beat probability for each of the partial log spectra are supplied to the feature quantity calculation formula generation apparatus 10. That is, the partial log spectrum is supplied to the feature quantity calculation formula generation apparatus 10 as the evaluation data, and the beat probability as the teacher data. Here, the window width of the partial log spectrum is determined taking into consideration the trade-off between the accuracy of the computation of the beat probability and the processing cost. For example, the window width of the partial log spectrum may include 7 frames preceding and following the frame for which the beat probability is to be calculated (i.e. 15 frames in total).

Furthermore, the beat probability supplied as the teacher data indicates, for example, whether a beat is included in the centre frame of each partial log spectrum, based on the known beat positions and by using a true value (1) or a false value (0). The positions of bars are not taken into consideration here, and when the centre frame corresponds to the beat position, the beat probability is 1; and when the centre frame does not correspond to the beat position, the beat probability is 0. In the example shown in FIG. 9, the beat probabilities of partial log spectra Wa, Wb, Wc, . . . , Wn are given respectively as 1, 0, 1, . . . , 0. A beat probability formula (P(W)) for computing the beat probability from the partial log spectrum is generated by the feature quantity calculation formula generation apparatus 10 based on a plurality of sets of evaluation data and teacher data. When the beat probability formula P(W) is generated in this manner, the beat probability computation unit 162 cuts out from a log spectrum of treated music data a partial log spectrum for each frame, and sequentially computes the beat probabilities by applying the beat probability formula P(W) to respective partial log spectra.

Figure 10:
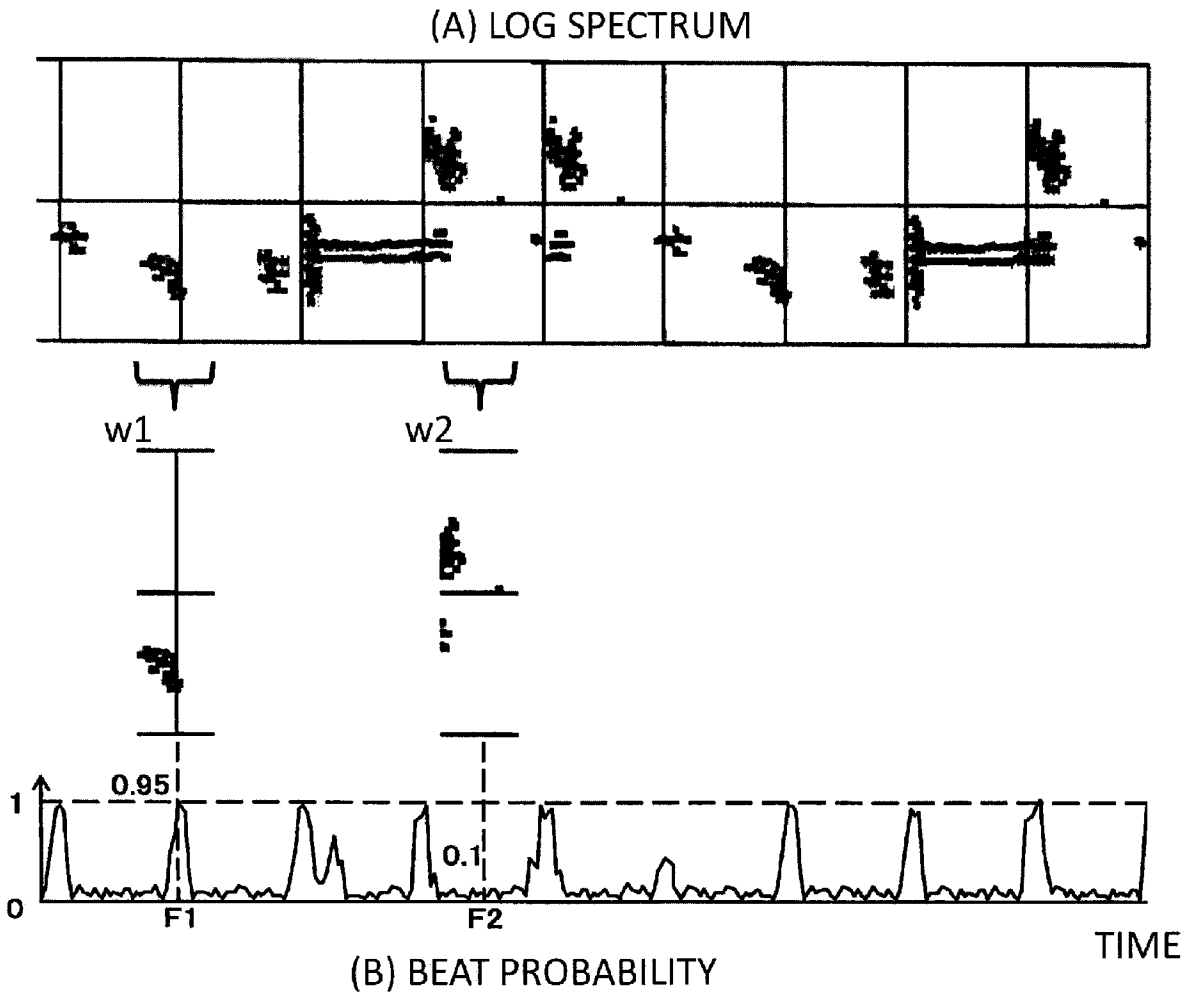
FIG. 10 is an explanatory diagram showing an example of the beat detection method according to the present embodiment.

FIG. 10 is an explanatory diagram showing an example of the beat probability computed by the beat probability computation unit 162. An example of the log spectrum to be input to the beat probability computation unit 162 from the log spectrum analysis unit 106 is shown in FIG. 10(A). On the other hand, in FIG. 10(B), the beat probability computed by the beat probability computation unit 162 based on the log spectrum (A) is shown with a polygonal line on the time axis. For example, referring to a frame position F1, it can be seen that a partial log spectrum W1 corresponds to the frame position F1. That is, beat probability P(W1)=0.95 of the frame F1 is computed from the partial log spectrum W1. Similarly, beat probability P(W2) of a frame position F2 is calculated to be 0.1 based on a partial log spectrum W2 cut out from the log spectrum. The beat probability P(W1) of the frame position F1 is high and the beat probability P(W2) of the frame position F2 is low, and thus it can be said that the possibility of the frame position F1 corresponding to a beat position is high, and the possibility of the frame position F2 corresponding to a beat position is low.

Moreover, the beat probability formula used by the beat probability computation unit 162 may be generated by another learning algorithm. However, it should be noted that, generally, the log spectrum includes a variety of parameters, such as a spectrum of drums, an occurrence of a spectrum due to utterance, and a change in a spectrum due to change of chord. In case of a spectrum of drums, it is highly probable that the time point of beating the drum is the beat position. On the other hand, in case of a spectrum of voice, it is highly probable that the beginning time point of utterance is the beat position. To compute the beat probability with high accuracy by collectively using the variety of parameters, it is suitable to use the feature quantity calculation formula generation apparatus 10 or the learning algorithm disclosed in JP-A-2008-123011. The beat probability computed by the beat probability computation unit 162 in the above-described manner is input to the beat analysis unit 164.

The beat analysis unit 164 determines the beat position based on the beat probability of each frame input from the beat probability computation unit 162. As shown in FIG. 8, the beat analysis unit 164 includes an onset detection unit 172, a beat score calculation unit 174, a beat search unit 176, a constant tempo decision unit 178, a beat re-search unit 180 for constant tempo, a beat determination unit 182, and a tempo revision unit 184. The beat probability of each frame is input from the beat probability computation unit 162 to the onset detection unit 172, the beat score calculation unit 174 and the tempo revision unit 184.

Figure 11:
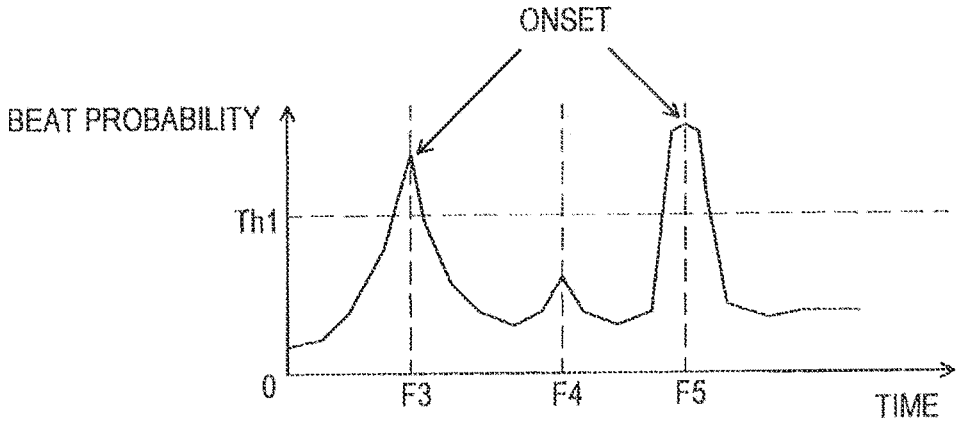
FIG. 11 is an explanatory diagram showing an example of the beat detection method according to the present embodiment.

The onset detection unit 172 detects onsets included in the audio signal based on the beat probability input from the beat probability computation unit 162. The onset here means a time point in an audio signal at which a sound is produced. More specifically, a point at which the beat probability is above a specific threshold value and takes a maximal value is referred to as the onset. For example, in FIG. 11, an example of the onsets detected based on the beat probability computed for an audio signal is shown. In FIG. 11, as with FIG. 10(B), the beat probability computed by the beat probability computation unit 162 is shown with a polygonal line on the time axis. In case of the graph for the beat probability illustrated in FIG. 11, the points taking a maximal value are three points, i.e. frames F3, F4 and F5. Among these, regarding the frames F3 and F5, the beat probabilities at the time points are above a specific threshold value Th1 given in advance. On the other hand, the beat probability at the time point of the frame F4 is below the threshold value Th1. In this case, two points, i.e. the frames F3 and F5, are detected as the onsets.

Figure 12:
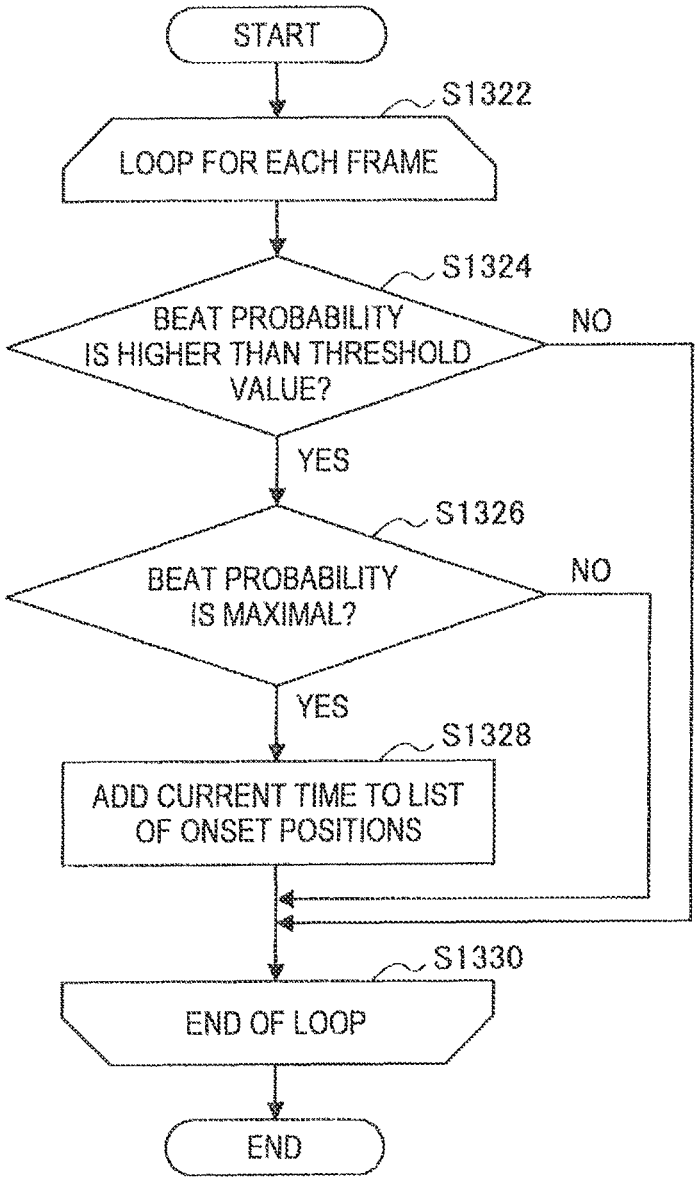
FIG. 12 is an explanatory diagram showing an example of the beat detection method according to the present embodiment.

Here, referring to FIG. 12, an onset detection process flow of the onset detection unit 172 will be briefly described. As shown in FIG. 12, first, the onset detection unit 172 sequentially executes a loop for the frames, starting from the first frame, with regard to the beat probability computed for each frame (S1322). Then, the onset detection unit 172 decides, with respect to each frame, whether the beat probability is above the specific threshold value (S1324), and whether the beat probability indicates a maximal value (S1326). Here, when the beat probability is above the specific threshold value and the beat probability is maximal, the onset detection unit 172 proceeds to the process of step S1328. On the other hand, when the beat probability is below the specific threshold value, or the beat probability is not maximal, the process of step S1328 is skipped. At step S1328, current times (or frame numbers) are added to a list of the onset positions (S1328). Then, when the processing regarding all the frames is over, the loop of the onset detection process is ended (S1330).

Figure 13:
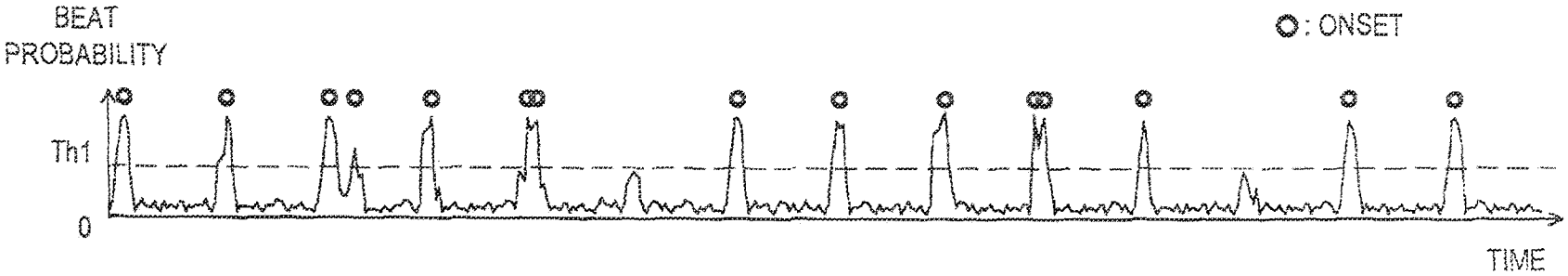
FIG. 13 is an explanatory diagram showing an example of the beat detection method according to the present embodiment.

With the onset detection process by the onset detection unit 172 as described above, a list of the positions of the onsets included in the audio signal (a list of times or frame numbers of respective onsets) is generated. Also, with the above-described onset detection process, positions of onsets as shown in FIG. 13 are detected, for example. FIG. 13 shows the positions of the onsets detected by the onset detection unit 172 in relation to the beat probability. In FIG. 13, the positions of the onsets detected by the onset detection unit 172 are shown with circles above the polygonal line showing the beat probability. In the example of FIG. 13, maximal values with the beat probabilities above the threshold value Th1 are detected as 15 onsets. The list of the positions of the onsets detected by the onset detection unit 172 in this manner is output to the beat score calculation unit 174 (refer to FIG. 8).

The beat score calculation unit 174 calculates, for each onset detected by the onset detection unit 172, a beat score indicating the degree of correspondence to a beat among beats forming a series of beats with a constant tempo (or a constant beat interval).

Figure 14:
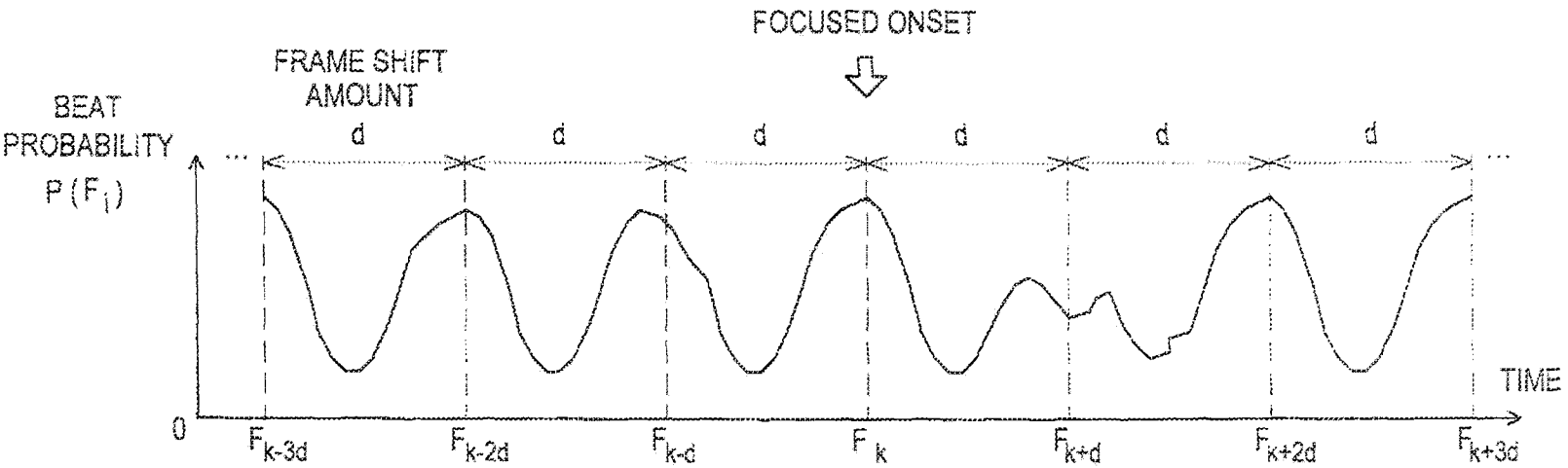
FIG. 14 is an explanatory diagram showing an example of the beat detection method according to the present embodiment.

First, the beat score calculation unit 174 sets a focused onset as shown in FIG. 14. In the example of FIG. 14, among the onsets detected by the onset detection unit 172, the onset at a frame position $F_k$ (frame number k) is set as a focused onset. Furthermore, a series of frame positions $F_{k-3}$, $F_{k-2}$, $F_{k-1}$, $F_k$, $F_{k+1}$, $F_{k+2}$, and $F_{k+3}$ distanced from the frame position $F_k$ at integer multiples of a specific distance d is being referred. In the following, the specific distance d is referred to as a shift amount, and a frame position distanced at an integer multiple of the shift amount d is referred to as a shift position. The beat score calculation unit 174 takes the sum of the beat probabilities at all the shift positions ( . . . $F_{k-3}$, $F_{k-2}$, $F_{k-1}$, $F_k$, $F_{k+1}$, $F_{k+2}$, and $F_{k+3}$ . . . ) included in a group F of frames for which the beat probability has been calculated as the beat score of the focused onset. For example, when the beat probability at a frame position $F_i$ is $P(F_i)$, a beat score BS(k,d) in relation to the frame number k and the shift amount d for the focused onset is expressed by the following equation (7). The beat score BS(k,d) expressed by the following equation (7) can be said to be the score indicating the possibility of an onset at the k-th frame of the audio signal being in sync with a constant tempo having the shift amount d as the beat interval.

[Equation 6]

$$BS(k, d) = \sum_{n} P(F_{k+nd}) \tag{7}$$

Figure 15:
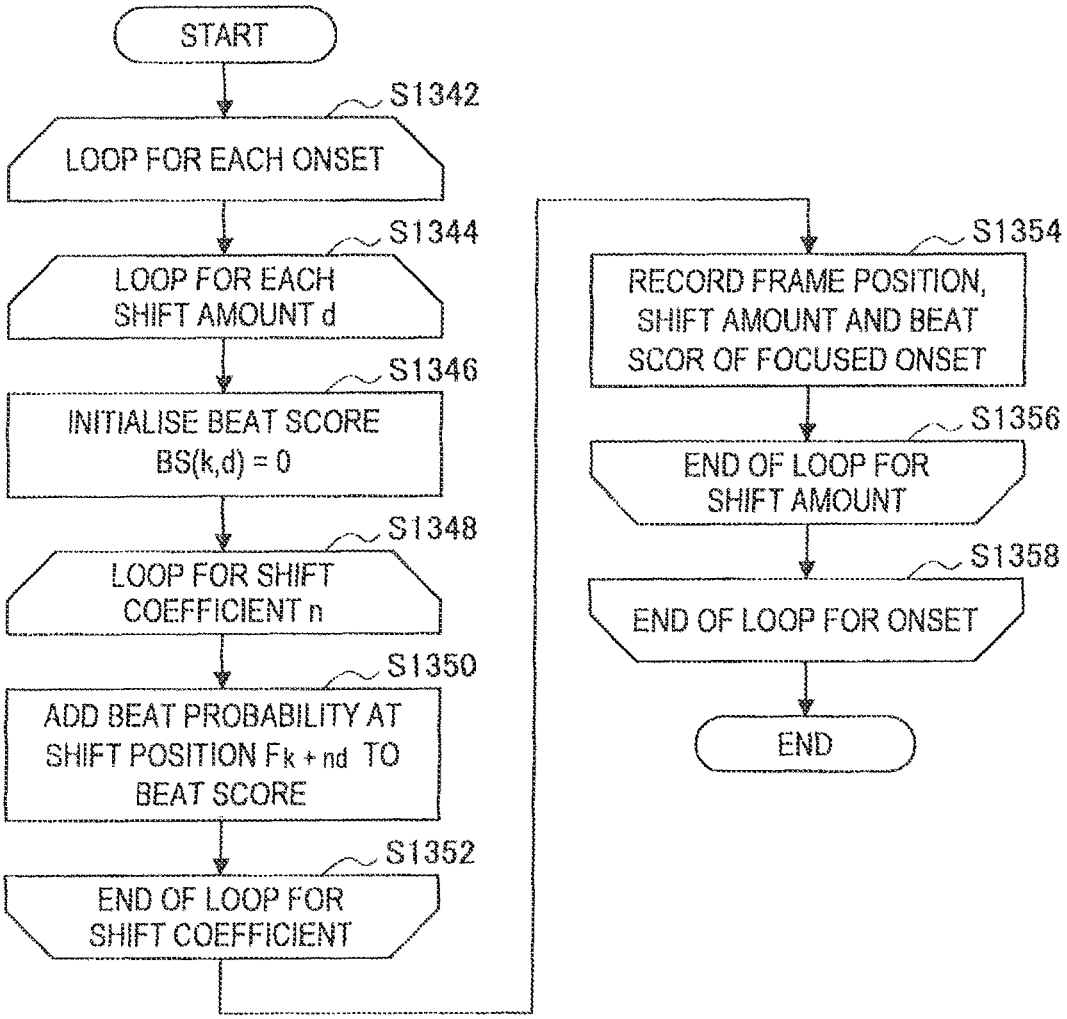
FIG. 15 is an explanatory diagram showing an example of the beat detection method according to the present embodiment.

Here, referring to FIG. 15, a beat score calculation processing flow of the beat score calculation unit 174 will be briefly described.

As shown in FIG. 15, first, the beat score calculation unit 174 sequentially executes a loop for the onsets, starting from the first onset, with regard to the onsets detected by the onset detection unit 172 (S1322). Furthermore, the beat score calculation unit 174 executes a loop for each of all the shift amounts d with regard to the focused onset (S1344). The shift amounts d, which are the subjects of the loop, are the values of the intervals at all the beats which may be used in a music performance. The beat score calculation unit 174 then initialises the beat score BS(k,d) (that is, zero is substituted into the beat score BS(K,d)) (S1346). Next, the beat score calculation unit 174 executes a loop for a shift coefficient n for shifting a frame position $F_d$ of the focused onset (S1348). Then, the beat score calculation unit 174 sequentially adds the beat probability $P(F_{k+nd})$ at each of the shift positions to the beat score BS(k,d) (S1350). Then, when the loop for all the shift coefficients n is over (S1352), the beat score calculation unit 174 records the frame position (frame number k), the shift amount d and the beat score BS(k,d) of the focused onset (S1354). The beat score calculation unit 174 repeats this computation of the beat score BS(k,d) for every shift amount of all the onsets (S1356, S1358).

Figure 16:
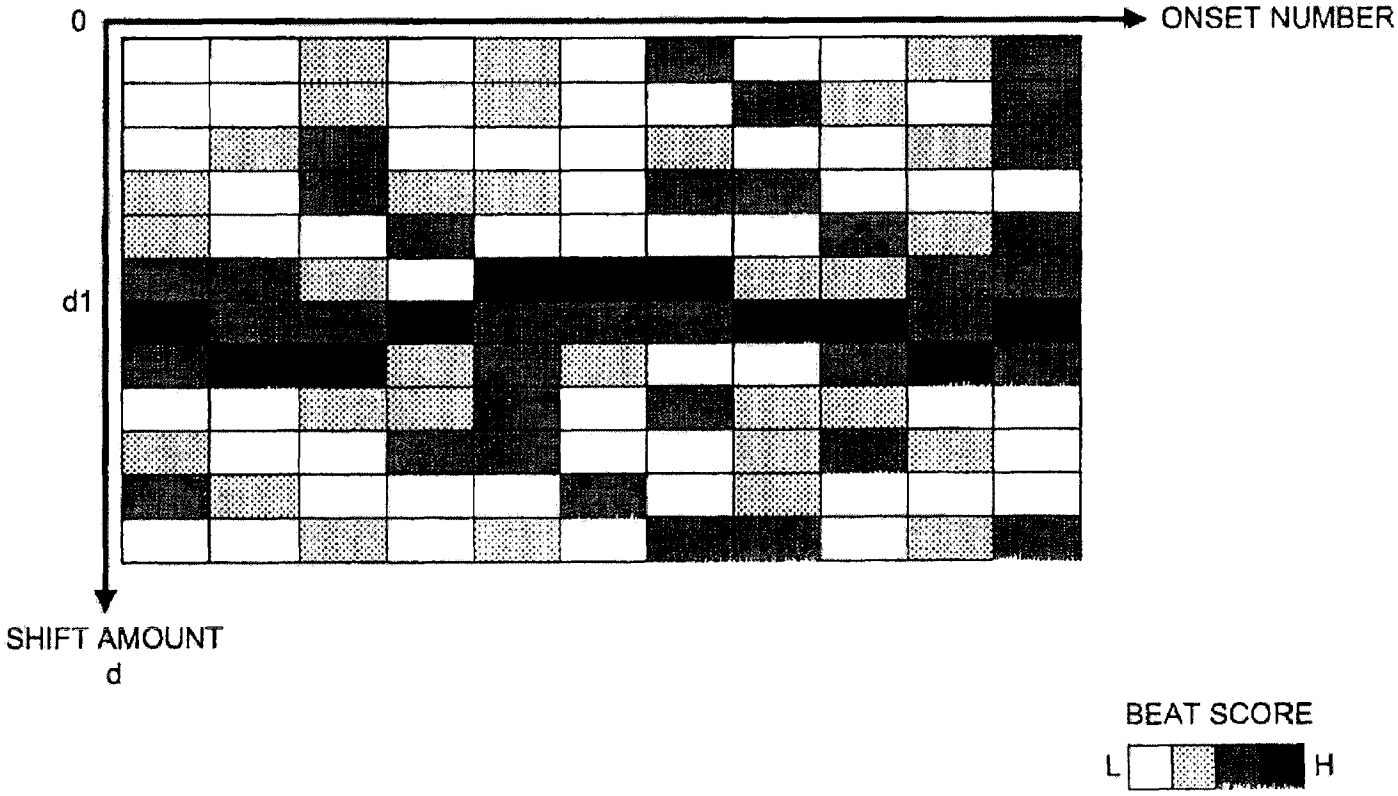
FIG. 16 is an explanatory diagram showing an example of the beat detection method according to the present embodiment.

With the beat score calculation process by the beat score calculation unit 174 as described above, the beat score BS(k, d) across a plurality of the shift amounts d is output for every onset detected by the onset detection unit 172. A beat score distribution chart as shown in FIG. 16 is obtained by the above-described beat score calculation process. The beat score distribution chart visualizes the beat scores output from the beat score calculation unit 174. In FIG. 16, the onsets detected by the onset detection unit 172 are shown in time series along the horizontal axis. The vertical axis in FIG. 16 indicates the shift amount for which the beat score for each onset has been computed. Furthermore, the intensity of the colour of each dot in the figure indicates the level of the beat score calculated for the onset at the shift amount. In the example of FIG. 16, in the vicinity of a shift amount d1, the beat scores are high for all the onsets. When assuming that the music piece is played at a tempo at the shift amount d1, it is highly possible that many of the detected onsets correspond to the beats. The beat scores calculated by the beat score calculation unit 174 are input to the beat search unit 176.

Figure 17:
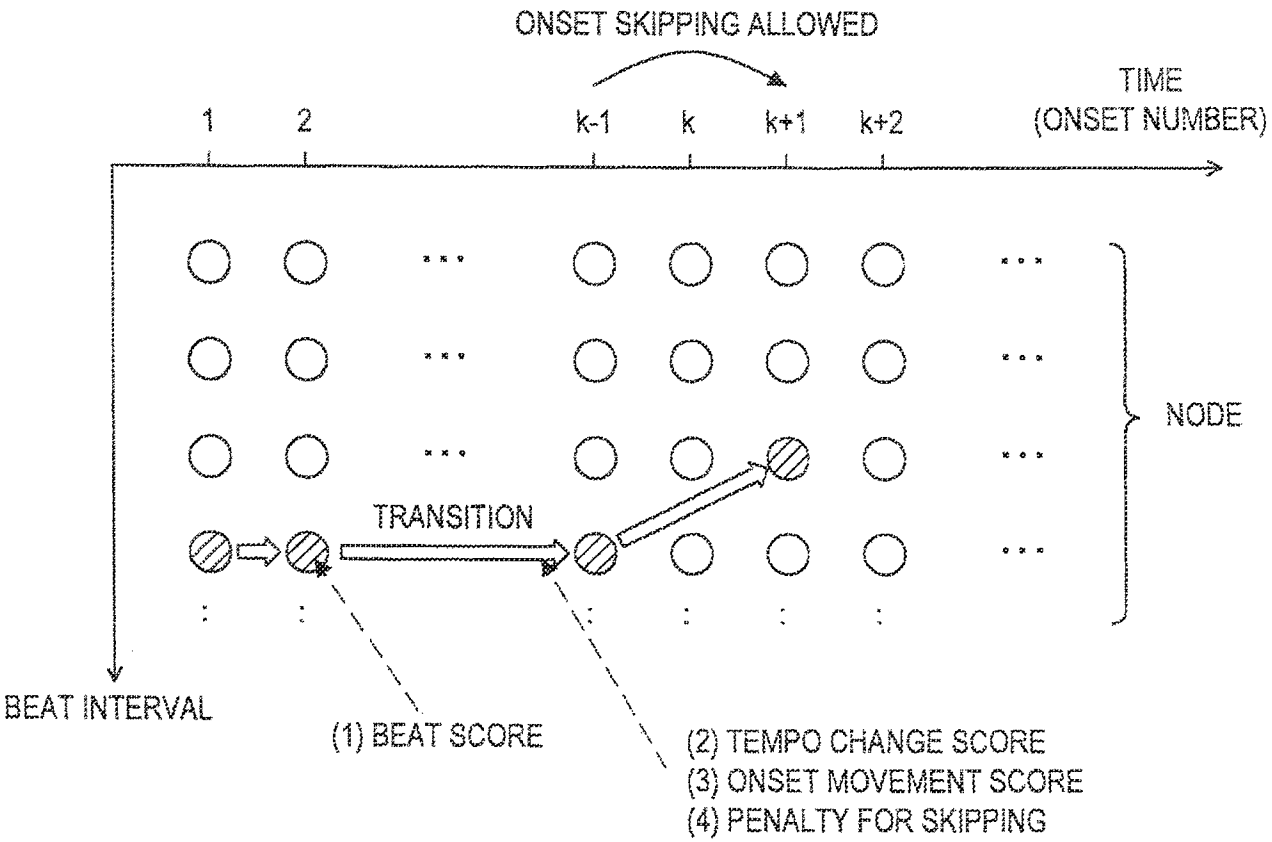
FIG. 17 is an explanatory diagram showing an example of the beat detection method according to the present embodiment.

The beat search unit 176 searches for a path of onset positions showing a likely tempo fluctuation, based on the beat scores computed by the beat score calculation unit 174. A Viterbi search algorithm based on hidden Markov model may be used as the path search method by the beat search unit 176, for example. For the Viterbi search by the beat search unit 176, the onset number is set as the unit for the time axis (horizontal axis) and the shift amount used at the time of beat score computation is set as the observation sequence (vertical axis) as schematically shown in FIG. 17, for example. The beat search unit 176 searches for a Viterbi path connecting nodes respectively defined by values of the time axis and the observation sequence. In other words, the beat search unit 176 takes as the target node for the path search each of all the combinations of the onset and the shift amount used at the time of calculating the beat score by the beat score calculation unit 174. Moreover, the shift amount of each node is equivalent to the beat interval assumed for the node. Thus, in the following, the shift amount of each node may be referred to as the beat interval.

With regard to the node as described, the beat search unit 176 sequentially selects, along the time axis, any of the nodes, and evaluates a path formed from a series of the selected nodes. At this time, in the node selection, the beat search unit 176 is allowed to skip onsets. For example, in the example of FIG. 17, after the k−1st onset, the k-th onset is skipped and the k+1st onset is selected. This is because normally onsets that are beats and onsets that are not beats are mixed in the onsets, and a likely path has to be searched from among paths including paths not going through onsets that are not beats.

For example, for the evaluation of a path, four evaluation values may be used, namely (1) beat score, (2) tempo change score, (3) onset movement score, and (4) penalty for skipping. Among these, (1) beat score is the beat score calculated by the beat score calculation unit 174 for each node. On the other hand, (2) tempo change score, (3) onset movement score and (4) penalty for skipping are given to a transition between nodes. Among the evaluation values to be given to a transition between nodes, (2) tempo change score is an evaluation value given based on the empirical knowledge that, normally, a tempo fluctuates gradually in a music piece. Thus, a value given to the tempo change score is higher as the difference between the beat interval at a node before transition and the beat interval at a node after the transition is smaller.

Figure 18:
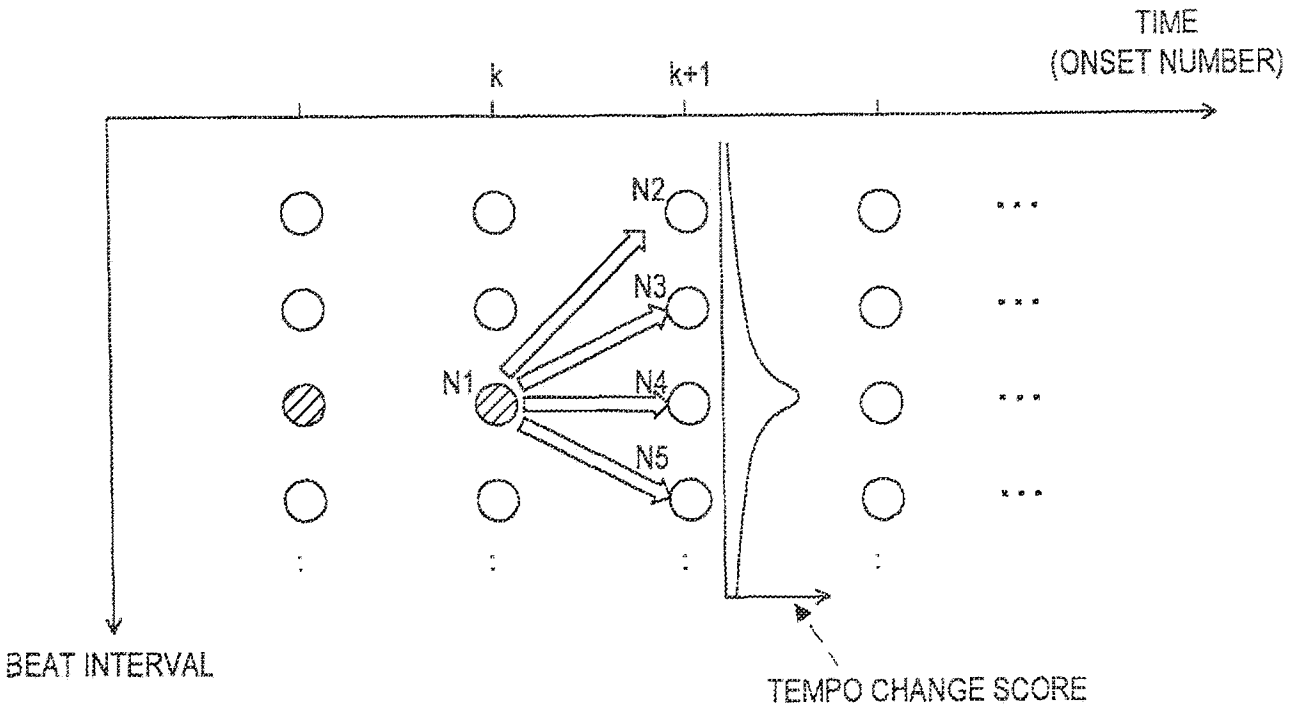
FIG. 18 is an explanatory diagram showing an example of the beat detection method according to the present embodiment.

Here, referring to FIG. 18, (2) tempo change score will be described in detail. In the example of FIG. 18, a node N1 is currently selected. The beat search unit 176 possibly selects any of nodes N2 to N5 as the next node. Although nodes other than N2 to N5 might also be selected, for the sake of convenience of description, four nodes, i.e. nodes N2 to N5, will be described. Here, when the beat search unit 176 selects the node N4, since there is no difference between the beat intervals at the node N1 and the node N4, the highest value will be given as the tempo change score. On the other hand, when the beat search unit 176 selects the node N3 or N5, there is a difference between the beat intervals at the node N1 and the node N3 or N5, and thus, a lower tempo change score compared to when the node N4 is selected is given. Furthermore, when the beat search unit 176 selects the node N2, the difference between the beat intervals at the node N1 and the node N2 is larger than when the node N3 or N5 is selected. Thus, an even lower tempo score is given.

Figure 19:
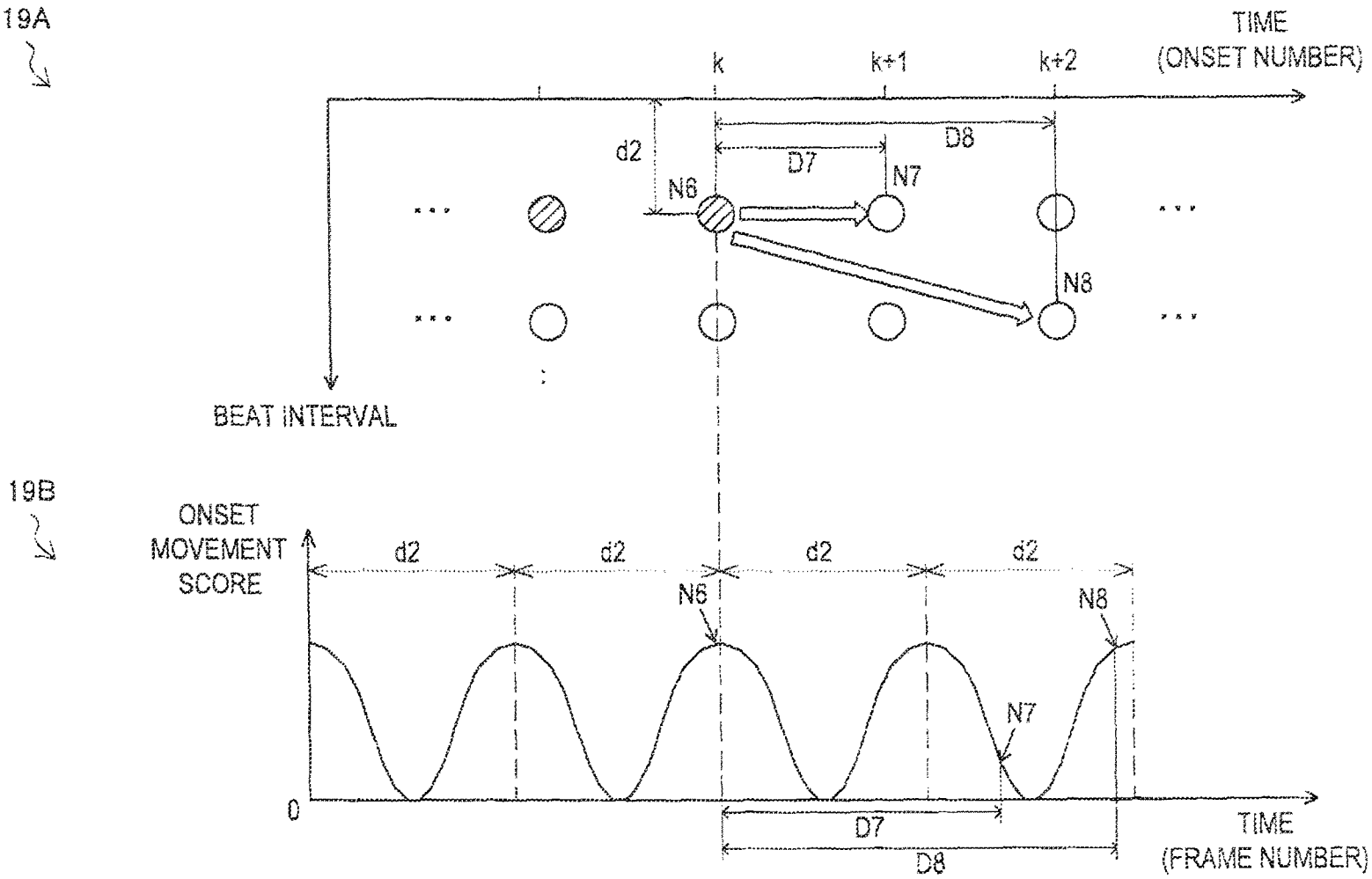
FIG. 19 is an explanatory diagram showing an example of the beat detection method according to the present embodiment.

Next, referring to FIG. 19, (3) onset movement score will be described in detail. The onset movement score is an evaluation value given in accordance with whether the interval between the onset positions of the nodes before and after the transition matches the beat interval at the node before the transition. In FIG. 19(A), a node N6 with a beat interval d2 for the k-th onset is currently selected. Also, two nodes, N7 and N8 are shown as the nodes which may be selected next by the beat search unit 176. Among these, the node N7 is a node of the k+1st onset, and the interval between the k-th onset and the k+1st onset (for example, difference between the frame numbers) is D7. On the other hand, the node N8 is a node of the k+2nd onset, and the interval between the k-th onset and the k+2nd onset is D8.

Here, when assuming an ideal path where all the nodes on the path correspond, without fail, to the beat positions in a constant tempo, the interval between the onset positions of adjacent nodes is an integer multiple (same interval when there is no rest) of the beat interval at each node. Thus, as shown in FIG. 19(B), a higher onset movement score is given as the interval between the onset positions is closer to the integer multiple of the beat interval d2 at the node N6, in relation to the current node N6. In the example of FIG. 19(B), since the interval D8 between the nodes N6 and N8 is closer to the integer multiple of the beat interval d2 at the node N6 than the interval D7 between the nodes N6 and N7, a higher onset movement score is given to the transition from the node N6 to the node N8.

Figure 20:
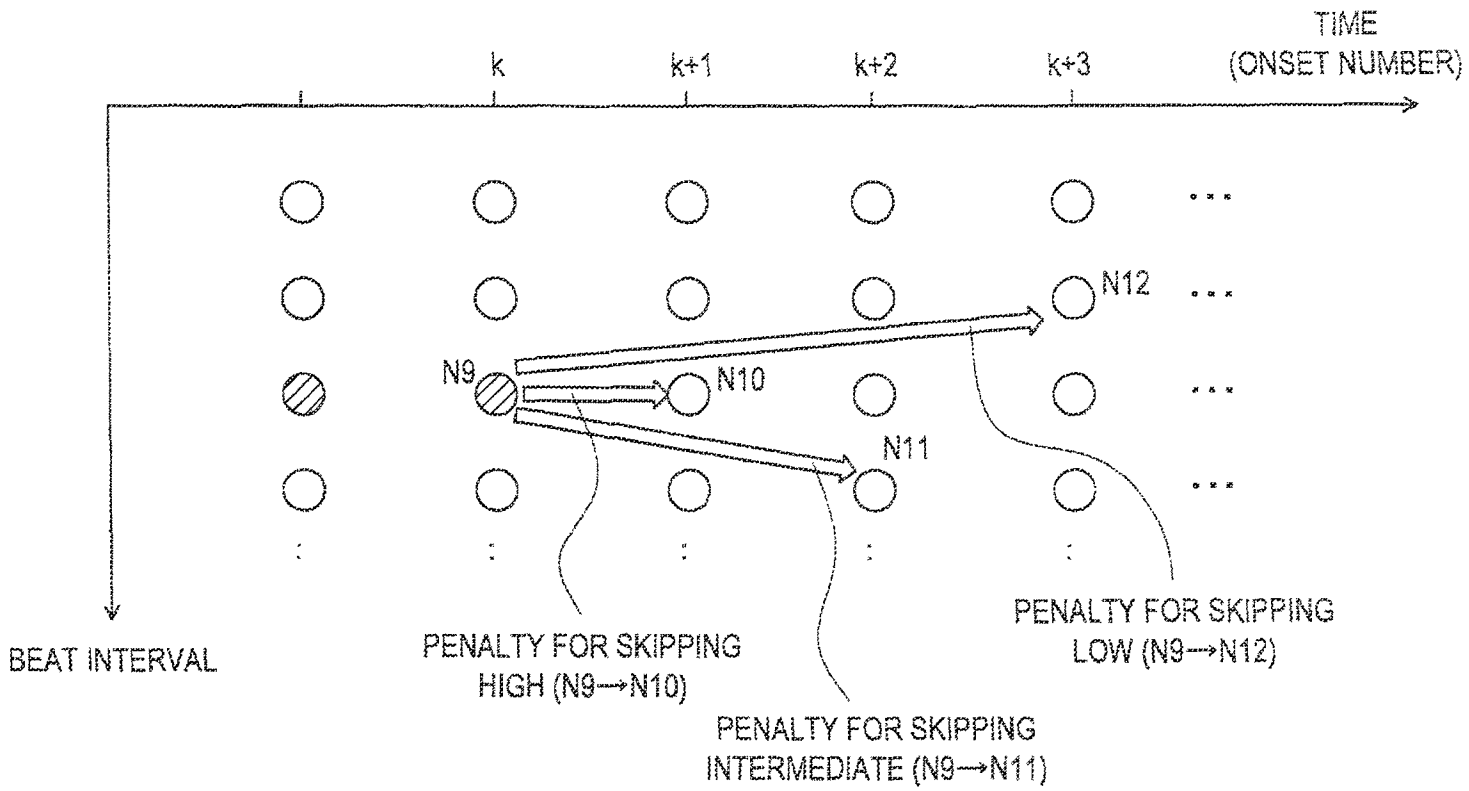
FIG. 20 is an explanatory diagram showing an example of the beat detection method according to the present embodiment.

Next, referring to FIG. 20, (4) penalty for skipping is described in detail. The penalty for skipping is an evaluation value for restricting an excessive skipping of onsets in a transition between nodes. Accordingly, the score is lower as more onsets are skipped in one transition, and the score is higher as fewer onsets are skipped in one transition. Here, lower score means higher penalty. In the example of FIG. 20, a node N9 of the k-th onset is selected as the current node. Also, in the example of FIG. 20, three nodes, N10, N11 and N12 are shown as the nodes which may be selected next by the beat search unit 176. The node N10 is the node of the k+1st onset, the node. N11 is the node of the k+2nd onset, and the node N12 is the node of the k+3rd onset.

Accordingly, in case of transition from the node N9 to the node N10, no onset is skipped. On the other hand, in case of transition from the node N9 to the node N11, the k+1st onset is skipped. Also, in case of transition from the node N9 to the node N12, the k+1st and k+2nd onsets are skipped. Thus, the penalty for skipping takes a relatively high value in case of transition from the node N9 to the node N10, an intermediate value in case of transition from the node N9 to the node N11, and a low value in case of transition from the node N9 to the node N12. As a result, at the time of the path search, a phenomenon that a larger number of onsets are skipped to thereby make the interval between the nodes constant can be prevented.

Figure 21:
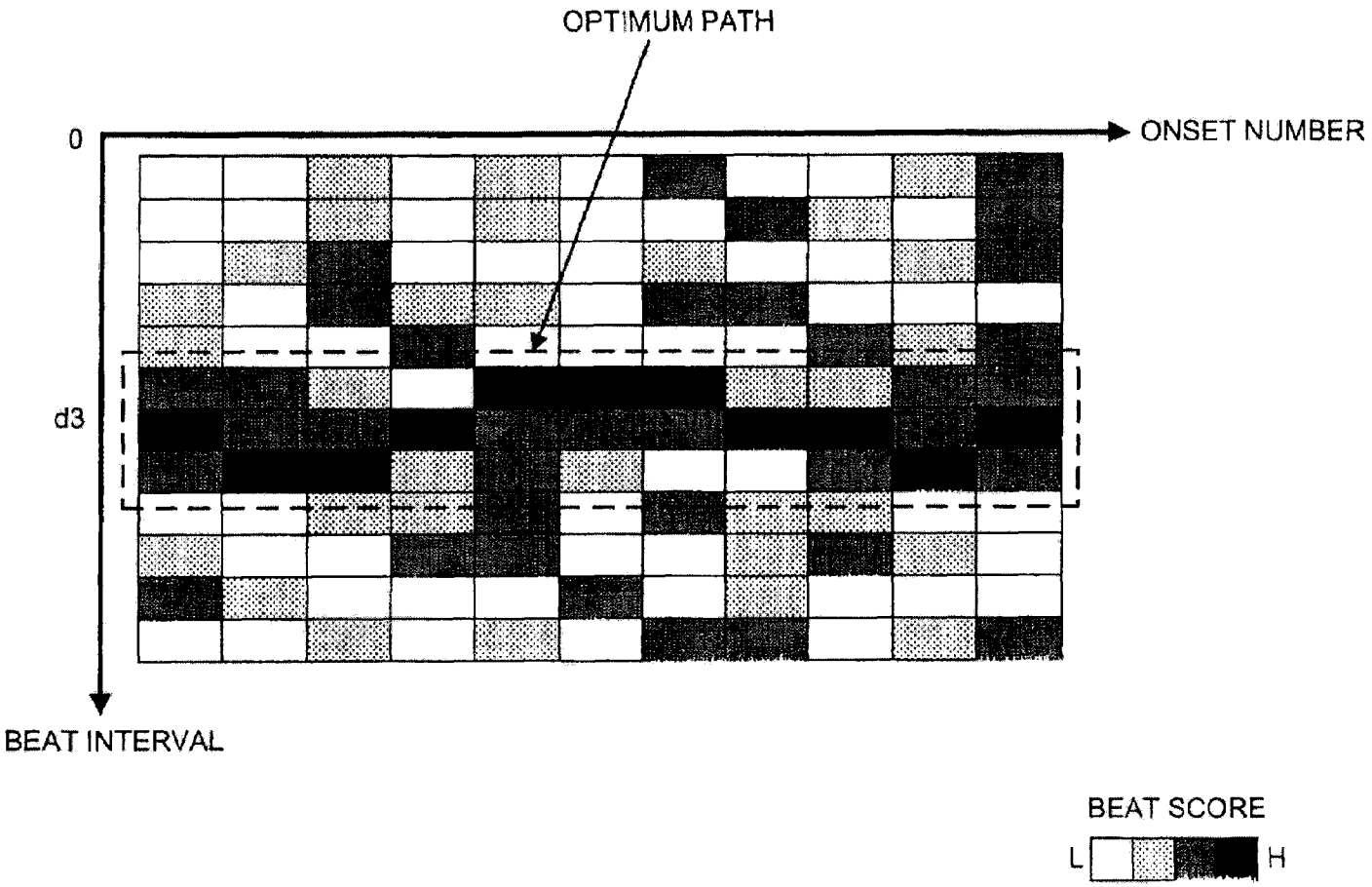
FIG. 21 is an explanatory diagram showing an example of the beat detection method according to the present embodiment.

Heretofore, the four evaluation values used for the evaluation of paths searched out by the beat search unit 176 have been described. The evaluation of paths described by using FIG. 17 is performed, with respect to a selected path, by sequentially multiplying by each other the evaluation values of the above-described (1) to (4) given to each node or for the transition between nodes included in the path. The beat search unit 176 determines, as the optimum path, the path whose product of the evaluation values is the largest among all the conceivable paths. The path determined in this manner is as shown in FIG. 21, for example. FIG. 21 shows an example of a Viterbi path determined as the optimum path by the beat search unit 176. In the example of FIG. 21, the optimum path determined by the beat search unit 176 is outlined by dotted-lines on the beat score distribution chart shown in FIG. 16. In the example of FIG. 21, it can be seen that the tempo of the music piece for which search is conducted by the beat search unit 176 fluctuates, centring on a beat interval d3. The optimum path (a list of nodes included in the optimum path) determined by the beat search unit 176 is input to the constant tempo decision unit 178, the beat re-search unit 180 for constant tempo, and the beat determination unit 182.

Figure 22:
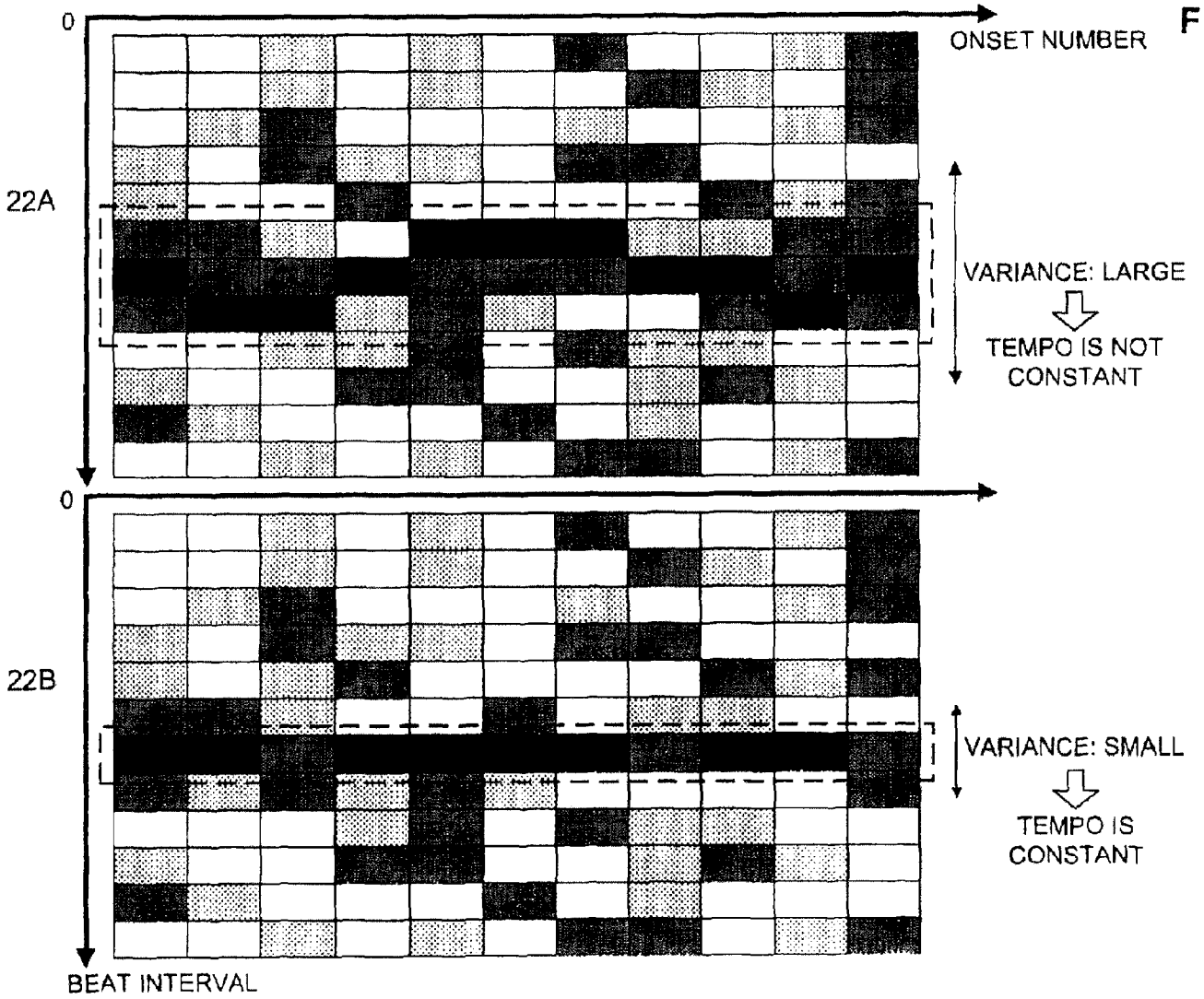
FIG. 22 is an explanatory diagram showing an example of the beat detection method according to the present embodiment.

The constant tempo decision unit 178 decides whether the optimum path determined by the beat search unit 176 indicates a constant tempo with low variance of beat intervals that are assumed for respective nodes. First, the constant tempo decision unit 178 calculates the variance for a group of beat intervals at nodes included in the optimum path input from the beat search unit 176. Then, when the computed variance is less than a specific threshold value given in advance, the constant tempo decision unit 178 decides that the tempo is constant; and when the computed variance is more than the specific threshold value, the constant tempo decision unit 178 decides that the tempo is not constant. For example, the tempo is decided by the constant tempo decision unit 178 as shown in FIG. 22.

For example, in the example shown in FIG. 22(A), the beat interval for the onset positions in the optimum path outlined by the dotted-lines varies according to time. With such a path, the tempo may be decided as not constant as a result of a decision relating to a threshold value by the constant tempo decision unit 178. On the other hand, in the example shown in FIG. 22(B), the beat interval for the onset positions in the optimum path outlined by the dotted-lines is nearly constant through out the music piece. Such a path may be decided as constant as a result of the decision relating to a threshold value by the constant tempo decision unit 178. The result of the decision relating to a threshold value by the constant tempo decision unit 178 obtained in this manner is input to the beat re-search unit 180 for constant tempo.

When the optimum path extracted by the beat search unit 176 is decided by the constant tempo decision unit 178 to indicate a constant tempo, the beat re-search unit 180 for constant tempo re-executes the path search, limiting the nodes which are the subjects of the search to those only around the most frequently appearing beat intervals. For example, the beat re-search unit 180 for constant tempo executes a re-search process for a path by a method illustrated in FIG. 23. Moreover, as with FIG. 17, the beat re-search unit 180 for constant tempo executes the re-search process for a path for a group of nodes along a time axis (onset number) with the beat interval as the observation sequence.

Figure 23:
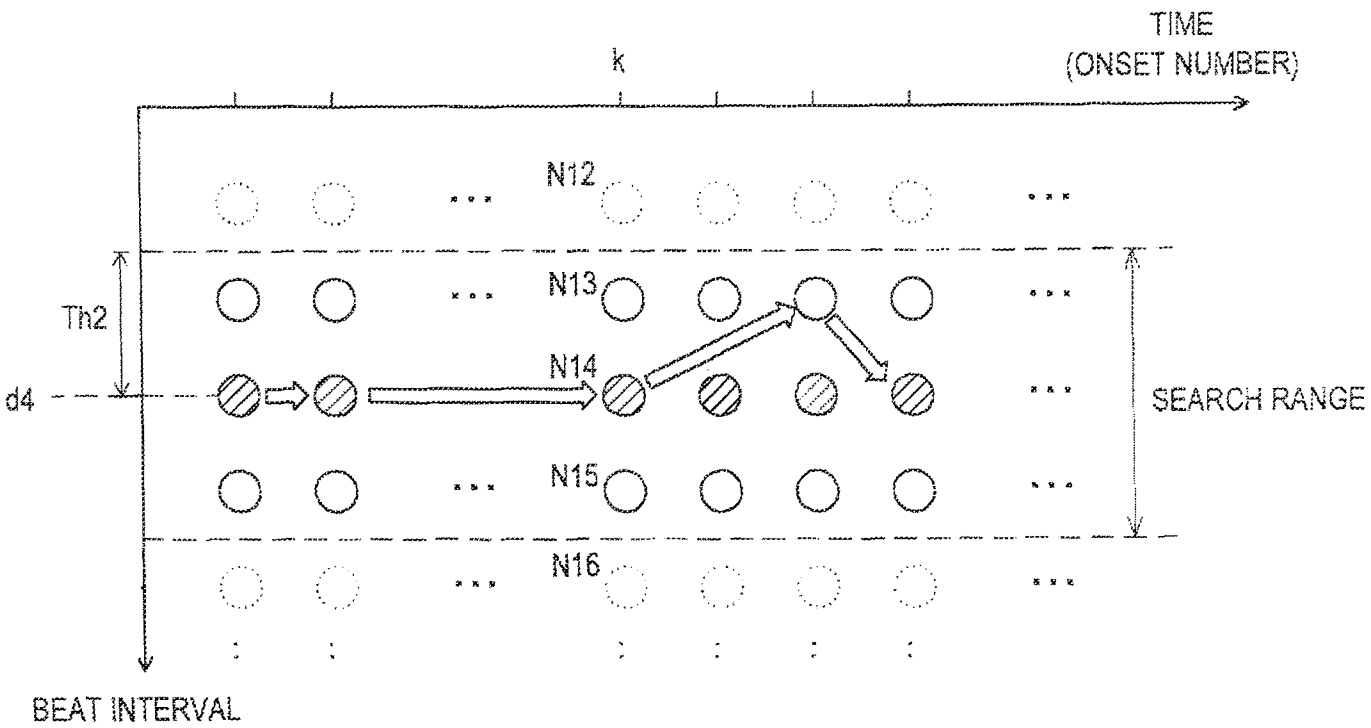
FIG. 23 is an explanatory diagram showing an example of the beat detection method according to the present embodiment.

For example, it is assumed that the mode of the beat intervals at the nodes included in the path determined to be the optimum path by the beat search unit 176 is d4, and that the tempo for the path is decided to be constant by the constant tempo decision unit 178. In this case, the beat re-search unit 180 for constant tempo searches again for a path with only the nodes for which the beat interval d satisfies $d4-Th2 \le d \le d4+Th2$ (Th2 is a specific threshold value) as the subjects of the search. In the example of FIG. 23, five nodes N12 to N16 are shown for the k-th onset. Among these, the beat intervals at N13 to N15 are included within the search range ($d4-Th2 \le d \le d4+Th2$) with regard to the beat re-search unit 180 for constant tempo. In contrast, the beat intervals at N12 and N16 are not included in the above-described search range. Thus, with regard to the k-th onset, only the three nodes, N13 to N15, are made to be the subjects of the re-execution of the path search by the beat re-search unit 180 for constant tempo.

Moreover, the flow of the re-search process for a path by the beat re-search unit 180 for constant tempo is similar to the path search process by the beat search unit 176 except for the range of the nodes which are to be the subjects of the search. According to the path re-search process by the beat re-search unit 180 for constant tempo as described above, errors relating to the beat positions which might partially occur in a result of the path search can be reduced with respect to a music piece with a constant tempo. The optimum path redetermined by the beat re-search unit 180 for constant tempo is input to the beat determination unit 182.

Figure 24:
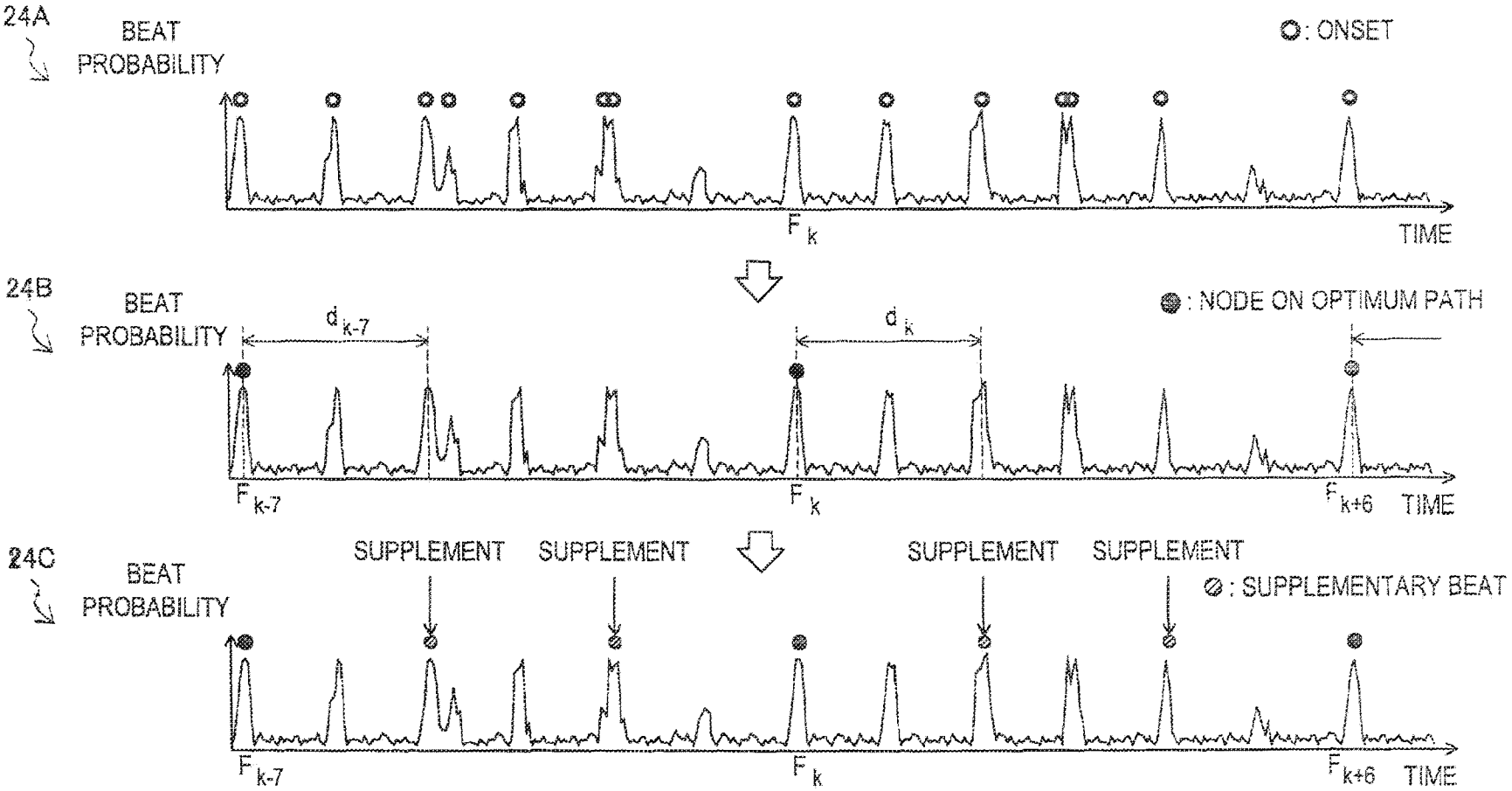
FIG. 24 is an explanatory diagram showing an example of the beat detection method according to the present embodiment.

The beat determination unit 182 determines the beat positions included in the audio signal, based on the optimum path determined by the beat search unit 176 or the optimum path redetermined by the beat re-search unit 180 for constant tempo as well as on the beat interval at each node included in the path. For example, the beat determination unit 182 determines the beat position by a method as shown in FIG. 24. In FIG. 24(A), an example of the onset detection result obtained by the onset detection unit 172 is shown. In this example, 14 onsets in the vicinity of the k-th onset that are detected by the onset detection unit 172 are shown. In contrast, FIG. 24(B) shows the onsets included in the optimum path determined by the beat search unit 176 or the beat re-search unit 180 for constant tempo. In the example of (B), the k−7th onset, the k-th onset and the k+6th onset (frame numbers $F_{k-7}$, $F_k$, $F_{k+6}$), among the 14 onsets shown in (A), are included in the optimum path. Furthermore, the beat interval at the k−7th onset (equivalent to the beat interval at the corresponding node) is $d_{k-7}$, and the beat interval at the k-th onset is $d_k$.

Figure 25:
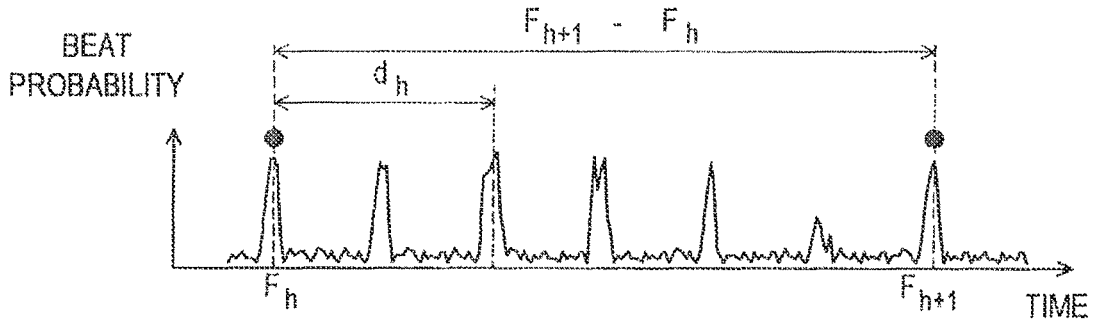
FIG. 25 is an explanatory diagram showing an example of the beat detection method according to the present embodiment.

With respect to such onsets, first, the beat determination unit 182 takes the positions of the onsets included in the optimum path as the beat positions of the music piece. Then, the beat determination unit 182 furnishes supplementary beats between adjacent onsets included in the optimum path according to the beat interval at each onset. At this time, the beat determination unit 182 first determines the number of supplementary beats to furnish the beats between onsets adjacent to each other on the optimum path. For example, as shown in FIG. 25, the beat determination unit 182 takes the positions of two adjacent onsets as $F_h$ and $F_{h+1}$, and the beat interval at the onset position $F_h$ as $d_h$. In this case, the number of supplementary beats $B_{fill}$ to be furnished between $F_h$ and $F_{h+1}$ is given by the following equation (8).

[Equation 7]

$$B_{fill} = \text{Round}\left(\frac{F_{h+1} - F_h}{d_h}\right) - 1 \tag{8}$$

Here, Round ( . . . ) indicates that " . . . " is rounded off to the nearest whole number. According to the above equation (8), the number of supplementary beats to be furnished by the beat determination unit 182 will be a number obtained by rounding off, to the nearest whole number, the value obtained by dividing the interval between adjacent onsets by the beat interval, and then subtracting 1 from the obtained whole number in consideration of the fencepost problem.

Next, the beat determination unit 182 furnishes the supplementary beats, by the determined number of beats, between onsets adjacent to each other on the optimum path so that the beats are arranged at an equal interval. In FIG. 24(C), onsets after the furnishing of supplementary beats are shown. In the example of (C), two supplementary beats are furnished between the k−7th onset and the k-th onset, and two supplementary beats are furnished between the k-th onset and the k+6th onset. It should be noted that the positions of supplementary beats provided by the beat determination unit 182 does not necessarily correspond with the positions of onsets detected by the onset detection unit 172. With this configuration, the position of a beat can be determined without being affected by a sound produced locally off the beat position. Furthermore, the beat position can be appropriately grasped even in case there is a rest at the beat position and no sound is produced. A list of the beat positions determined by the beat determination unit 182 (including the onsets on the optimum path and supplementary beats furnished by the beat determination unit 182) in this manner is input to the tempo revision unit 184.

Figure 26:
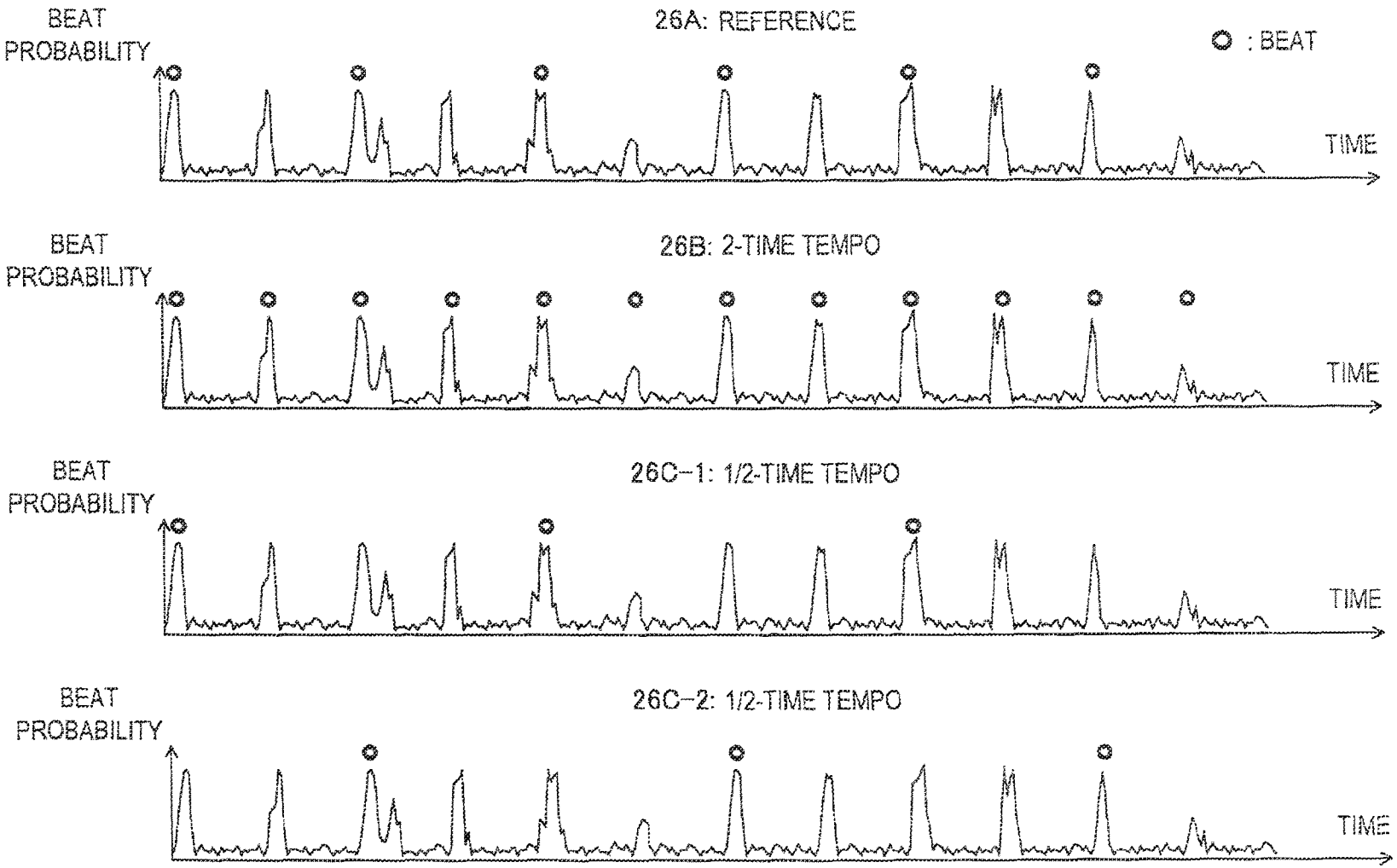
FIG. 26 is an explanatory diagram showing an example of the beat detection method according to the present embodiment.

The tempo revision unit 184 revises the tempo indicated by the beat positions determined by the beat determination unit 182. The tempo before revision is possibly a constant multiple of the original tempo of the music piece, such as 2 times, ½ times, 3/2 times, ⅔ times or the like (refer to FIG. 26). Accordingly, the tempo revision unit 184 revises the tempo which is erroneously grasped to be a constant multiple and reproduces the original tempo of the music piece. Here, reference is made to the example of FIG. 26 showing patterns of beat positions determined by the beat determination unit 182. In the example of FIG. 26, 6 beats are included for pattern (A) in the time range shown in the figure. In contrast, for pattern (B), 12 beats are included in the same time range. That is, the beat positions of pattern (B) indicate a 2-time tempo with the beat positions of pattern (A) as the reference.

On the other hand, with pattern (C-1), 3 beats are included in the same time range. That is, the beat positions of pattern (C-1) indicate a ½-time tempo with the beat positions of pattern (A) as the reference. Also, with pattern (C-2), as with pattern (C-1), 3 beats are included in the same time range, and thus a ½-time tempo is indicated with the beat positions of pattern (A) as the reference. However, pattern (C-1) and pattern (C-2) differ from each other by the beat positions which will be left to remain at the time of changing the tempo from the reference tempo. The revision of tempo by the tempo revision unit 184 is performed by the following procedures (S1) to (S3), for example.

(S1) Determination of Estimated Tempo estimated based on Waveform (S2) Determination of Optimum Basic Multiplier among a Plurality of Multipliers (S3) Repetition of (S2) until Basic Multiplier is 1

Figure 27:
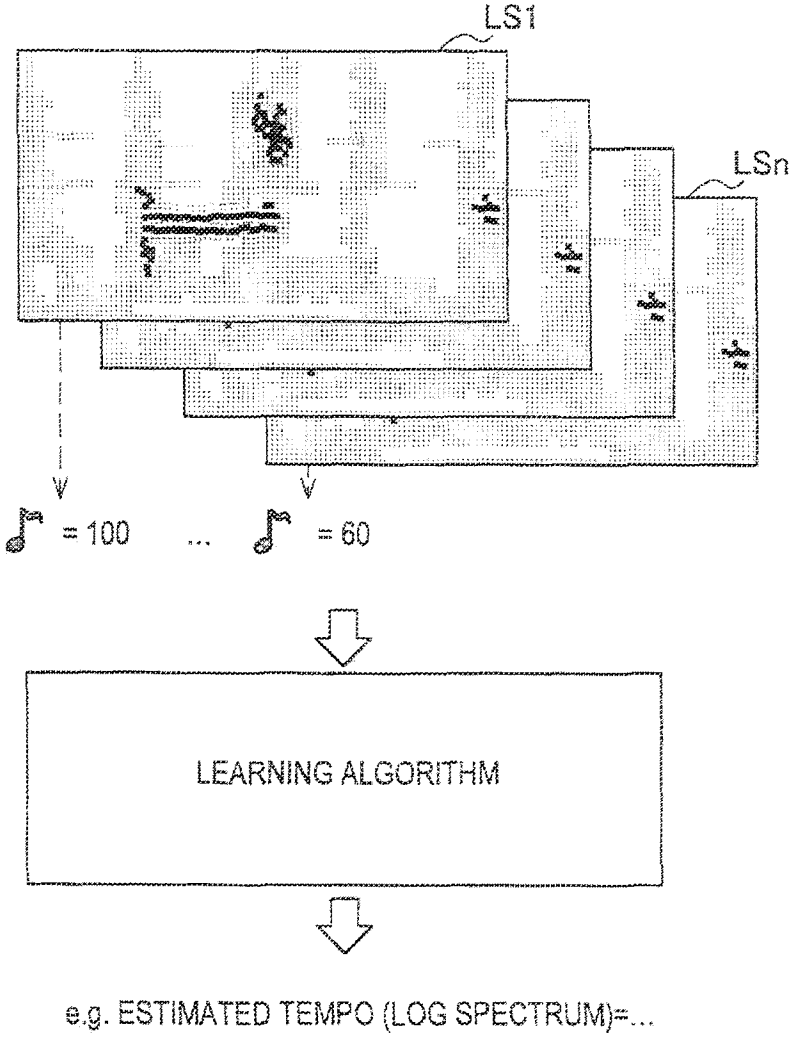
FIG. 27 is an explanatory diagram showing an example of the beat detection method according to the present embodiment.

First, explanation will be made on (S1) Determination of Estimated Tempo estimated based on waveform. The tempo revision unit 184 determines an estimated tempo which is estimated to be adequate from the sound features appearing in the waveform of the audio signal. For example, the feature quantity calculation formula generation apparatus 10 or a calculation formula for estimated tempo discrimination (an estimated tempo discrimination formula) generated by the learning algorithm disclosed in JP-A-2008-123011 are used for the determination of the estimated tempo. For example, as shown in FIG. 27, log spectra of a plurality of music pieces are supplied as evaluation data to the feature quantity calculation formula generation apparatus 10. In the example of FIG. 27, log spectra LS1 to LSn are supplied. Furthermore, tempos decided to be correct by a human being listening to the music pieces are supplied as teacher data. In the example of FIG. 27, a correct tempo (LS1:100, . . . , LSn:60) of each log spectrum is supplied. The estimated tempo discrimination formula is generated based on a plurality of sets of such evaluation data and teacher data. The tempo revision unit 184 computes the estimated tempo of a treated piece by using the generated estimated tempo discrimination formula.

Next, explanation will be made on (2) Determination of Optimum Basic Multiplier among a Plurality of Multiplier. The tempo revision unit 184 determines a basic multiplier, among a plurality of basic multipliers, according to which a revised tempo is closest to the original tempo of a music piece. Here, the basic multiplier is a multiplier which is a basic unit of a constant ratio used for the revision of tempo. For example, any of seven types of multipliers, i.e. ⅓, ½, ⅔, 1, 3/2, 2 and 3 is used as the basic multiplier. However, the application range of the present embodiment is not limited to these examples, and the basic multiplier may be any of five types of multipliers, i.e. ⅓, ½, 1, 2 and 3, for example. To determine the optimum basic multiplier, the tempo revision unit 184 first calculates an average beat probability after revising the beat positions by each basic multiplier. However, in case of the basic multiplier being 1, an average beat probability is calculated for a case where the beat positions are not revised. For example, the average beat probability is computed for each basic multiplier by the tempo revision unit 184 by a method as shown in FIG. 28.

Figure 28:
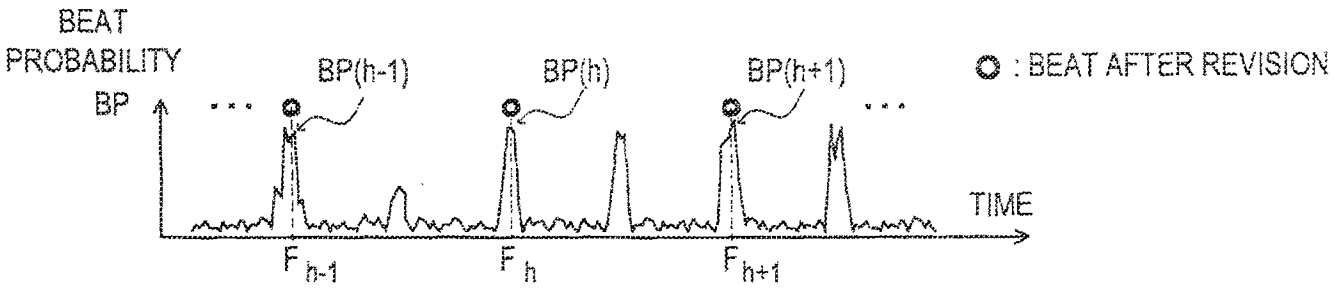
FIG. 28 is an explanatory diagram showing an example of the beat detection method according to the present embodiment.

In FIG. 28, the beat probability computed by the beat probability computation unit 162 is shown with a polygonal line on the time axis. Moreover, frame numbers $F_{h-1}$, $F_h$ and $F_{h+1}$ of three beats revised according to any of the multipliers are shown on the horizontal axis. Here, when the beat probability at the frame number $F_h$ is BP(h), an average beat probability $BP_{AVG}(r)$ of a group F(r) of the beat positions revised according to a multiplier r is given by the following equation (9). Here, m(r) is the number of pieces of frame numbers included in the group F(r).

[Equation 8]

$$BP_{AVG}(r) = \frac{\sum_{F(h)\in F(r)} BP(h)}{m(r)} \tag{9}$$

As described using patterns (C-1) and (C-2) of FIG. 26, there are two types of candidates for the beat positions in case the basic multiplier r is ½. In this case, the tempo revision unit 184 calculates the average beat probability $BP_{AVG}(r)$ for each of the two types of candidates for the beat positions, and adopts the beat positions with higher average beat probability $BP_{AVG}(r)$ as the beat positions revised according to the multiplier r=½. Similarly, in case the multiplier r is ⅓, there are three types of candidates for the beat positions. Accordingly, the tempo revision unit 184 calculates the average beat probability $BP_{AVG}(r)$ for each of the three types of candidates for the beat positions, and adopts the beat positions with the highest average beat probability $BP_{AVG}(r)$ as the beat positions revised according to the multiplier r=⅓.

After calculating the average beat probability for each basic multiplier, the tempo revision unit 184 computes, based on the estimated tempo and the average beat probability, the likelihood of the revised tempo for each basic multiplier (hereinafter, a tempo likelihood). The tempo likelihood can be expressed by the product of a tempo probability shown by a Gaussian distribution centring around the estimated tempo and the average beat probability. For example, the tempo likelihood as shown in FIG. 29 is computed by the tempo revision unit 184.

Figure 29:
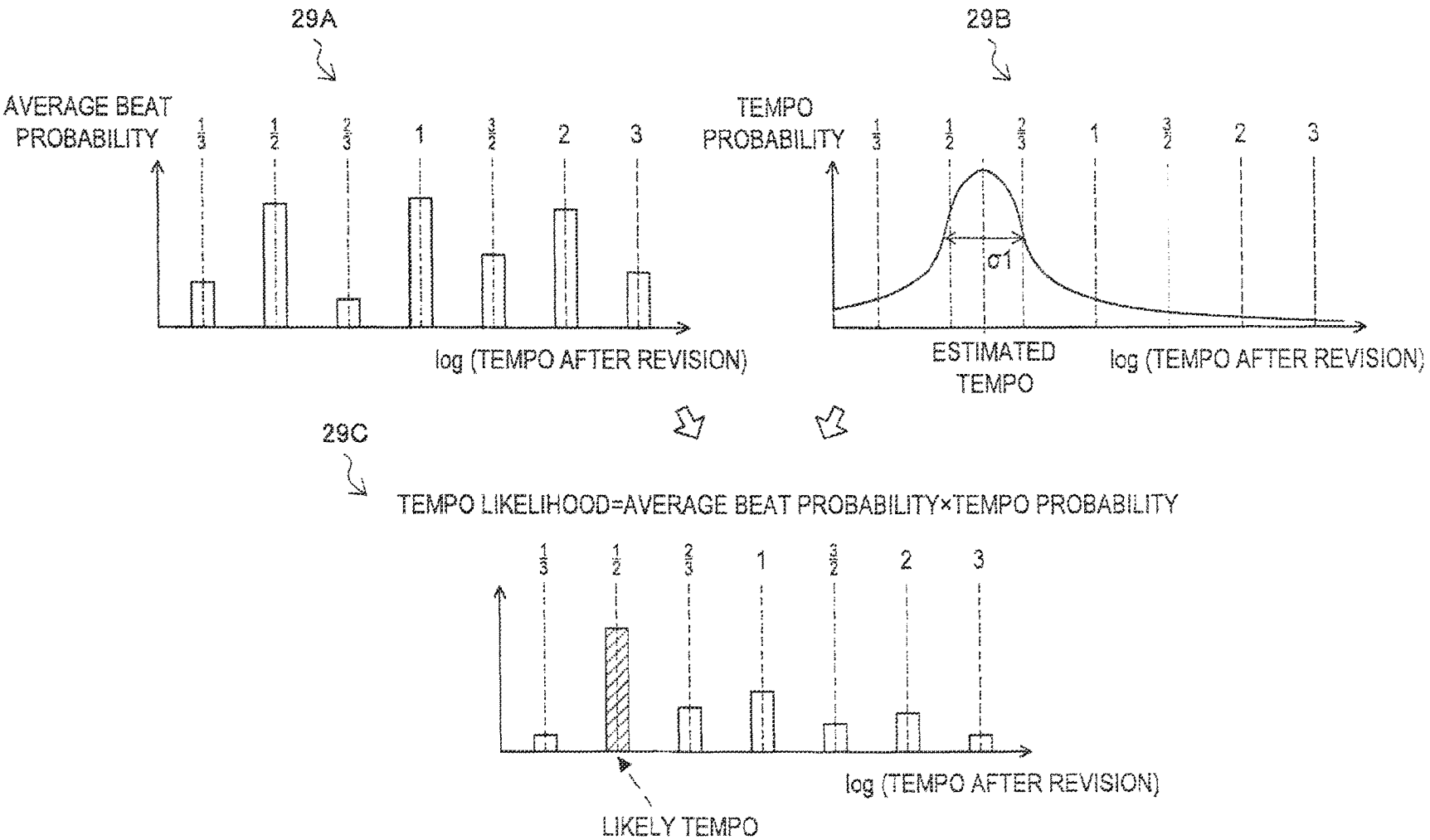
FIG. 29 is an explanatory diagram showing an example of the beat detection method according to the present embodiment.

The average beat probabilities computed by the tempo revision unit 184 for the respective multipliers are shown in FIG. 29(A). Also, FIG. 29(B) shows the tempo probability in the form of a Gaussian distribution that is determined by a specific variance σ1 given in advance and centring around the estimated tempo estimated by the tempo revision unit 184 based on the waveform of the audio signal. Moreover, the horizontal axes of FIGS. 29(A) and (B) represent the logarithm of tempo after the beat positions have been revised according to each multiplier. The tempo revision unit 184 computes the tempo likelihood shown in (C) for each of the basic multipliers by multiplying by each other the average beat probability and the tempo probability. In the example of FIG. 29, although the average beat probabilities are almost the same for when the basic multiplier is 1 and when it is ½, the tempo revised to ½ times is closer to the estimated tempo (the tempo probability is high). Thus, the computed tempo likelihood is higher for the tempo revised to ½ times. The tempo revision unit 184 computes the tempo likelihood in this manner, and determines the basic multiplier producing the highest tempo likelihood as the basic multiplier according to which the revised tempo is the closest to the original tempo of the music piece.

In this manner, by taking the tempo probability which can be obtained from the estimated tempo into account in the determination of a likely tempo, an appropriate tempo can be accurately determined among the candidates, which are tempos in constant multiple relationships and which are hard to discriminate from each other based on the local waveforms of the sound. When the tempo is revised in this manner, the tempo revision unit 184 performs (S3) Repetition of (S2) until Basic Multiplier is 1. Specifically, the calculation of the average beat probability and the computation of the tempo likelihood for each basic multiplier are repeated by the tempo revision unit 184 until the basic multiplier producing the highest tempo likelihood is 1. As a result, even if the tempo before the revision by the tempo revision unit 184 is ¼ times, ⅙ times, 4 times, 6 times or the like of the original tempo of the music piece, the tempo can be revised by an appropriate multiplier for revision obtained by a combination of the basic multipliers (for example, ½ times×½ times=¼ times).

Figure 30:
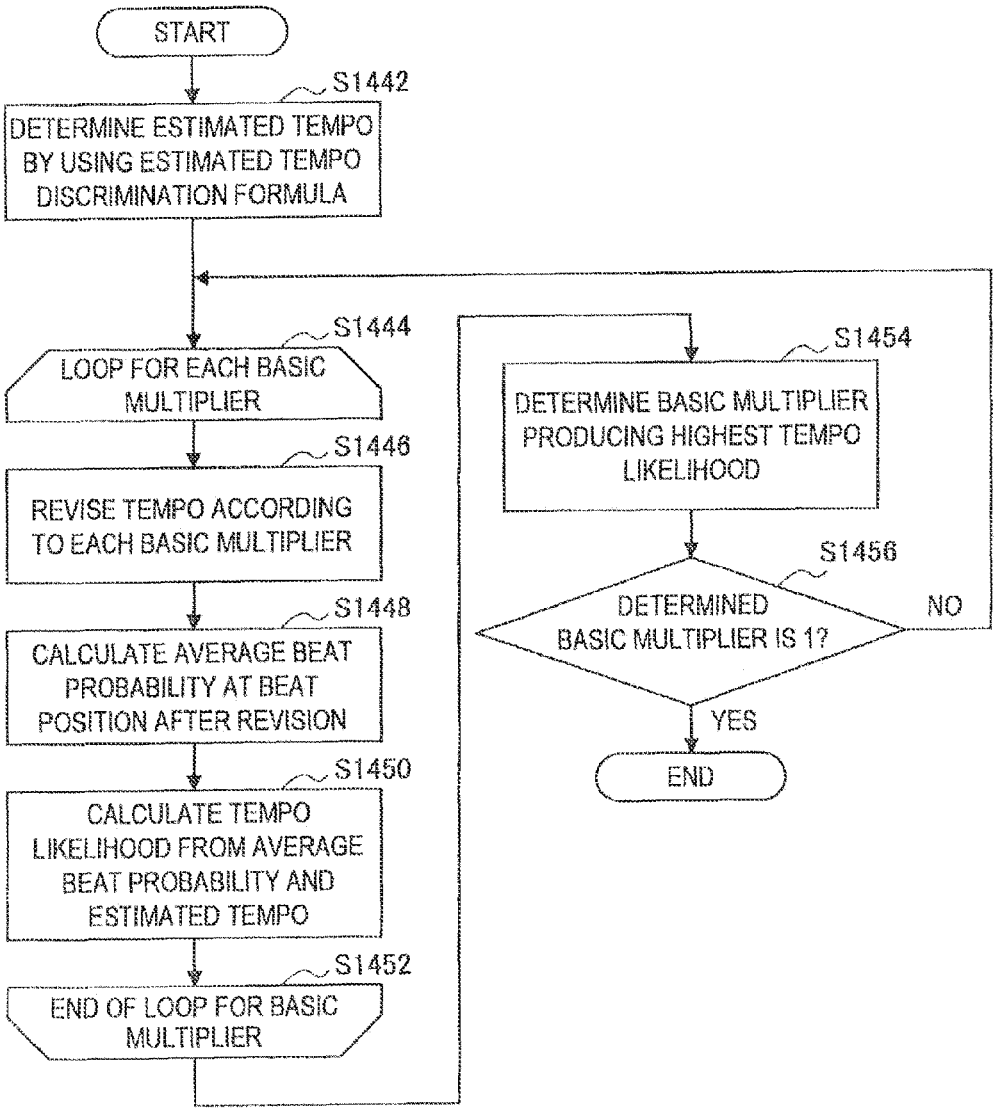
FIG. 30 is an explanatory diagram showing an example of the beat detection method according to the present embodiment.

Here, referring to FIG. 30, a revision process flow of the tempo revision unit 184 will be briefly described. As shown in FIG. 30, first, the tempo revision unit 184 determines an estimated tempo from the audio signal by using an estimated tempo discrimination formula obtained in advance by the feature quantity calculation formula generation apparatus 10 (S1442). Next, the tempo revision unit 184 sequentially executes a loop for a plurality of basic multipliers (such as ⅓, ½, or the like) (S1444). Within the loop, the tempo revision unit 184 changes the beat positions according to each basic multiplier and revises the tempo (S1446). Next, the tempo revision unit 184 calculates the average beat probability of the revised beat positions (S1448). Next, the tempo revision unit 184 calculates the tempo likelihood for each basic multiplier based on the average beat probability calculated at S1448 and the estimated tempo determined at S1442 (S1450).

Then, when the loop is over for all the basic multipliers (S1452), the tempo revision unit 184 determines the basic multiplier producing the highest tempo likelihood (S1454). Then, the tempo revision unit 184 decides whether the basic multiplier producing the highest tempo likelihood is 1 (S1456). If the basic multiplier producing the highest tempo likelihood is 1, the tempo revision unit 184 ends the revision process. On the other hand, when the basic multiplier producing, the highest tempo likelihood is not 1, the tempo revision unit 184 returns to the process of step S1444. Thereby, a revision of tempo according to any of the basic multipliers is again conducted based on the tempo (beat positions) revised according to the basic multiplier producing the highest tempo likelihood.

Heretofore, the configuration of the beat detection unit 132 has been described. With the above-described processing, a detection result for the beat positions as shown in FIG. 31 is output from the beat detection unit 132. The detection result of the beat detection unit 132 is input to the chord progression detection unit 134, and is used for detection processing for the chord progression (refer to FIG. 2).

(2-4-2. Configuration Example of Chord Progression Detection Unit 134)

Next, the configuration of the chord progression detection unit 134 will be described. The chord progression detection unit 134 is means for detecting the chord progression of music data based on a learning algorithm. As shown in FIG. 2, the chord progression detection unit 134 includes a structure analysis unit 202, a chord probability detection unit 204, a key detection unit 206, a bar detection unit 208, and a chord progression estimation unit 210. The chord progression detection unit 134 detects the chord progression of music data by using the functions of these structural elements. In the following, the function of each structural element will be described.

(Structure Analysis Unit 202)

Figure 32:
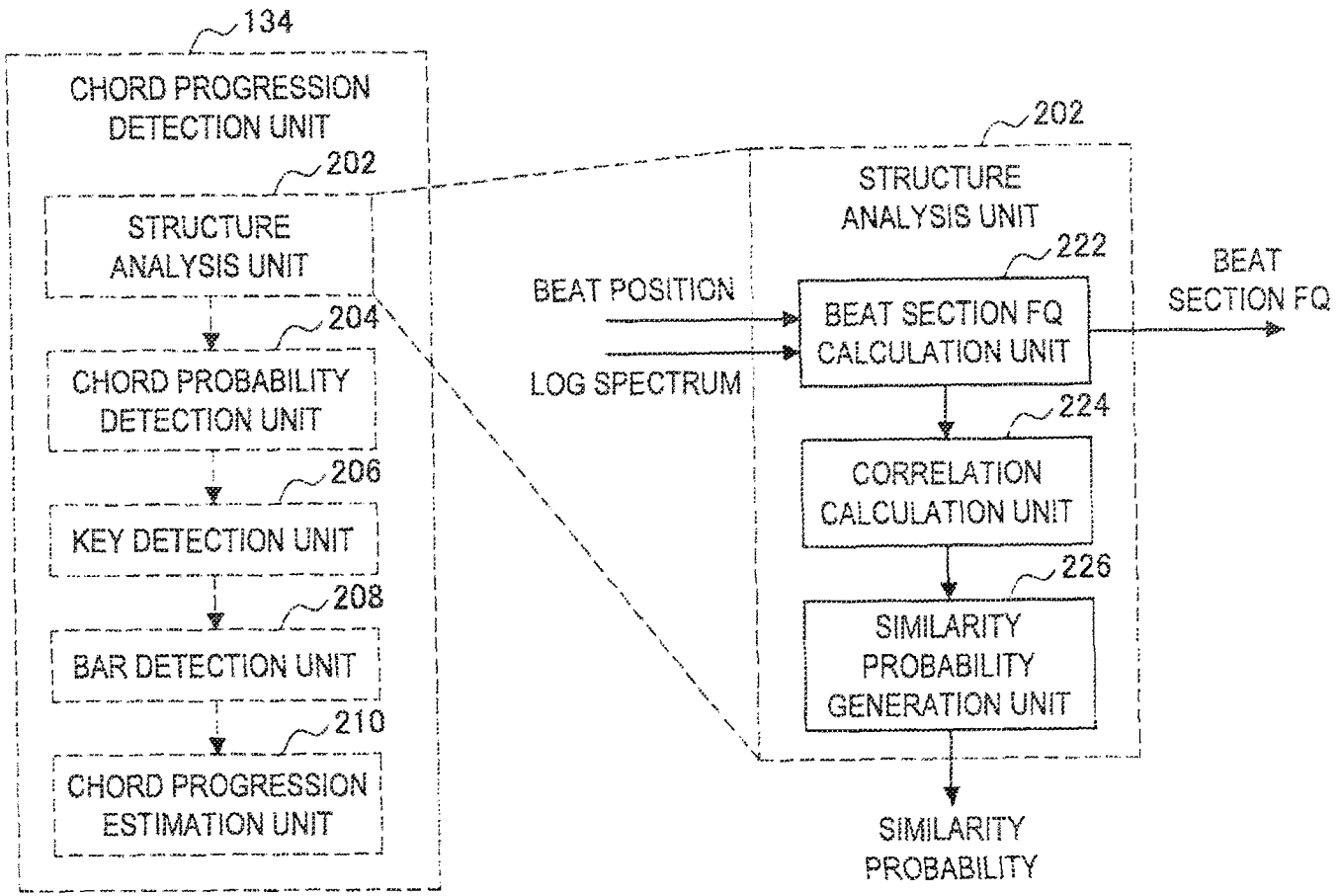
FIG. 32 is an explanatory diagram showing an example of a structure analysis method according to the present embodiment.

First, the structure analysis unit 202 will be described. As shown in FIG. 32, the structure analysis unit 202 is input with a log spectrum from the log spectrum analysis unit 106 and beat positions from the beat analysis unit 164. The structure analysis unit 202 calculates similarity probability of sound between beat sections included in the audio signal, based on the log spectrum and the beat positions. As shown in FIG. 32, the structure analysis unit 202 includes a beat section feature quantity calculation unit 222, a correlation calculation unit 224, and a similarity probability generation unit 226.

Figure 33:
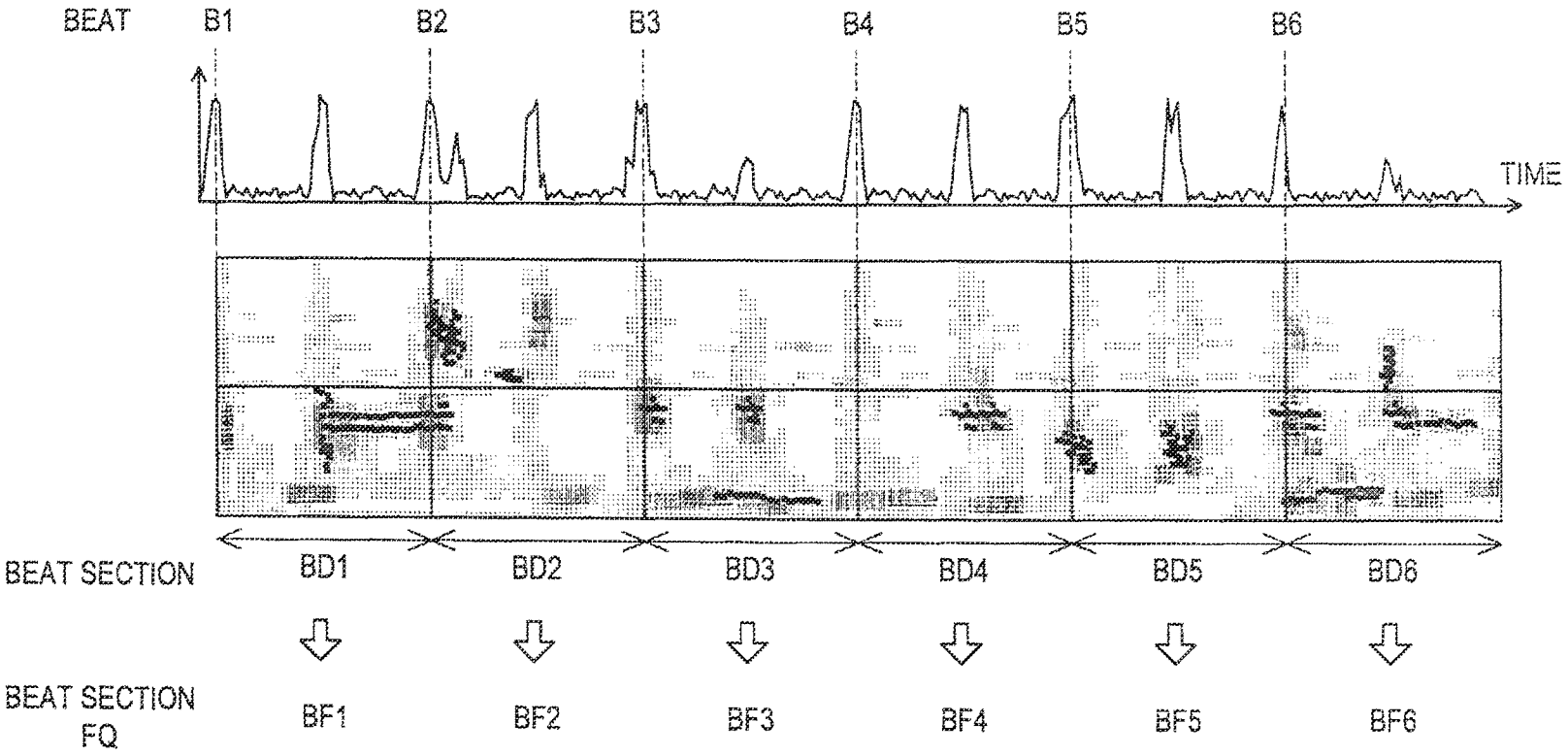
FIG. 33 is an explanatory diagram showing an example of the structure analysis method according to the present embodiment.

The beat section feature quantity calculation unit 222 calculates, with respect to each beat detected by the beat analysis unit 164, a beat section feature quantity representing the feature of a partial log spectrum of a beat section from the beat to the next beat. Here, referring to FIG. 33, a relationship between a beat, a beat section, and a beat section feature quantity will be briefly described. Six beat positions B1 to B6 detected by the beat analysis unit 164 are shown in FIG. 33. In this example, the beat section is a section obtained by dividing the audio signal at the beat positions, and indicates a section from a beat to the next beat. For example, a section BD1 is a beat section from the beat B1 to the beat B2; a section BD2 is a beat section from the beat B2 to the beat B3; and a section BD3 is a beat section from the beat B3 to the beat B4. The beat section feature quantity calculation unit 222 calculates each of beat section feature quantities BF1 to BF6 from a partial log spectrum corresponding to each of the beat sections BD1 to BD6.

Figure 34:
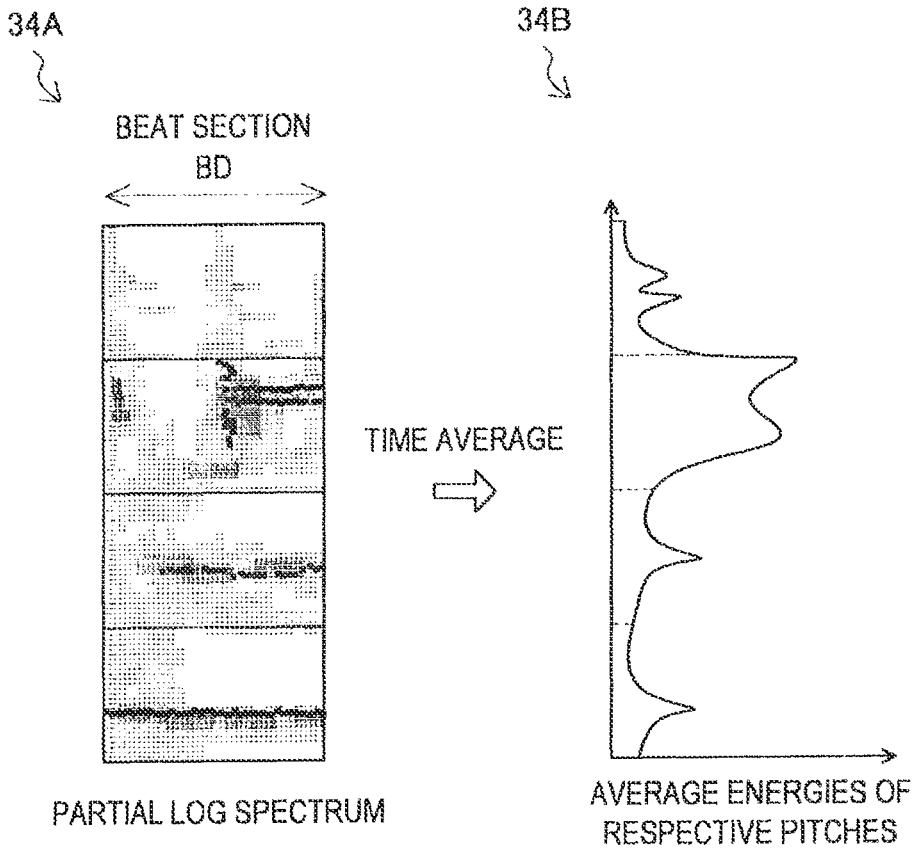
FIG. 34 is an explanatory diagram showing an example of the structure analysis method according to the present embodiment.
Figure 35:
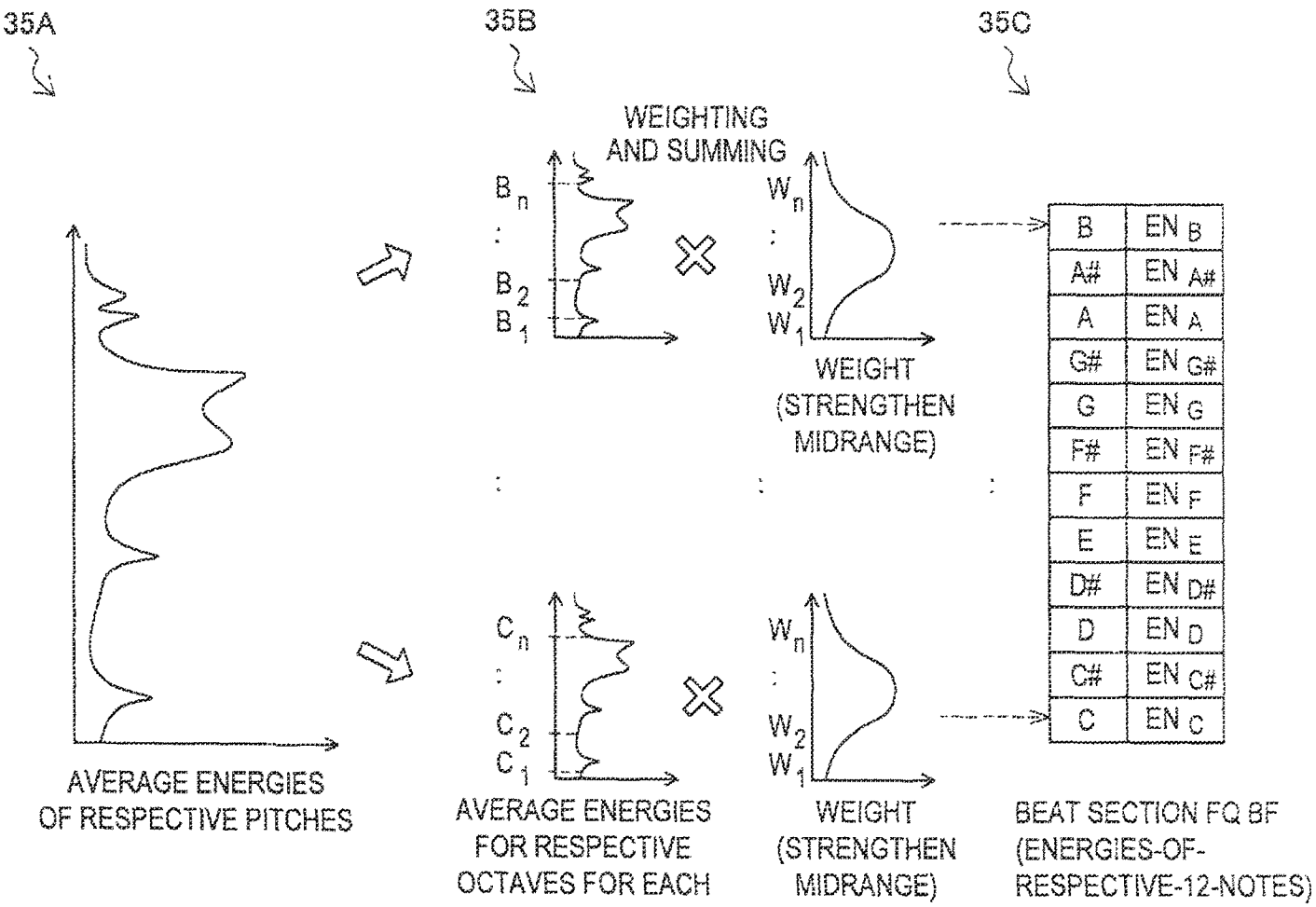
FIG. 35 is an explanatory diagram showing an example of the structure analysis method according to the present embodiment.

The beat section feature quantity calculation unit 222 calculates the beat section feature quantity by methods as shown in FIGS. 34 and 35. In FIG. 34(A), a partial log spectrum of a beat section BD corresponding to a beat cut out by the beat section feature quantity calculation unit 222 is shown. The beat section feature quantity calculation unit 222 time-averages the energies for respective pitches (number of octaves× 12 notes) of the partial log spectrum. By this time-averaging, average energies of respective pitches are computed. The levels of the average energies of respective pitches computed by the beat section feature quantity calculation unit 222 are shown in FIG. 34(B).

Next, reference will be made to FIG. 35. The same levels of the average energies of respective pitches as shown in FIG. 34(B) are shown in FIG. 35(A). The beat section feature quantity calculation unit 222 weights and sums, for 12 notes, the values of the average energies of notes bearing the same name in different octaves over several octaves, and computes the energies of respective 12 notes. For example, in the example shown in FIGS. 35(B) and (C), the average energies of notes C ($C_1, C_2, \ldots, C_n$) over n octaves are weighted by using specific weights ($W_1, W_2, \ldots, W_n$) and summed together, and an energy value $En_C$ for the notes C is computed. Furthermore, in the same manner, the average energies of notes B ($B_1, B_2, \ldots, B_n$) over n octaves are weighted by using the specific weights ($W_1, W_2, \ldots, W_n$) and summed together, and an energy value $En_B$ for the notes B is computed. It is likewise for the ten notes (C# to A#) between the note C and the note B. As a result, a 12-dimensional vector having the energy values $EN_C$ $EN_{C\#}, \ldots, EN_B$ of respective 12 notes as the elements is generated. The beat section feature quantity calculation unit 222 calculates such energies-of-respective-12-notes (a 12-dimensional vector) for each beat as a beat section feature quantity BF, and inputs the same to the correlation calculation unit 224.

The values of weights $W_1, W_2, \ldots, W_n$ for respective octaves used for weighting and summing are preferably larger in the midrange where melody or chord of a common music piece is distinct. This configuration enables the analysis of a music piece structure, reflecting more clearly the feature of the melody or chord.

Figure 36:
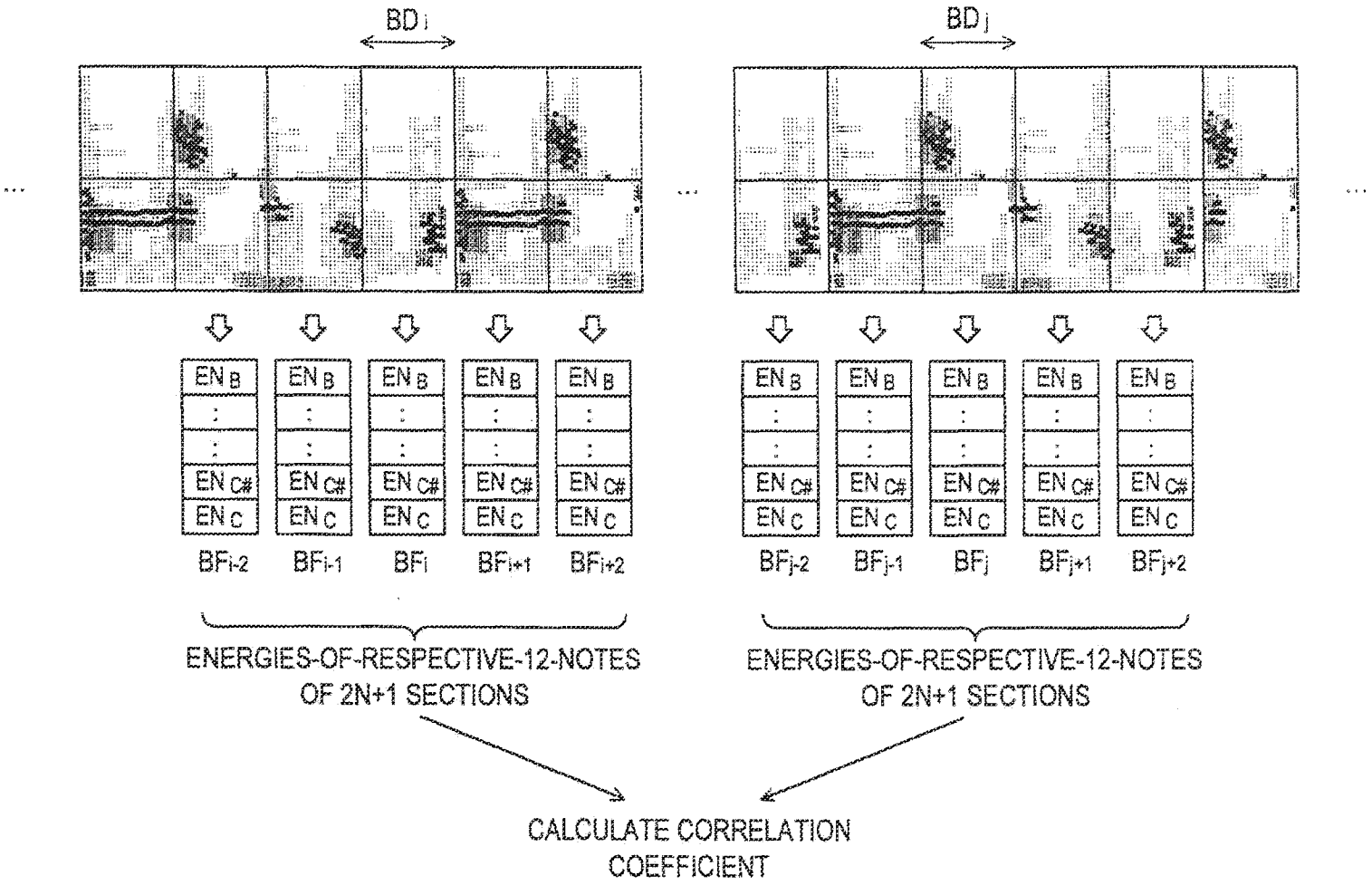
FIG. 36 is an explanatory diagram showing an example of the structure analysis method according to the present embodiment.

The correlation calculation unit 224 calculates, for all the pairs of the beat sections included in the audio signal, the correlation coefficients between the beat sections by using the beat section feature quantity (energies-of-respective-12-notes for each beat section) input from the beat section feature quantity calculation unit 222. For example, the correlation calculation unit 224 calculates the correlation coefficients by a method as shown in FIG. 36. In FIG. 36, a first focused beat section $BD_i$ and a second focused beat section $BD_j$ are shown as an example of a pair of the beat sections, the beat sections being obtained by dividing the log spectrum, for which the correlation coefficient is to be calculated.

For example, to calculate the correlation coefficient between the two focused beat sections, the correlation calculation unit 222 first obtains the energies-of-respective-12-notes of the first focused beat section $BD_i$ and the preceding and following N sections (also referred to as "2N+1 sections") (in the example of FIG. 36, N=2, total 5 sections). Similarly, the correlation calculation unit 224 obtains the energies-of-respective-12-notes of the second focused beat section $BD_j$ and the preceding and following N sections. Then, the correlation calculation unit 224 calculates the correlation coefficient between the obtained energies-of-respective-12-notes of the first focused beat section $BD_i$ and the preceding and following N sections and the obtained energies-of-respective-12-notes of the second focused beat section $BD_j$ and the preceding and following N sections. The correlation calculation unit 224 calculates the correlation coefficient as described for all the pairs of a first focused beat section $BD_i$ and a second focused beat section $BD_j$, and outputs the calculation result to the similarity probability generation unit 226.

Figure 37:
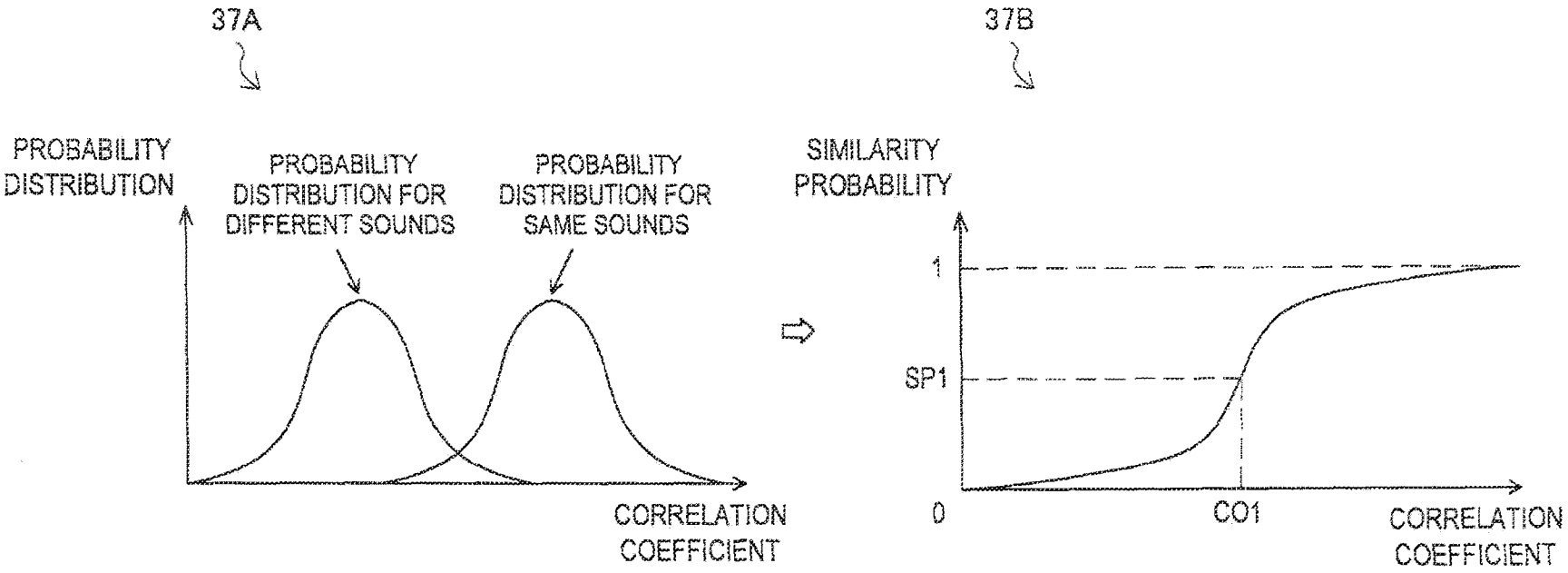
FIG. 37 is an explanatory diagram showing an example of the structure analysis method according to the present embodiment.

The similarity probability generation unit 226 converts the correlation coefficients between the beat sections input from the correlation calculation unit 224 to similarity probabilities by using a conversion curve generated in advance. The similarity probabilities indicate the degree of similarity between the sound contents of the beat sections. A conversion curve used at the time of converting the correlation coefficient to the similarity probability is as shown in FIG. 37, for example.

Two probability distributions obtained in advance are shown in FIG. 37(A). These two probability distributions are a probability distribution of correlation coefficient between beat sections having the same sound contents and a probability distribution of correlation coefficient between beat sections having different sound contents. As can be seen from FIG. 37(A), the probability that the sound contents are the same with each other is lower as the correlation coefficient is lower, and the probability that the sound contents are the same with each other is higher as the correlation coefficient is higher. Thus, a conversion curve as shown in FIG. 37(B) for deriving the similarity probability between the beat sections from the correlation coefficient can be generated in advance. The similarity probability generation unit 226 converts a correlation coefficient CO1 input from the correlation calculation unit 224, for example, to a similarity probability SP1 by using the conversion curve generated in advance in this manner.

Figure 38:
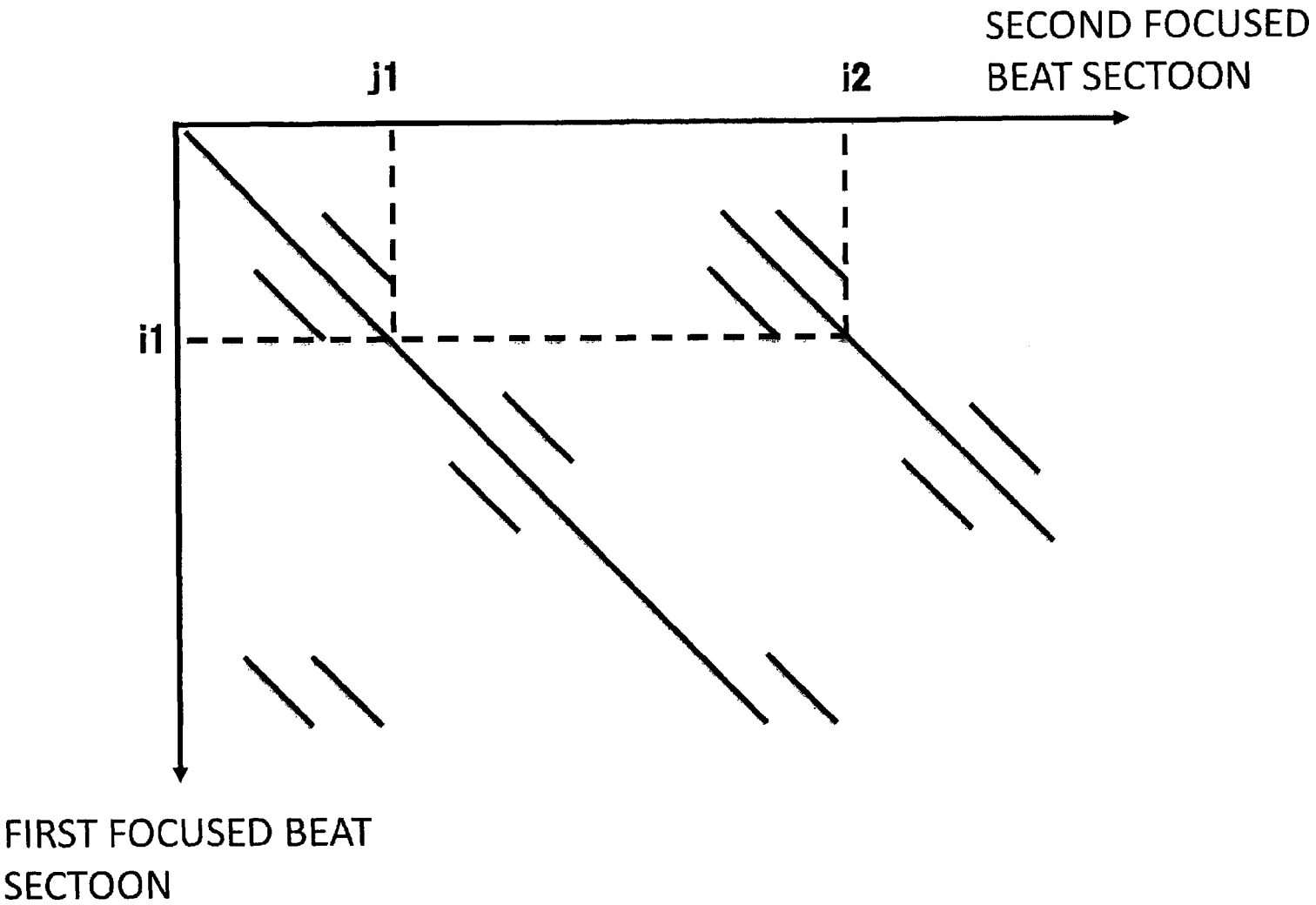
FIG. 38 is an explanatory diagram showing an example of the structure analysis method according to the present embodiment.

The similarity probability which has been converted can be visualized as FIG. 38, for example. The vertical axis of FIG. 38 corresponds to a position in the first focused beat section, and the horizontal axis corresponds to a position in the second focused beat section. Furthermore, the intensity of colours plotted on the two-dimensional plane indicates the degree of similarity probabilities between the first focused beat section and the second focused beat section at the coordinate. For example, the similarity probability between a first focused beat section i1 and a second focused beat section j1, which is substantially the same beat section as the first focused beat section i1, naturally shows a high value, and shows that the beat sections have the same sound contents. When the part of the music piece being played reaches a second focused beat section j2, the similarity probability between the first focused beat section i1 and the second focused beat section j2 again shows a high value. That is, it can be seen that it is highly possible that the sound contents which are approximately the same as that of the first focused beat section i1 are being played in the second focused beat section j2. The similarity probabilities between the beat sections obtained by the structure analysis unit 202 in this manner are input to the bar detection unit 208 and the chord progression estimation unit 210 described later.

Moreover, in the present embodiment, since the time averages of the energies in a beat section are used for the calculation of the beat section feature quantity, information relating a temporal change in the log spectrum in the beat section is not taken into consideration for the analysis of a music piece structure by the structure analysis unit 202. That is, even if the same melody is played in two beat sections, being temporally shifted from each other (due to the arrangement by a player, for example), the played contents are decided to be the same as long as the shift occurs only within a beat section.

(Chord Probability Detection Unit 204)

Figure 39:
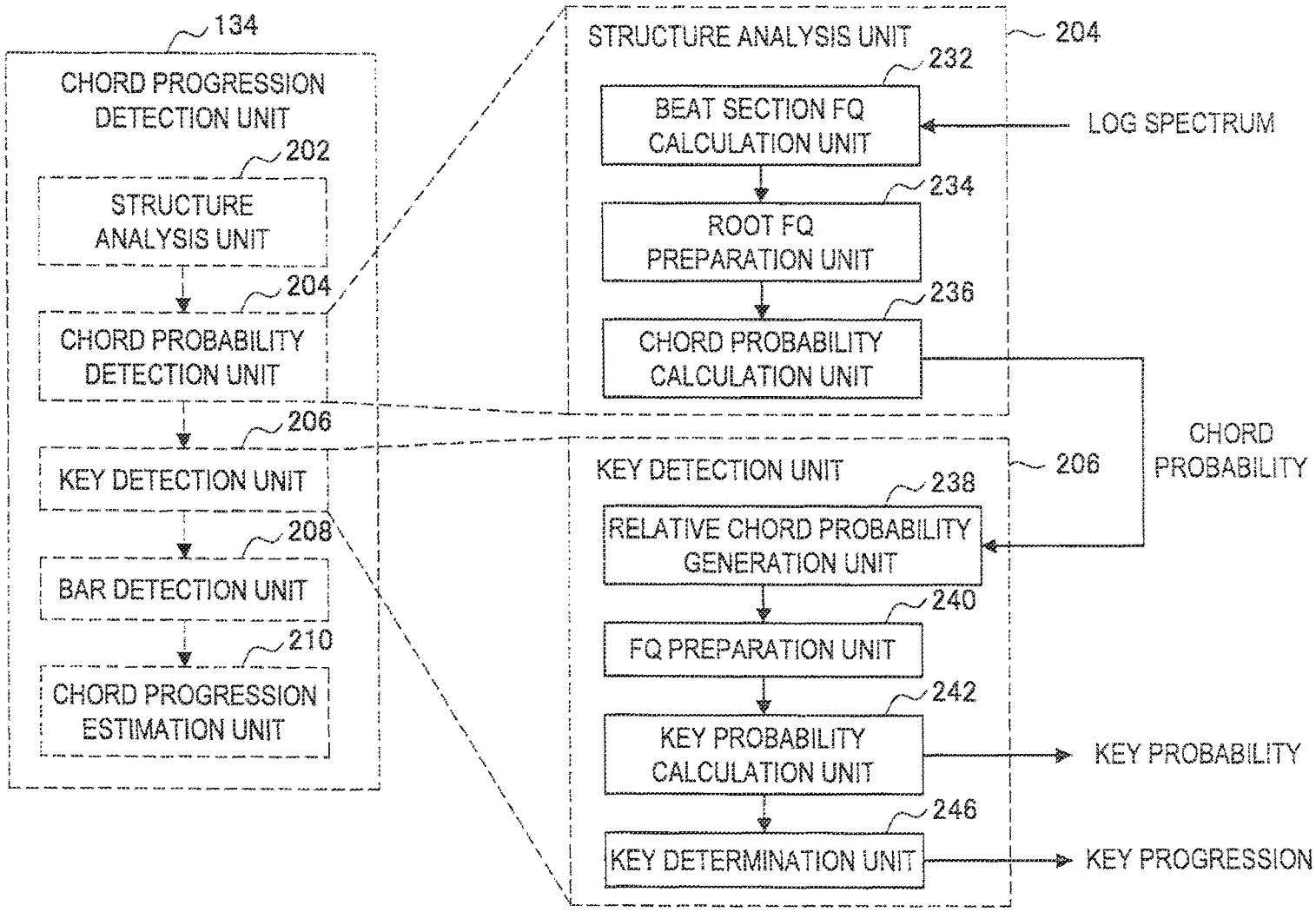
FIG. 39 is an explanatory diagram showing examples of a chord probability detection method and a key detection method according to the present embodiment.

Next, the chord probability detection unit 204 will be described. The chord probability detection unit 204 computes a probability (hereinafter, chord probability) of each chord being played in the beat section of each beat detected by the beat analysis unit 164. As described above, the chord probability computed by the chord probability detection unit 204 is used, as shown in FIG. 39, for the key detection process by the key detection unit 206. Furthermore, as shown in FIG. 39, the chord probability detection unit 204 includes a beat section feature quantity calculation unit 232, a root feature quantity preparation unit 234, and a chord probability calculation unit 236.

As described above, the information on the beat positions detected by the beat detection unit 132 and the log spectrum are input to the chord probability detection unit 204. Thus, the beat section feature quantity calculation unit 232 calculates energies-of-respective-12-notes as beat section feature quantity representing the feature of the audio signal in a beat section, with respect to each beat detected by the beat analysis unit 164. The beat section feature quantity calculation unit 232 calculates the energies-of-respective-12-notes as the beat section feature quantity, and inputs the same to the root feature quantity preparation unit 234. The root feature quantity preparation unit 234 generates root feature quantity to be used for the computation of the chord probability for each beat section based on the energies-of-respective-12-notes input from the beat section feature quantity calculation unit 232. For example, the root feature quantity preparation unit 234 generates the root feature quantity by methods shown in FIGS. 40 and 41.

Figure 40:
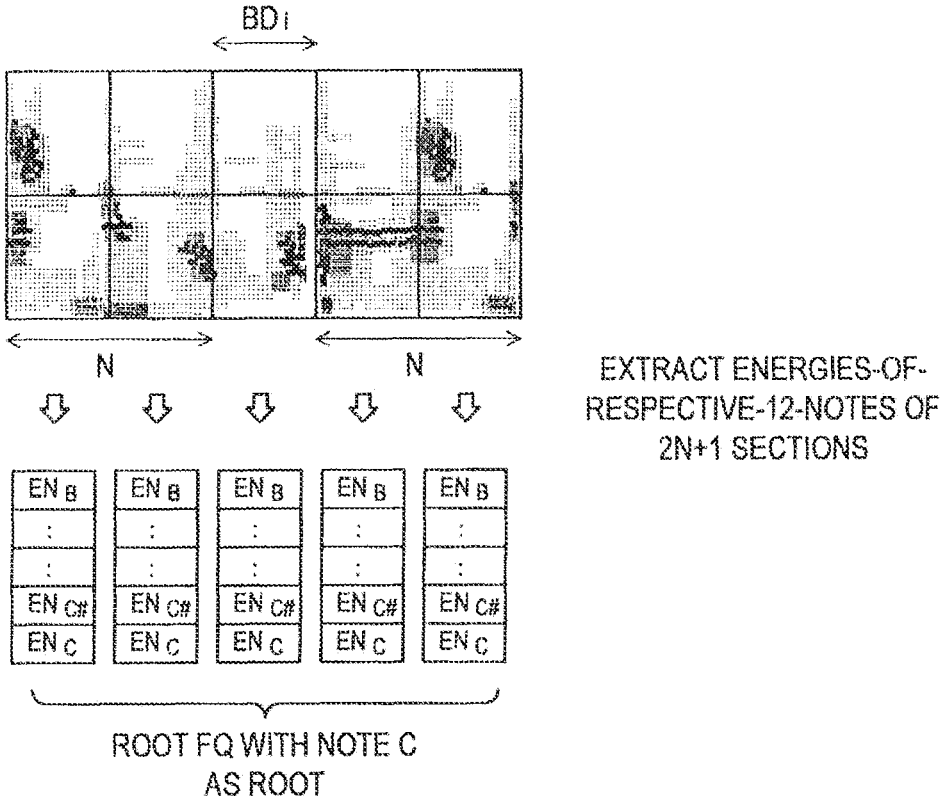
FIG. 40 is an explanatory diagram showing examples of the chord probability detection method and the key detection method according to the present embodiment.
Figure 41:
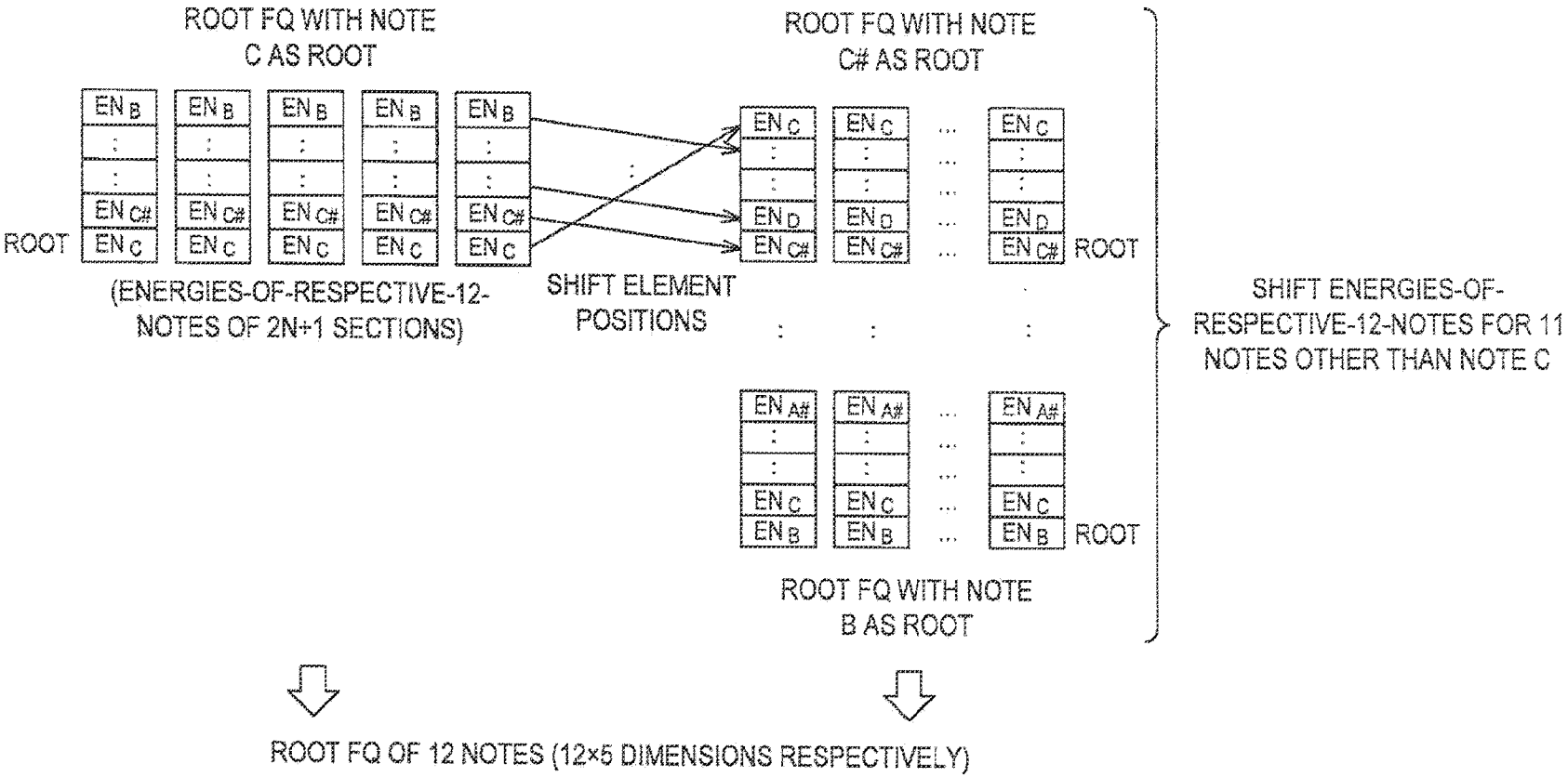
FIG. 41 is an explanatory diagram showing examples of the chord probability detection method and the key detection method according to the present embodiment.

First, the root feature quantity preparation unit 234 extracts, for a focused beat section $BD_i$, the energies-of-respective-12-notes of the focused beat section $BD_i$ and the preceding and following N sections (refer to FIG. 40). The energies-of-respective-12-notes of the focused beat section $BD_i$ and the preceding and following N sections can be considered as a feature quantity with the note C as the root (fundamental note) of the chord. In the example of FIG. 40, since N is 2, a root feature quantity for five sections (12×5 dimensions) having the note C as the root is extracted. Next, the root feature quantity preparation unit 234 generates 11 separate root feature quantities, each for five sections and each having any of note C# to note B as the root, by shifting by a specific number the element positions of the 12 notes of the root feature quantity for five sections having the note C as the root (refer to FIG. 41). Moreover, the number of shifts by which the element position are shifted is 1 for a case where the note C# is the root, 2 for a case where the note D is the root, . . . , and 11 for a case where the note B is the root. As a result, the root feature quantities (12×5-dimensional, respectively), each having one of the 12 notes from the note C to the note B as the root, are generated for the respective 12 notes by the root feature quantity preparation unit 234.

The root feature quantity preparation unit 234 performs the root feature quantity generation process as described above for all the beat sections, and prepares a root feature quantity used for the computation of the chord probability for each section. Moreover, in the examples of FIGS. 40 and 41, a feature quantity prepared for one beat section is a 12×5×12-dimensional vector. The root feature quantities generated by the root feature quantity preparation unit 234 are input to the chord probability calculation unit 236. The chord probability calculation unit 236 computes, for each beat section, a probability (chord probability) of each chord being played, by using the root feature quantities input from the root feature quantity preparation unit 234. "Each chord" here means each of the chords distinguished based on the root (C, C#, D, . . . ), the number of constituent notes (a triad, a 7th chord, a 9th chord), the tonality (major/minor), or the like, for example. A chord probability formula learnt in advance by a logistic regression analysis can be used for the computation of the chord probability, for example.

For example, the chord probability calculation unit 236 generates the chord probability formula to be used for the calculation of the chord probability by a method shown in FIG. 42. The learning of the chord probability formula is performed for each type of chord. That is, a learning process described below is performed for each of a chord probability formula for a major chord, a chord probability formula for a minor chord, a chord probability formula for a 7th chord and a chord probability formula for a 9th chord, for example.

First, a plurality of root feature quantities (for example, 12×5×12-dimensional vectors described by using FIG. 41), each for a beat section whose correct chord is known, are provided as independent variables for the logistic regression analysis. Furthermore, dummy data for predicting the generation probability by the logistic regression analysis is provided for each of the root feature quantity for each beat section. For example, when learning the chord probability formula for a major chord, the value of the dummy data will be a true value (1) if a known chord is a major chord, and a false value (0) for any other case. On the other hand, when learning the chord probability formula for a minor chord, the value of the dummy data will be a true value (1) if a known chord is a minor chord, and a false value (0) for any other case. The same can be said for the 7th chord and the 9th chord.

Figure 43:
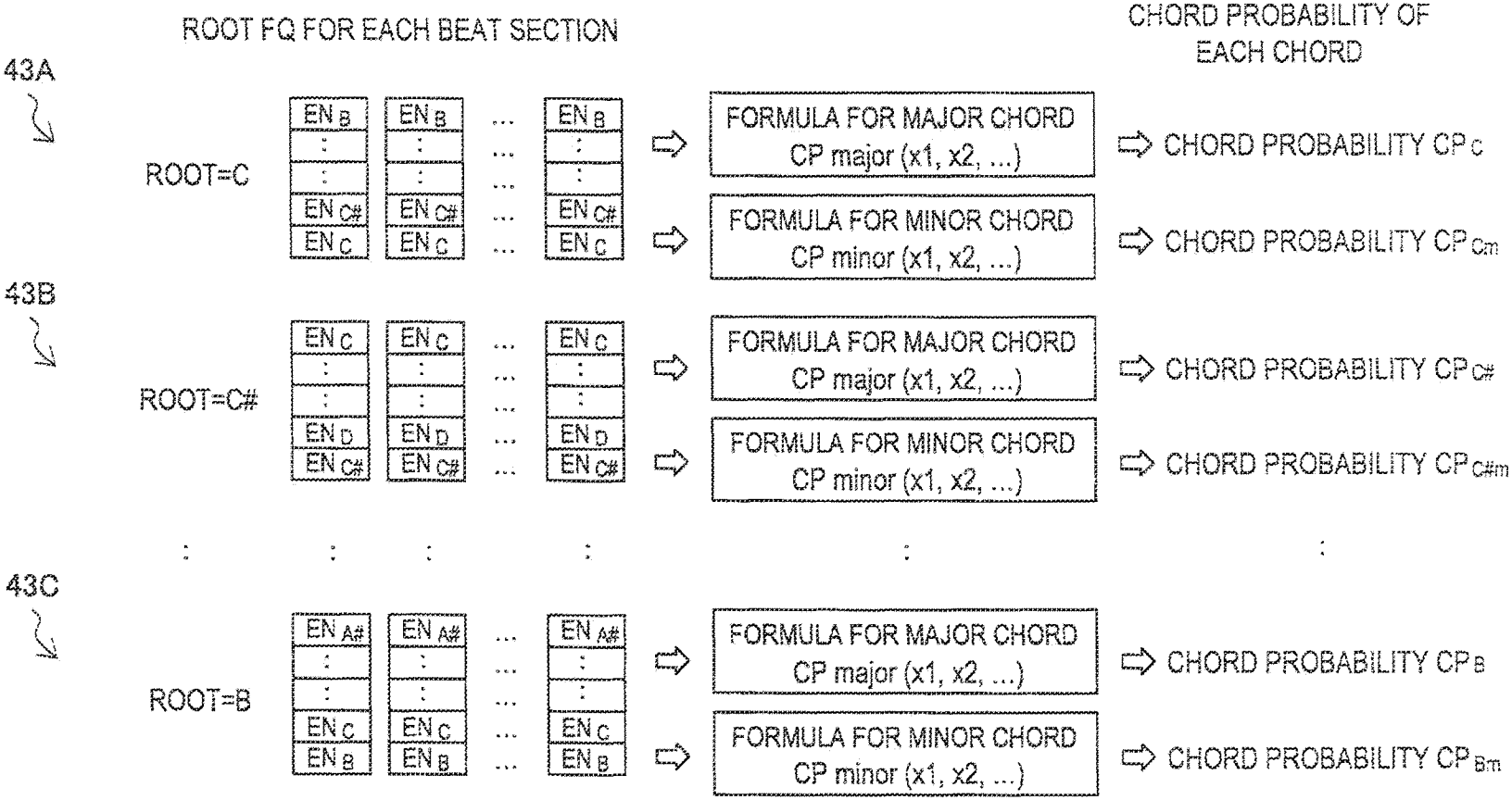
FIG. 43 is an explanatory diagram showing examples of the chord probability detection method and the key detection method according to the present embodiment.

By performing the logistic regression analysis for a sufficient number of the root feature quantities, each for a beat section, by using the independent variables and the dummy data as described above, chord probability formulae for computing the chord probabilities from the root feature quantity for each beat section are generated. Then, the chord probability calculation unit 236 applies the root feature quantities input from the root feature quantity preparation unit 234 to the generated chord probability formulae, and sequentially computes the chord probabilities for respective types of chords for each beat section. The chord probability calculation process by the chord probability calculation unit 236 is performed by a method as shown in FIG. 43, for example. In FIG. 43(A), a root feature quantity with the note C as the root, among the root feature quantity for each beat section, is shown.

For example, the chord probability calculation unit 236 applies the chord probability formula for a major chord to the root feature quantity with the note C as the root, and calculates a chord probability $CP_C$ of the chord being "C" for each beat section. Furthermore, the chord probability calculation unit 236 applies the chord probability formula for a minor chord to the root feature quantity with the note C as the root, and calculates a chord probability $CP_{Cm}$ of the chord being "Cm" for the beat section. In a similar manner, the chord probability calculation unit 236 applies the chord probability formula for a major chord and the chord probability formula for a minor chord to the root feature quantity with the note C# as the root, and can calculate a chord probability $CP_{C\#}$ for the chord "C#" and a chord probability $CP_{C\#m}$ for the chord "C#m" (B). A chord probability $CP_B$ for the chord "B" and a chord probability $CP_{Bm}$ for the chord "Bm" are calculated in the same manner (C).

Figure 44:
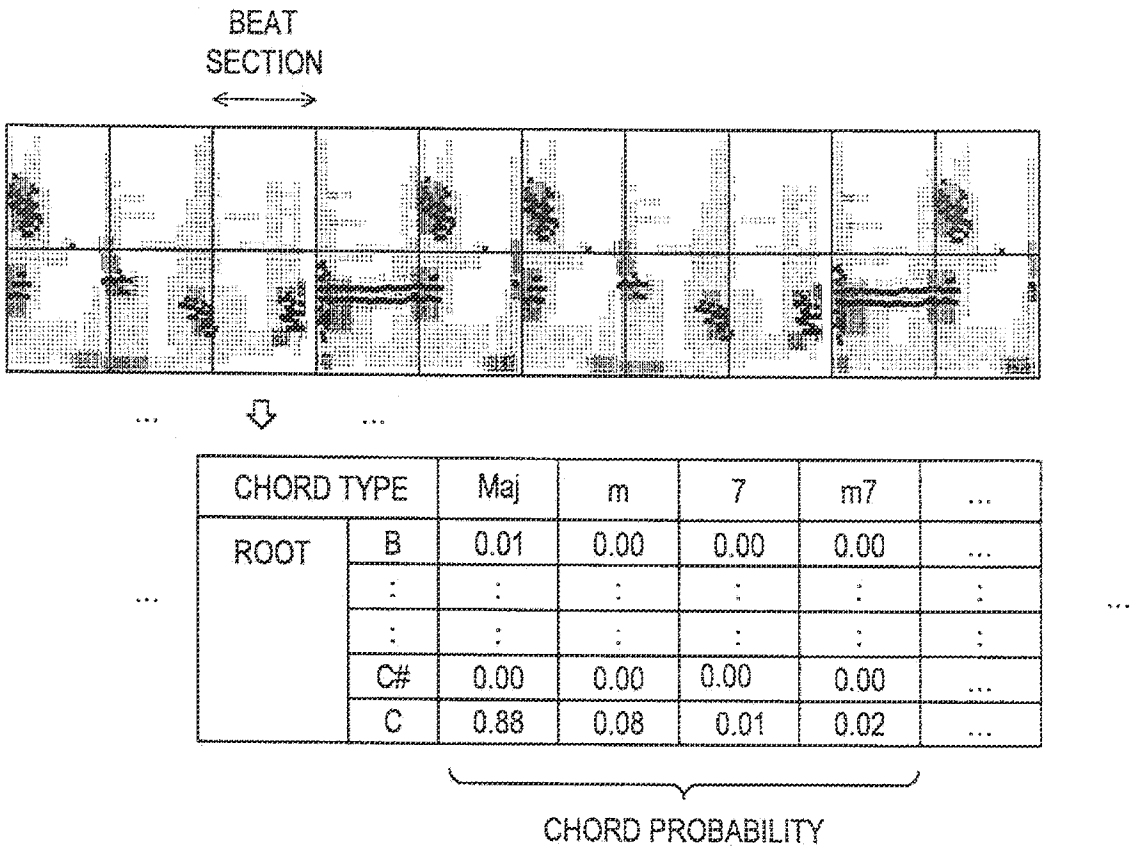
FIG. 44 is an explanatory diagram showing examples of the chord probability detection method and the key detection method according to the present embodiment.

The chord probability as shown in FIG. 44 is computed by the chord probability calculation unit 236 by the above-described method. Referring to FIG. 44, the chord probability is calculated, for a certain beat section, for chords, such as "Maj (major)," "m (minor)," 7 (7th)," and "m7 minor 7th)," for each of the 12 notes from the note C to the note B. According to the example of FIG. 44, the chord probability $CP_C$ is 0.88, the chord probability $CP_{Cm}$ is 0.08, the chord probability $CP_{C7}$ is 0.01, the chord probability $CP_{Cm7}$ is 0.02, and the chord probability $CP_B$ is 0.01. Chord probability values for other types all indicate 0. Moreover, after calculating the chord probability for a plurality of types of chords in the above-described manner, the chord probability calculation unit 236 normalizes the probability values in such a way that the total of the computed probability values becomes 1 per beat section. The calculation and normalization processes for the chord probabilities by the chord probability calculation unit 236 as described above are repeated for all the beat sections included in the audio signal.

The chord probability is computed by the chord probability detection unit 204 by the processes by the beat section feature quantity calculation unit 232, the root feature quantity preparation unit 234 and the chord probability calculation unit 236 as described above. Then, the chord probability computed by the chord probability detection unit 204 is input to the key detection unit 206 (refer to FIG. 39).

(Key Detection Unit 206)

Next, the configuration of the key detection unit 206 will be described. As described above, the chord probability computed by the chord probability detection unit 204 is input to the key detection unit 206. The key detection unit 206 is means for detecting the key (tonality/basic scale) for each beat section by using the chord probability computed by the chord probability detection unit 204 for each beat section. As shown in FIG. 39, the key detection unit 206 includes a relative chord probability generation unit 238, a feature quantity preparation unit 240, a key probability calculation unit 242, and a key determination unit 246.

Figure 45:
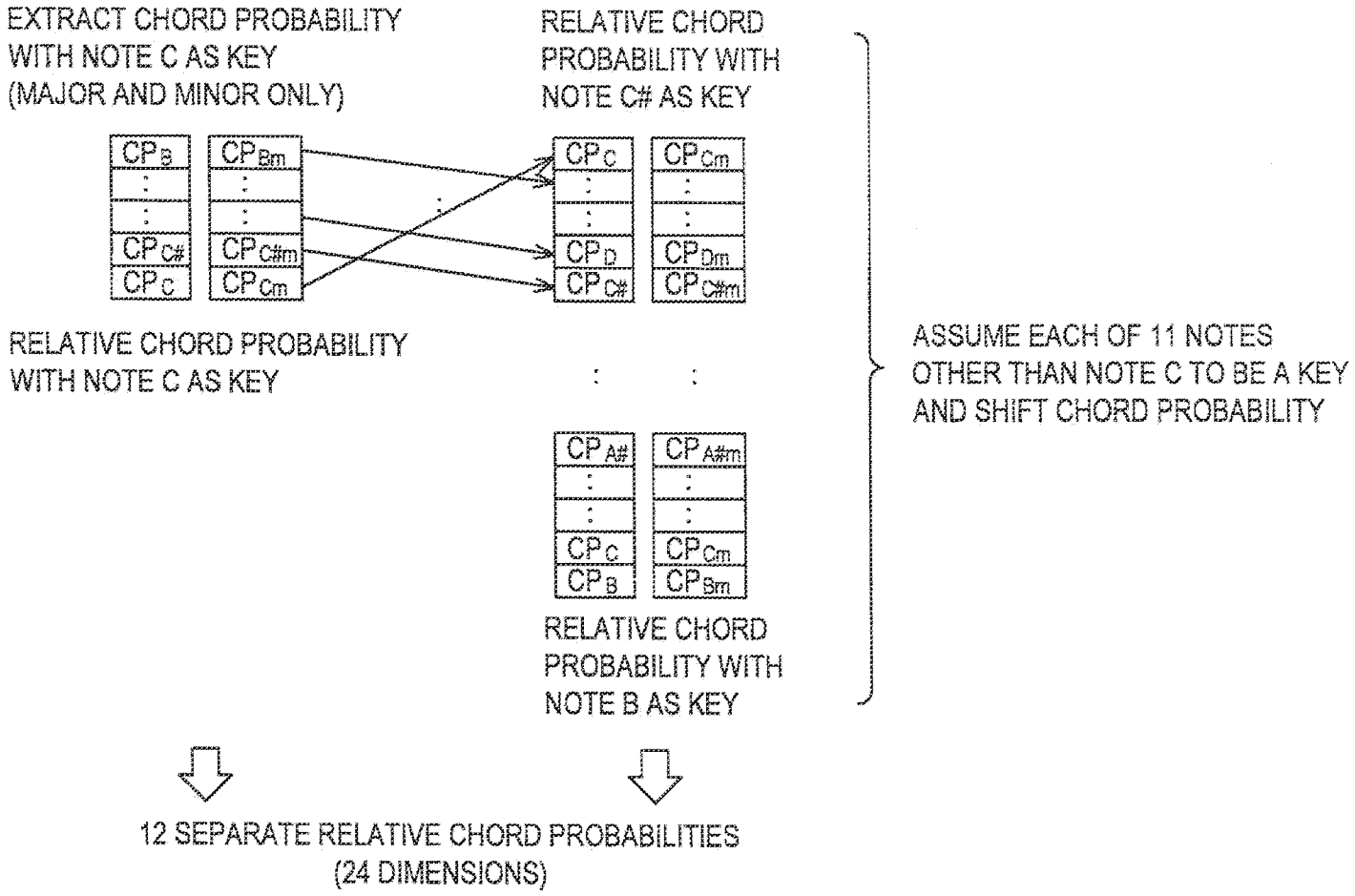
FIG. 45 is an explanatory diagram showing examples of the chord probability detection method and the key detection method according to the present embodiment.

First, the chord probability is input to the relative chord probability generation unit 238 by the chord probability detection unit 204. The relative chord probability generation unit 238 generates a relative chord probability used for the computation of the key probability for each beat section, from the chord probability for each beat section that is input from the chord probability detection unit 204. For example, the relative chord probability generation unit 238 generates the relative chord probability by a method as shown in FIG. 45. First, the relative chord probability generation unit 238 extracts the chord probability relating to the major chord and the minor chord from the chord probability for a certain focused beat section. The chord probability values extracted here are expressed as a vector of total 24 dimensions, i.e. 12 notes for the major chord and 12 notes for the minor chord. Hereunder, the 24-dimensional vector including the chord probability values extracted here will be treated as the relative chord probability with the note C assumed to be the key.

Next, the relative chord probability generation unit 238 shifts, by a specific number, the element positions of the 12 notes of the extracted chord probability values for the major chord and the minor chord. By shifting in this manner, 11 separate relative chord probabilities are generated. Moreover, the number of shifts by which the element positions are shifted is the same as the number of shifts at the time of generation of the root feature quantities as described using FIG. 41. In this manner, 12 separate relative chord probabilities, each assuming one of the 12 notes from the note C to the note B as the key, are generated by the relative chord probability generation unit 238. The relative chord probability generation unit 238 performs the relative chord probability generation process as described for all the beat sections, and inputs the generated relative chord probabilities to the feature quantity preparation unit 240.

The feature quantity preparation unit 240 generates a feature quantity to be used for the computation of the key probability for each beat section. A chord appearance score and a chord transition appearance score for each beat section that are generated from the relative chord probability input to the feature quantity preparation unit 240 from the relative chord probability generation unit 238 are used as the feature quantity to be generated by the feature quantity preparation unit 240.

Figure 46:
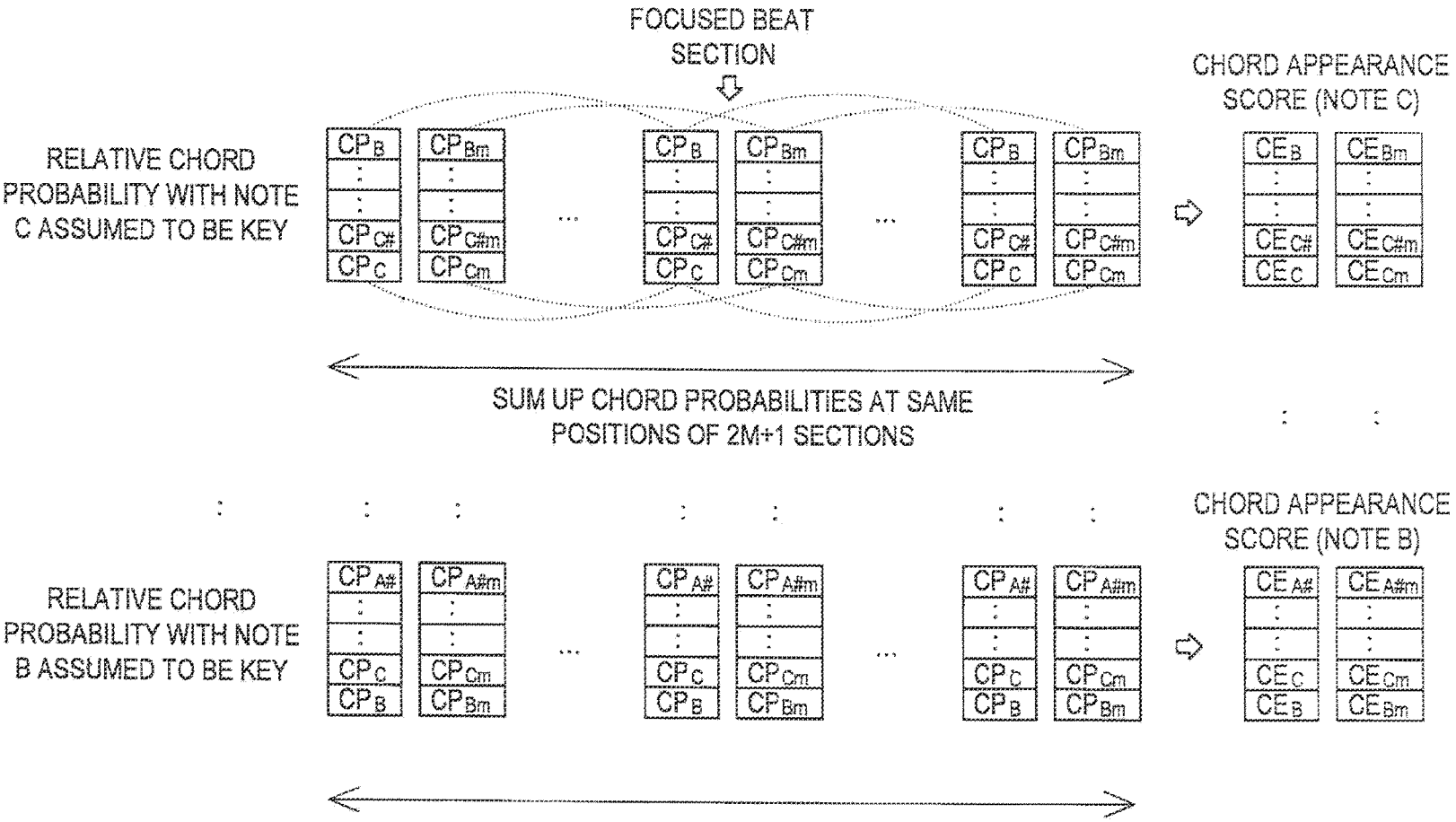
FIG. 46 is an explanatory diagram showing examples of the chord probability detection method and the key detection method according to the present embodiment.

First, the feature quantity preparation unit 240 generates the chord appearance score for each beat section by a method as shown in FIG. 46. First, the feature quantity preparation unit 240 provides relative chord probabilities CP, with the note C assumed to be the key, for the focused beat section and the preceding and following M beat sections. Then, the feature quantity preparation unit 240 sums up, across the focused beat section and the preceding and following M sections, the probability values of the elements at the same position, the probability values being included in the relative chord probabilities with the note C assumed to be the key. As a result, a chord appearance score ($CE_C$, $CE_{C\#}$, . . . , $CE_{Bm}$) (24-dimensional vector) is obtained, which is in accordance with the appearance probability of each chord, the appearance probability being for the focused beat section and a plurality of beat sections around the focused beat section and assuming the note C to be the key. The feature quantity preparation unit 240 performs the calculation of the chord appearance score as described above for cases each assuming one of the 12 notes from the note C to the note B to be the key. According to this calculation, 12 separate chord appearance scores are obtained for one focused beat section.

Figure 47:
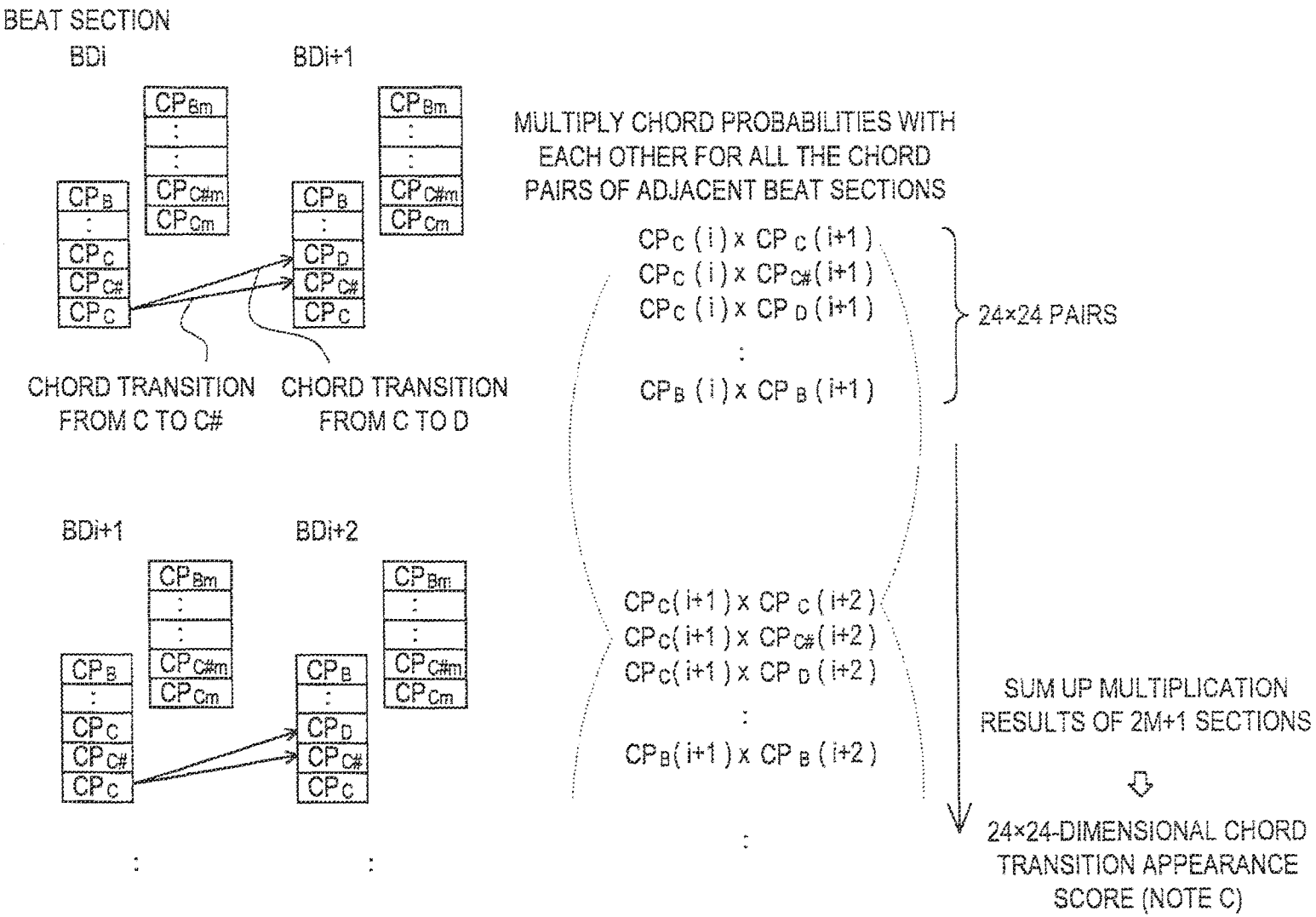
FIG. 47 is an explanatory diagram showing examples of the chord probability detection method and the key detection method according to the present embodiment.

Next, the feature quantity preparation unit 240 generates the chord transition appearance score for each beat section by a method as shown in FIG. 47. First, the feature quantity preparation unit 240 first multiplies with each other the relative chord probabilities before and after the chord transition, the relative chord probabilities assuming the note C to be the key, with respect to all the pairs of chords (all the chord transitions) between a beat section $BD_i$ and an adjacent beat section $BD_{i+1}$. Here, "all the pairs of the chords" means the 24×24 pairs, i.e. "C"→"C," "C"→"C#," "C"→"D," . . . , "B"→"B." Next, the feature quantity preparation unit 240 sums up the multiplication results of the relative chord probabilities before and after the chord transition for over the focused beat section and the preceding and following M sections. As a result, a 24×24-dimensional chord transition appearance score (a 24×24-dimensional vector) is obtained, which is in accordance with the appearance probability of each chord transition, the appearance probability being for the focused beat section and a plurality of beat sections around the focused beat section and assuming the note C to be the key. For example, a chord transition appearance score $CT_{C\rightarrow C\#(i)}$ regarding the chord transition from "C" to "C#" for a focused beat section $BD_i$ is given by the following equation (10).

[Equation 9]

$$CT_{C\rightarrow C\#}(i)=CP_C(i-M)\cdot CP_{C\#}(i-M+1)+\ldots+CP_C(i+M)\cdot CP_{C\#}(i+M+1) \quad (10)$$

In this manner, the feature quantity preparation unit 240 performs the above-described 24×24 separate calculations for the chord transition appearance score CT for each case assuming one of the 12 notes from the note C to the note B to be the key. According to this calculation, 12 separate chord transition appearance scores are obtained for one focused beat section. Moreover, unlike the chord which is apt to change for each bar, for example, the key of a music piece remains unchanged, in many cases, for a longer period. Thus, the value of M defining the range of relative chord probabilities to be used for the computation of the chord appearance score or the chord transition appearance score is suitably a value which may include a number of bars such as several tens of beats, for example. The feature quantity preparation unit 240 inputs, as the feature quantity for calculating the key probability, the 24-dimensional chord appearance score CE and the 24×24-dimensional chord transition appearance score that are calculated for each beat section to the key probability calculation unit 242.

Figure 48:
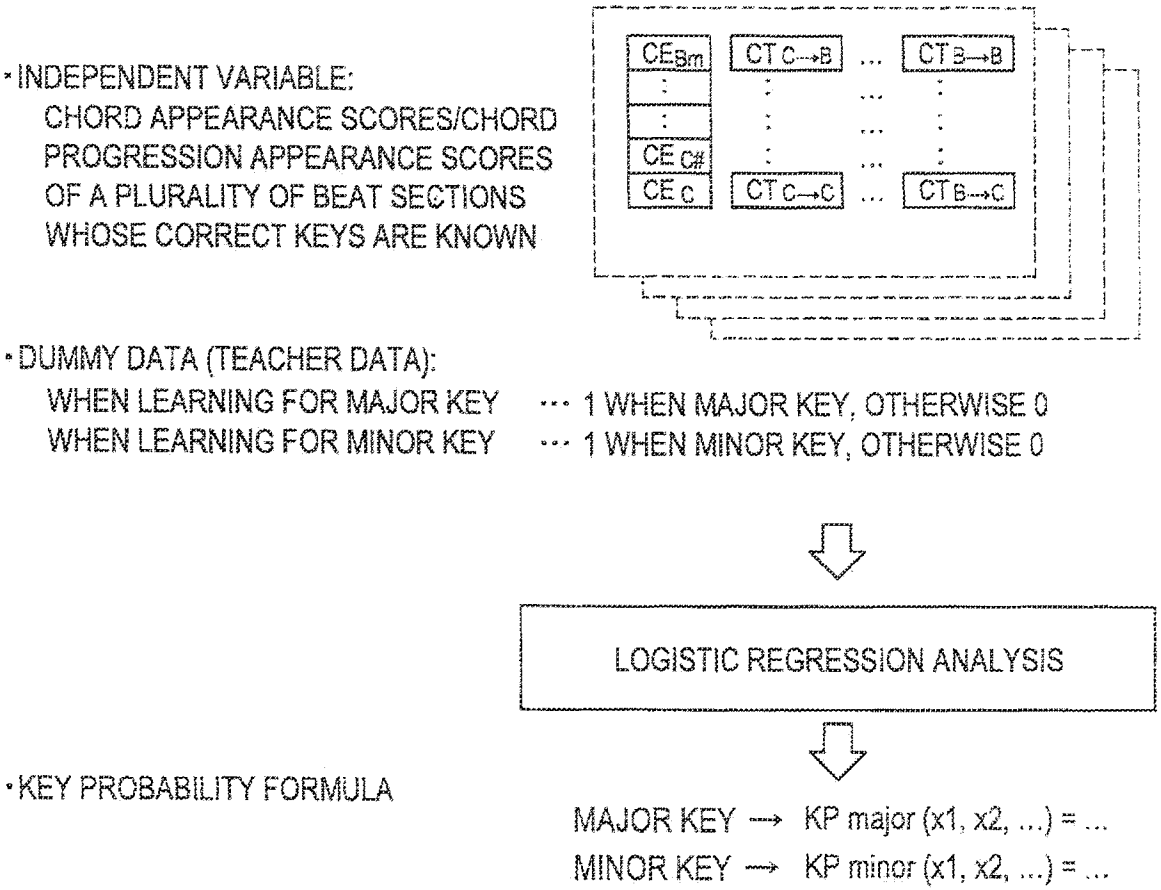
FIG. 48 is an explanatory diagram showing examples of the chord probability detection method and the key detection method according to the present embodiment.

The key probability calculation unit 242 computes, for each beat section, the key probability indicating the probability of each key being played, by using the chord appearance score and the chord transition appearance score input from the feature quantity preparation unit 240. "Each key" means a key distinguished based on, for example, the 12 notes (C, C#, D, . . . ) or the tonality (major/minor). For example, a key probability formula learnt in advance by the logistic regression analysis is used for the calculation of the key probability. For example, the key probability calculation unit 242 generates the key probability formula to be used for the calculation of the key probability by a method as shown in FIG. 48. The learning of the key probability formula is performed independently for the major key and the minor key. Accordingly, a major key probability formula and a minor key probability formula are generated.

As shown in FIG. 48, a plurality of chord appearance scores and chord progression appearance scores for respective beat sections whose correct keys are known are provided as the independent variables in the logistic regression analysis. Next, dummy data for predicting the generation probability by the logistic regression analysis is provided for each of the provided pairs of the chord appearance score and the chord progression appearance score. For example, when learning the major key probability formula, the value of the dummy data will be a true value (1) if a known key is a major key, and a false value (0) for any other case. Also, when learning the minor key probability formula, the value of the dummy data will be a true value (1) if a known key is a minor key, and a false value (0) for any other case.

Figure 49:
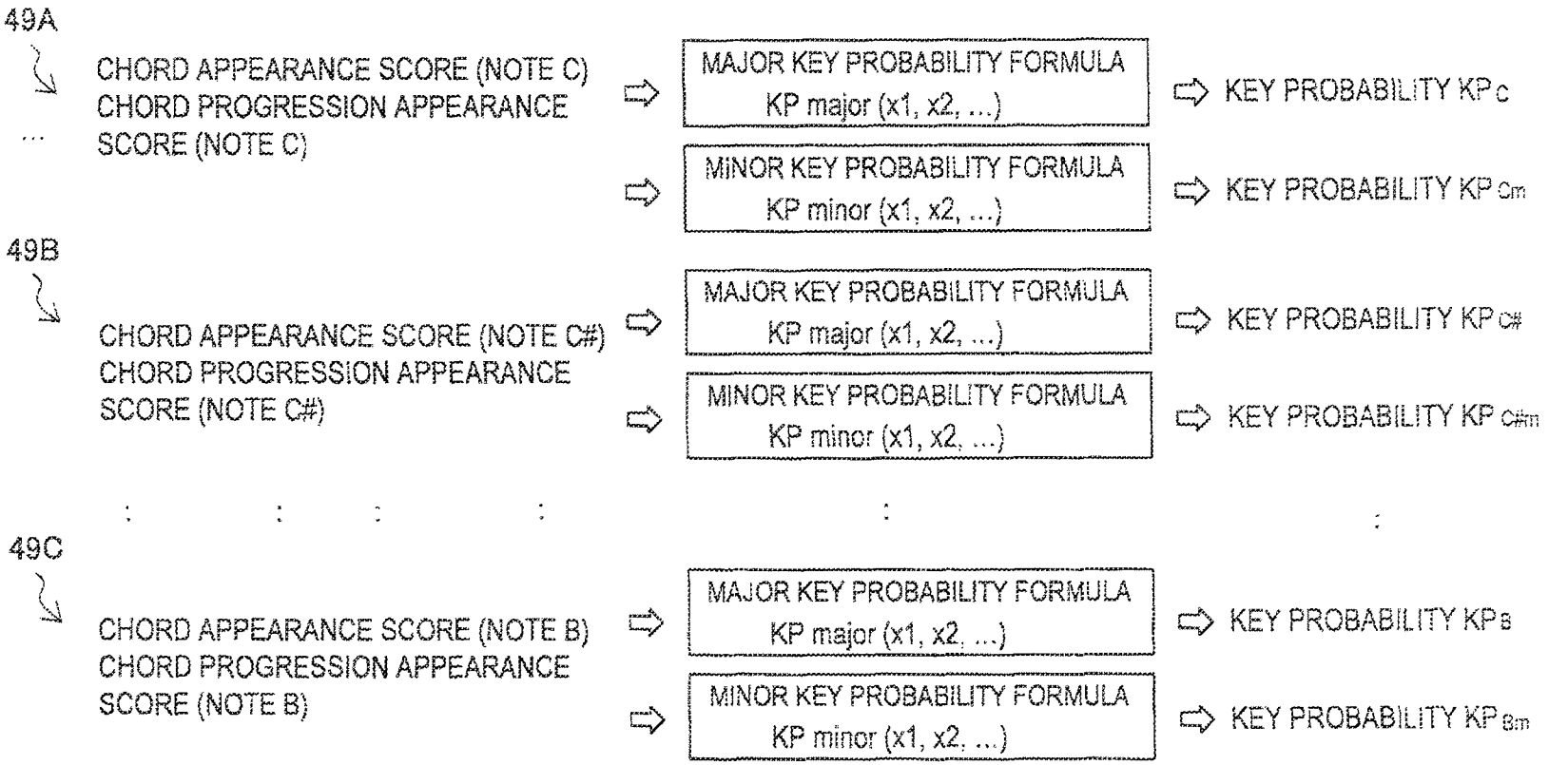
FIG. 49 is an explanatory diagram showing examples of the chord probability detection method and the key detection method according to the present embodiment.

By performing the logistic regression analysis by using a sufficient number of pairs of the independent variable and the dummy data, the key probability formula for computing the probability of the major key or the minor key from a pair of the chord appearance score and the chord progression appearance score for each beat section is generated. The key probability calculation unit 242 applies a pair of the chord appearance score and the chord progression appearance score input from the feature quantity preparation unit 240 to each of the key probability formulae, and sequentially computes the key probabilities for respective keys for each beat section. For example, the key probability is calculated by a method as shown in FIG. 49.

For example, in FIG. 49(A), the key probability calculation unit 242 applies a pair of the chord appearance score and the chord progression appearance score with the note C assumed to be the key to the major key probability formula obtained in advance by learning, and calculates a key probability $KP_C$ of the key being "C" for each beat section. Also, the key probability calculation unit 242 applies the pair of the chord appearance score and the chord progression appearance score with the note C assumed to be the key to the minor key probability formula, and calculates a key probability $KP_{Cm}$ of the key being "Cm" for the corresponding beat section. Similarly, the key probability calculation unit 242 applies a pair of the chord appearance score and the chord progression appearance score with the note C# assumed to be the key to the major key probability formula and the minor key probability formula, and calculates key probabilities $KP_{C\#}$ and $KP_{C\#m}$ (B). The same can be said for the calculation of key probabilities $KP_B$ and $KP_{Bm}$ (C).

Figure 50:
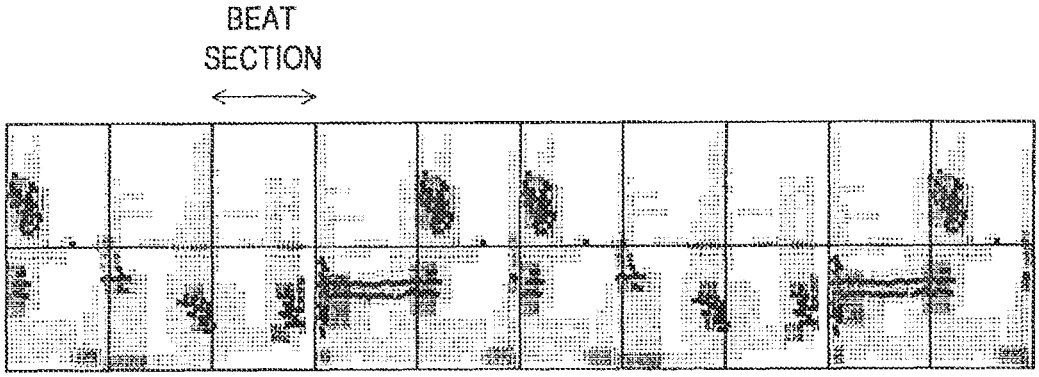
FIG. 50 is an explanatory diagram showing examples of the chord probability detection method and the key detection method according to the present embodiment.

By such calculations, a key probability as shown in FIG. 50 is computed, for example. Referring to FIG. 50, two types of key probabilities, each for "Maj (major)" and "m (minor)," are calculated for a certain beat section for each of the 12 notes from the note C to the note B. According to the example of FIG. 51, the key probability $KP_C$ is 0.90, and the key probability $KP_{Cm}$ is 0.03. Furthermore, key probability values other than the above-described key probability all indicate 0. After calculating the key probability for all the types of keys, the key probability calculation unit 242 normalizes the probability values in such a way that the total of the computed probability values becomes 1 per beat section. The calculation and normalization process by the key probability calculation unit 242 as described above are repeated for all the beat sections included in the audio signal. The key probability for each key computed for each beat section in this manner is input to the key determination unit 246.

Here, the key probability calculation unit 242 calculates a key probability (simple key probability), which does not distinguish between major and minor, from the key probabilities values calculated for the two types of keys, i.e. major and minor, for each of 12 notes from the note C to the note B. For example, the key probability calculation unit 242 calculates the simple key probability by a method as shown in FIG. 51. As shown in FIG. 51(A), for example, key probabilities $KP_C$, $KP_{Cm}$, $KP_A$, and $KP_{Am}$ are calculated by the key probability calculation unit 242 to be 0.90, 0.03, 0.02, and 0.05, respectively, for a certain beat section. Other key probability values all indicate 0. The key probability calculation unit 242 calculates the simple key probability, which does not distinguish between major and minor, by adding up the key probability values of keys in relative key relationship for each of the 12 notes from the note C to the note B. For example, a simple key probability $SKP_C$ is the total of the key probabilities $KP_C$ and $KP_{Am}$, i.e. $SKP_C$=0.90+0.05=0.95. This is because C major (key "C") and A minor (key "Am") are in relative key relationship. The calculation is similarly performed for the simple key probability values for the note. C# to the note B. The 12 separate simple key probabilities $SKP_C$ to $SKP_B$ computed by the key probability calculation unit 242 are input to the chord progression estimation unit 210.

Figure 52:
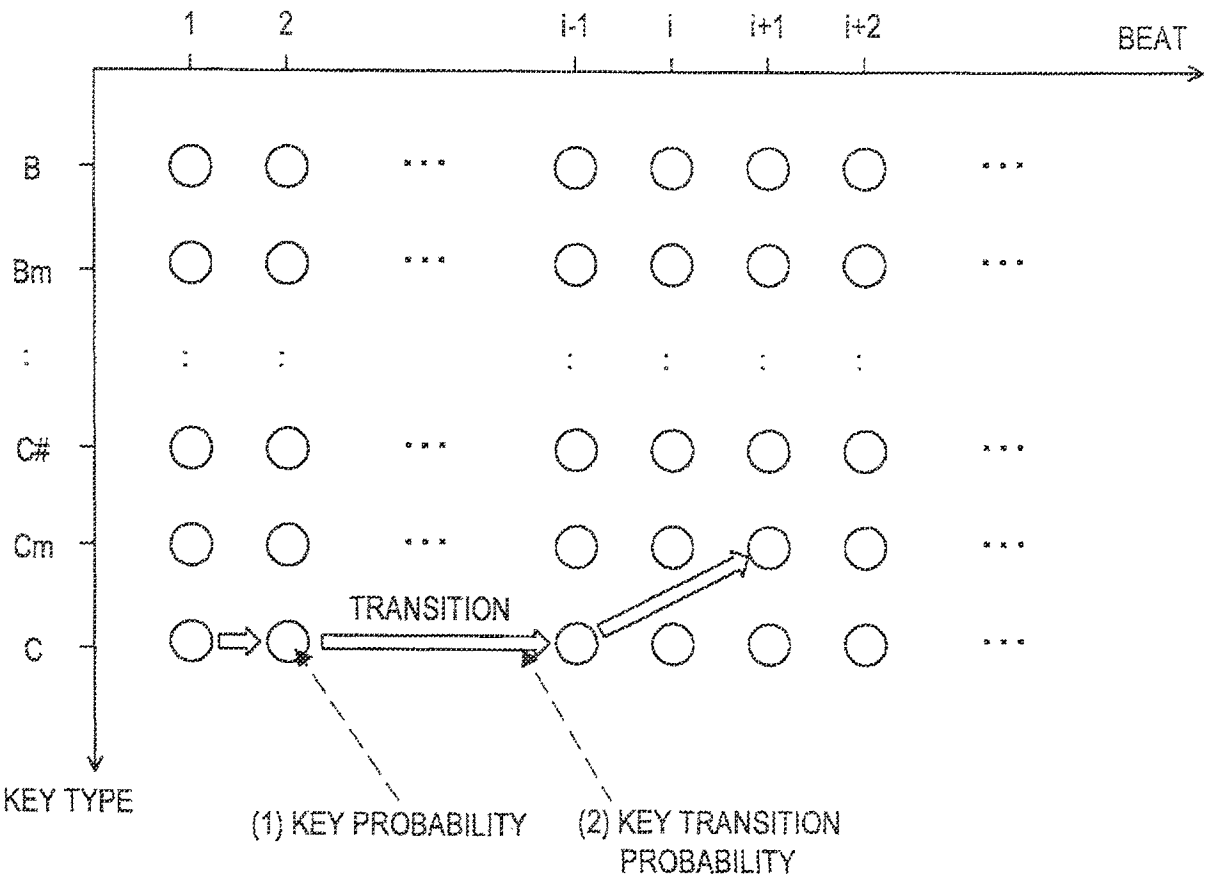
FIG. 52 is an explanatory diagram showing examples of the chord probability detection method and the key detection method according to the present embodiment.

Now, the key determination unit 246 determines a likely key progression by a path search based on the key probability of each key computed by the key probability calculation unit 242 for each beat section. The Viterbi algorithm described above is used as the method of path search by the key determination unit 246, for example. The path search for a Viterbi path is performed by a method as shown in FIG. 52, for example. At this time, beats are arranged sequentially as the time axis (horizontal axis) and the types of keys are arranged as the observation sequence (vertical axis). Accordingly, the key determination unit 246 takes, as the subject node of the path search, each of all the pairs of the beat for which the key probability has been computed by the key probability calculation unit 242 and a type of key.

With regard to the node as described, the key determination unit 246 sequentially selects, along the time axis, any of the nodes, and evaluates a path formed from a series of selected nodes by using two evaluation values, (1) key probability and (2) key transition probability. Moreover, skipping of beat is not allowed at the time of selection of a node by the key determination unit 246. Here, (1) key probability to be used for the evaluation is the key probability that is computed by the key probability calculation unit 242. The key probability is given to each of the node shown in FIG. 52. On the other hand, (2) key transition probability is an evaluation value given to a transition between nodes. The key transition probability is defined in advance for each pattern of modulation, based on the occurrence probability of modulation in a music piece whose correct keys are known.

Twelve separate values in accordance with the modulation amounts for a transition are defined as the key transition probability for each of the four patterns of key transitions: from major to major, from major to minor, from minor to major, and from minor to minor. FIG. 53 shows an example of the 12 separate probability values in accordance with the modulation amounts for a key transition from major to major. In the example of FIG. 53, when the key transition probability in relation to a modulation amount Δk is Pr(Δk), the key transition probability Pr(0) is 0.9987. This indicates that the probability of the key changing in a music piece is very low. On the other hand, the key transition probability MI) is 0.0002. This indicates that the probability of the key being raised by one pitch (or being lowered by 11 pitches) is 0.02%. Similarly, in the example of FIG. 53, Pr(2), Pr(3), Pr(4), Pr(5), Pr(7), Pr(8), Pr(9) and Pr(10) are respectively 0.0001. Also, Pr(6) and Pr(11) are respectively 0.0000. The 12 separate probability values in accordance with the modulation amounts are respectively defined also for each of the transition patterns: from major to minor, from minor to major, and from minor to minor.

Figure 54:
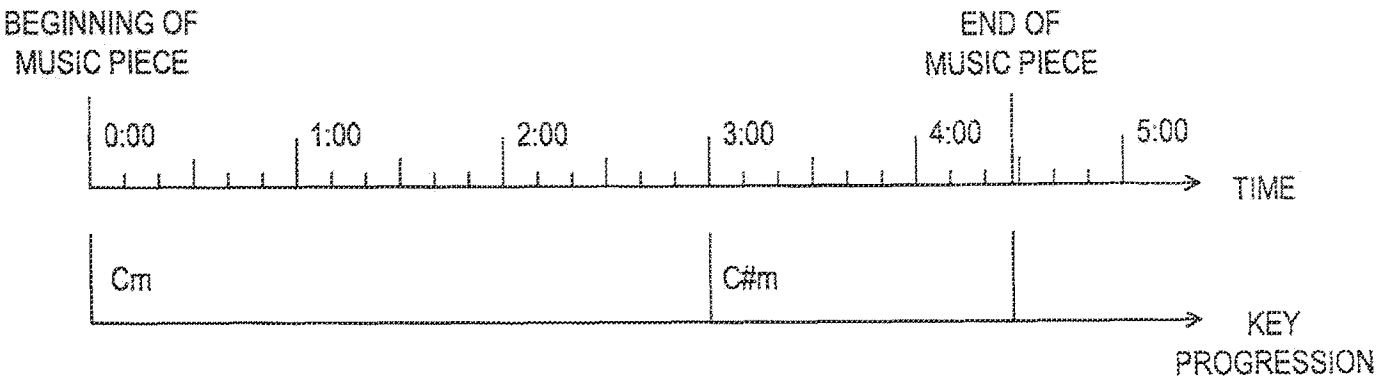
FIG. 54 is an explanatory diagram showing examples of the chord probability detection method and the key detection method according to the present embodiment.

The key determination unit 246 sequentially multiplies with each other (1) key probability of each node included in a path and (2) key transition probability given to a transition between nodes, with respect to each path representing the key progression. Then, the key determination unit 246 determines the path for which the multiplication result as the path evaluation value is the largest as the optimum path representing a likely key progression. For example, a key progression as shown in FIG. 54 is determined by the key determination unit 246. In FIG. 54, an example of a key progression of a music piece determined by the key determination unit 246 is shown under the time scale from the beginning of the music piece to the end. In this example, the key of the music piece is "Cm" for three minutes from the beginning of the music piece. Then, the key of the music piece changes to "C#m" and the key remains the same until the end of the music piece. The key progression determined by the processing by the relative chord probability generation unit 238, the feature quantity preparation unit 240, the key probability calculation unit 242 and the key determination unit 246 in this manner is input to the bar detection unit 208 (refer to FIG. 2).

(Bar Detection Unit 208)

Figure 55:
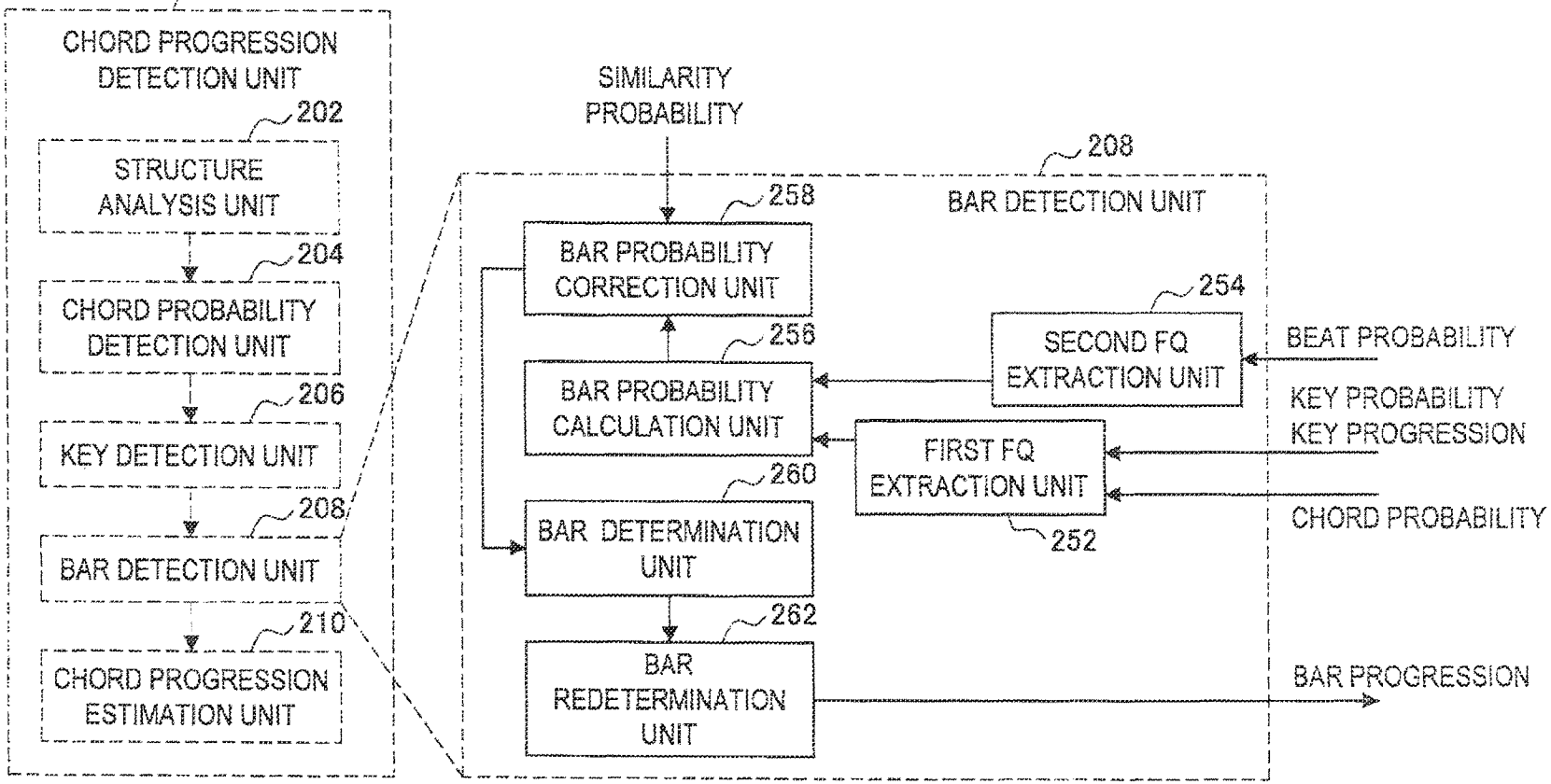
FIG. 55 is an explanatory diagram showing an example of a bar detection method according to the present embodiment.

Next, the bar detection unit 208 will be described. The similarity probability computed by the structure analysis unit 202, the beat probability computed by the beat detection unit 132, the key probability and the key progression computed by the key detection unit 206, and the chord probability detected by the chord probability detection unit 204 are input to the bar detection unit 208. The bar detection unit 208 determines a bar progression indicating to which ordinal in which meter each beat in a series of beats corresponds, based on the beat probability, the similarity probability between beat sections, the chord probability for each beat section, the key progression and the key probability for each beat section. As shown in FIG. 55, the bar detection unit 208 includes a first feature quantity extraction unit 252, a second feature quantity extraction unit 254, a bar probability calculation unit 256, a bar probability correction unit 258, a bar determination unit 260, and a bar redetermination unit 262.

Figure 56:
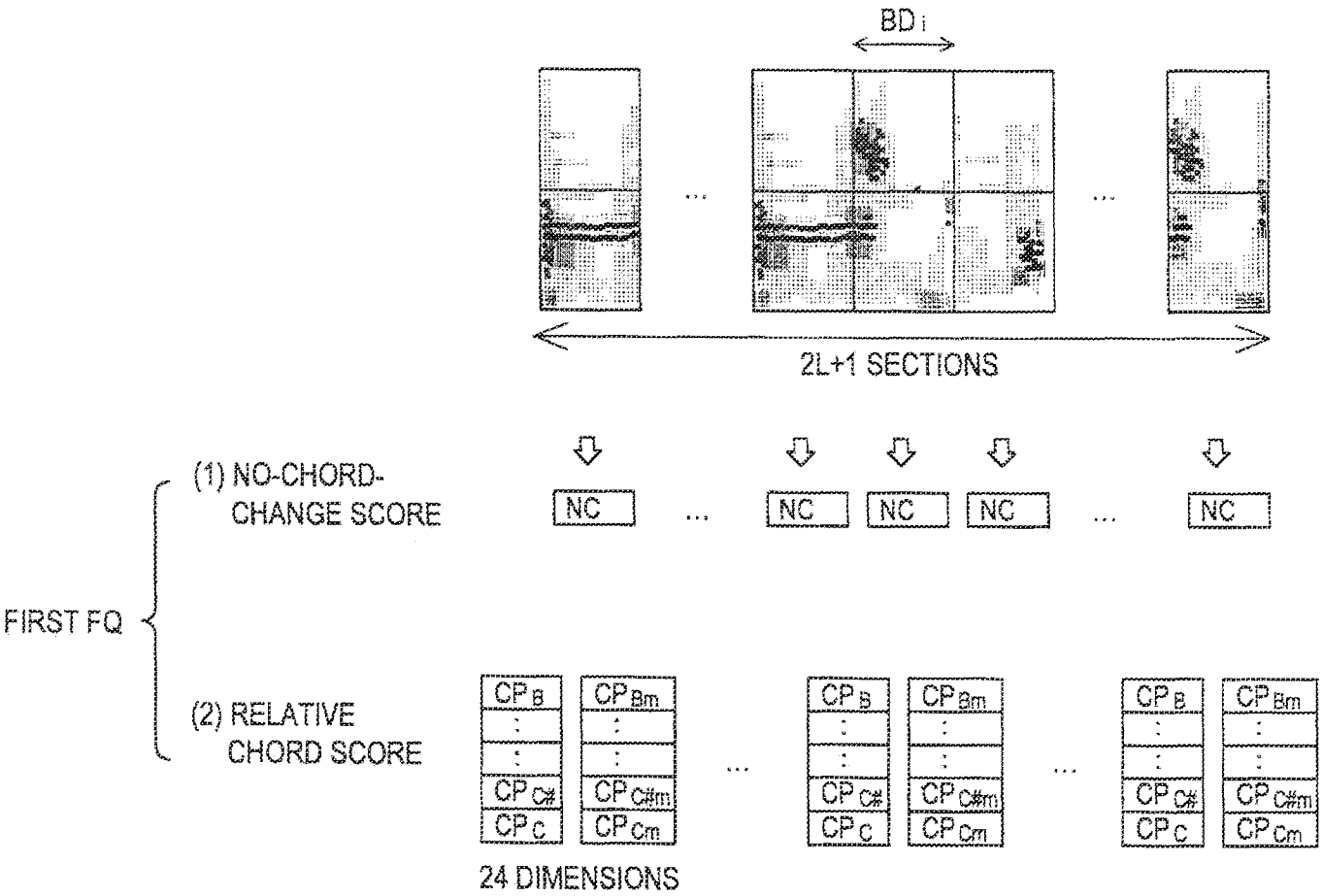
FIG. 56 is an explanatory diagram showing an example of the bar detection method according to the present embodiment.

The first feature quantity extraction unit 252 extracts, for each beat section, a first feature quantity in accordance with the chord probabilities and the key probabilities for the beat section and the preceding and following L sections as the feature quantity used for the calculation of a bar probability described later. For example, the first feature quantity extraction unit 252 extracts the first feature quantity by a method as shown in FIG. 56. As shown in FIG. 56, the first feature quantity includes (1) no-chord-change score and (2) relative chord score derived from the chord probabilities and the key probabilities for a focused beat section $BD_i$ and the preceding and following L beat sections. Among these, the no-chord-change score is a feature quantity having dimensions equivalent to the number of sections including the focused beat section $BD_i$ and the preceding and following L sections. On the other hand, the relative chord score is a feature quantity having 24 dimensions for each of the focused beat section and the preceding and following L sections. For example, when L is 8, the no-chord-change score is 17-dimensional and the relative chord score is 408-dimensional (17×24 dimensions), and thus the first feature quantity has 425 dimensions in total. Hereunder, the no-chord-change score and the relative chord score will be described.

(1) No-Chord-Change Score

Figure 57:
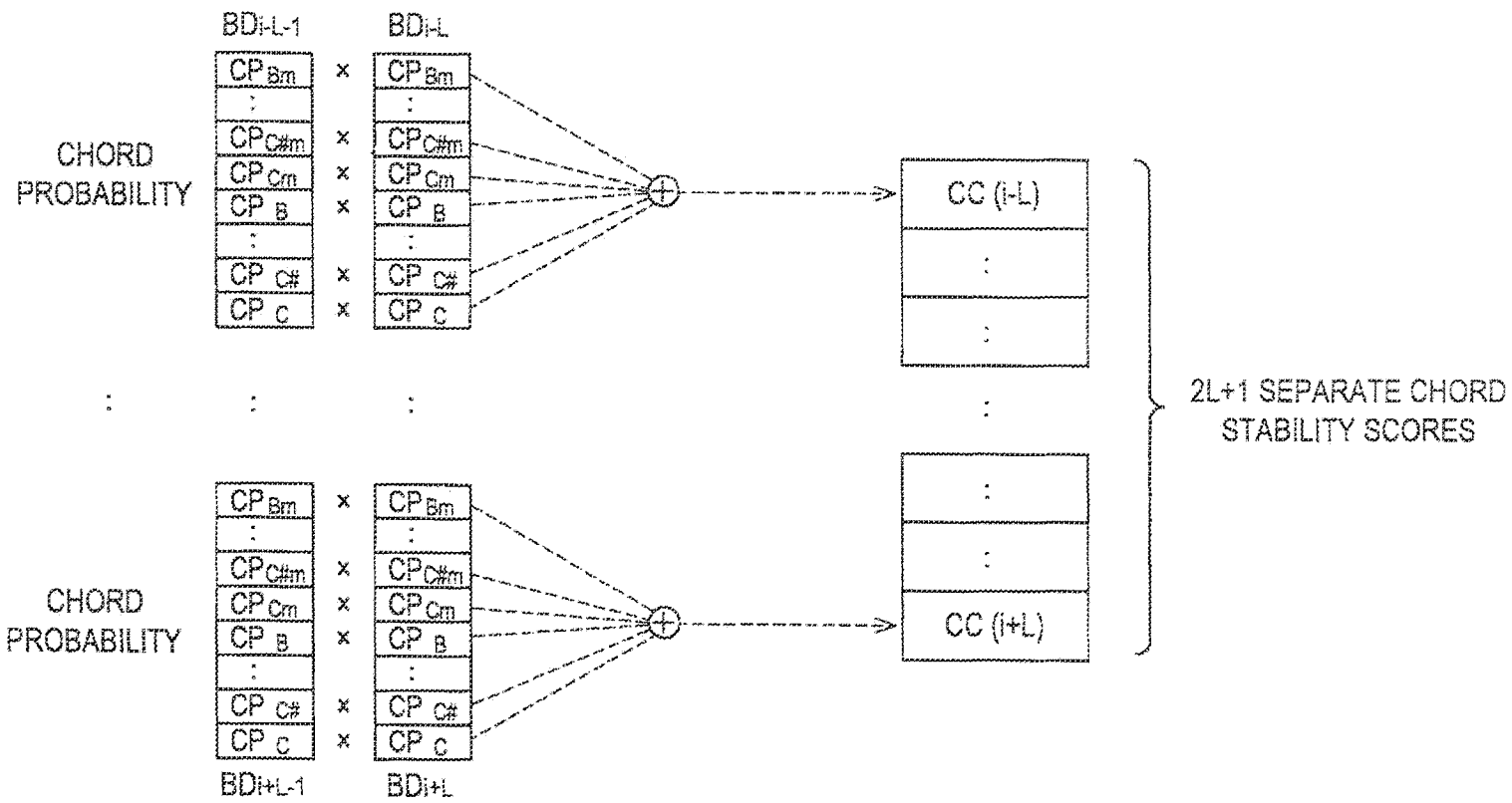
FIG. 57 is an explanatory diagram showing an example of the bar detection method according to the present embodiment.

First, the no-chord-change score will be described. The no-chord-change score is a feature quantity representing the degree of a chord of a music piece not changing over a specific range of sections. The no-chord-change score is obtained by dividing a chord stability score described next by a chord instability score (refer to FIG. 57). In the example of FIG. 57, the chord stability score for a beat section $BD_i$ includes elements CC(i−L) to CC(i+L), each of which is determined for a corresponding section among the beat section $BD_i$ and the preceding and following L sections. Each of the elements is calculated as the total value of the products of the chord probabilities of the chords bearing the same names between a target beat section and the immediately preceding beat section.

For example, by adding up the products of the chord probabilities of the chords bearing the same names among the chord probabilities for a beat section $BD_{i-L-1}$ and a beat section $BD_{i-L}$, a chord stability score CC(i−L) is computed. In a similar manner, by adding up the products of the chord probabilities of the chords bearing the same names among the chord probabilities for a beat section $BD_{i+L-1}$ and a beat section $BD_{i+L}$, a chord stability score CC(i+L) is computed. The first feature quantity extraction unit 252 performs the calculation as described for over the focused beat section $BD_i$ and the preceding and following L sections, and computes 2L+1 separate chord stability scores.

Figure 58:
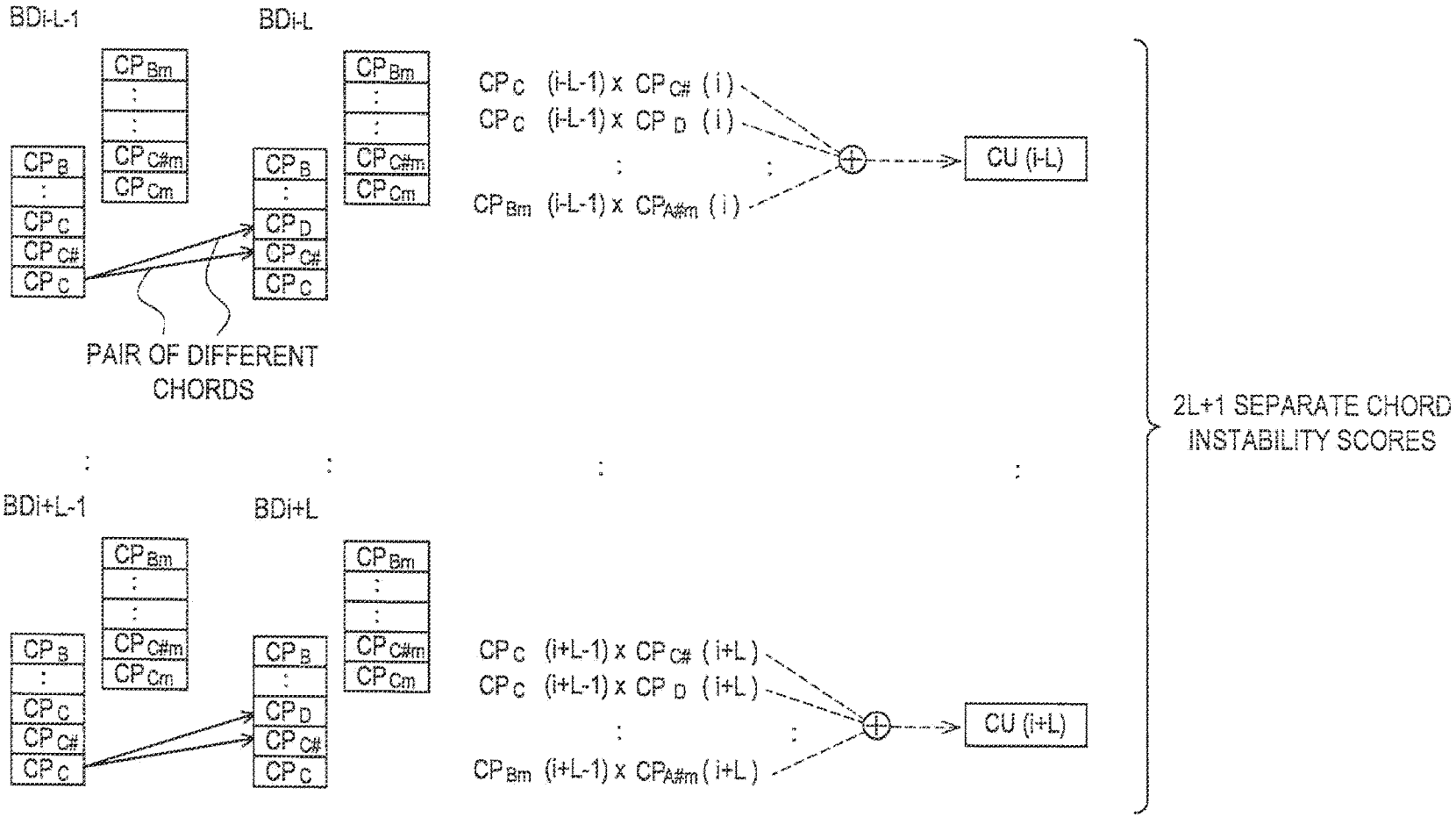
FIG. 58 is an explanatory diagram showing an example of the bar detection method according to the present embodiment.

On the other hand, as shown in FIG. 58, the chord instability score for the beat section $BD_i$ includes elements CU(i−L) to CU(i+L), each of which is determined for a corresponding section among the beat section $BD_i$ and the preceding and following L sections. Each of the elements is calculated as the total value of the products of the chord probabilities of all the pairs of chords bearing different names between a target beat section and the immediately preceding beat section. For example, by adding up the products of the chord probabilities of chords bearing different names among the chord probabilities for the beat section $BD_{i-L-1}$ and the beat section $BD_{i-L}$, a chord instability score CU(i−L) is computed. In a similar manner, by adding up the products of the chord probabilities of chords bearing different names among the chord probabilities for the beat section $BD_{i+L-1}$ and the beat section $BD_{i+L}$, a chord instability score CU(i+L) is computed. The first feature quantity extraction unit 252 performs the calculation as described for over the focused beat section $BD_i$ and the preceding and following L sections, and computes 2L+1 separate beat instability scores.

After computing the beat stability score and the beat instability score, the first feature quantity extraction unit 252 computes, for the focused beat section $BD_i$, the no-chord-change scores by dividing the chord stability score by the chord instability score for each set of 2L+1 elements. For example, let us assume that the chord stability scores CC are ($CC_{i-L}$, . . . , $CC_{i+L}$) and the chord instability scores CU are ($CU_{i-L}$, . . . , $CU_{i+L}$) for the focused beat section. $BD_i$. In this case, the no-chord-change scores CR are ($CC_{i-L}/CU_{i-L}$, . . . , $CC_{i+L}/CU_{i+L}$). The no-chord-change score computed in this manner indicates a higher value as the change of chords within a given range around the focused beat section is less. The first feature quantity extraction unit 252 computes, in this manner, the no-chord-change score for all the beat sections included in the audio signal.

(2) Relative Chord Score

Figure 59:
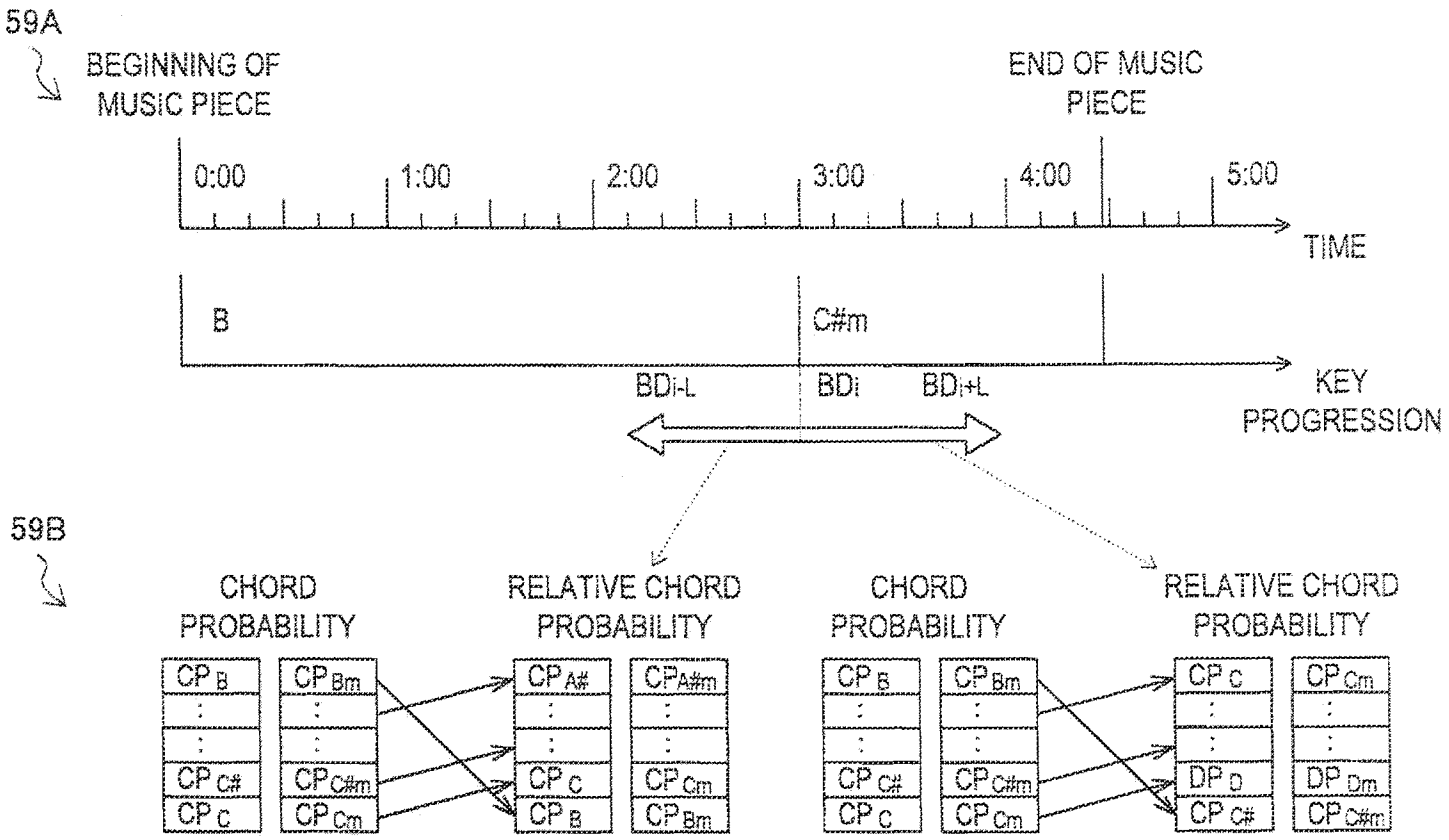
FIG. 59 is an explanatory diagram showing an example of the bar detection method according to the present embodiment.

Next, the relative chord score will be described. The relative chord score is a feature quantity representing the appearance probabilities of chords across sections in a given range and the pattern thereof. The relative chord score is generated by shifting the element positions of the chord probability in accordance with the key progression input from the key detection unit 206. For example, the relative chord score is generated by a method as shown in FIG. 59. An example of the key progression determined by the key detection unit 206 is shown in FIG. 59(A), In this example, the key of the music piece changes from "B" to "C#m" after three minutes from the beginning of the music piece. Furthermore, the position of a focused beat section $BD_i$ is also shown, which includes within the preceding and following L sections a time point of change of the key.

At this time, the first feature quantity extraction unit 252 generates, for a beat section whose key is "B," a relative chord probability where the positions of the elements of a 24-dimensional chord probability, including major and minor, of the beat section are shifted so that the chord probability $CP_B$ comes at the beginning. Also, the first feature quantity extraction unit 252 generates, for a beat section whose key is "C#m," a relative chord probability where the positions of the elements of a 24-dimensional chord probability, including major and minor, of the beat section are shifted so that the chord probability $CP_{C\#m}$ comes at the beginning. The first feature quantity extraction unit 252 generates such a relative chord probability for each of the focused beat section and the preceding and following L sections, and outputs a collection of the generated relative chord probabilities ((2L+1)×24-dimensional feature quantity vector) as the relative chord score.

The first feature quantity formed from (1) no-chord-change score and (2) relative chord score described above is output from the first feature quantity extraction unit 252 to the bar probability calculation unit 256 (refer to FIG. 55). Now, in addition to the first feature quantity, a second feature quantity is also input to the bar probability calculation unit 256. Accordingly, the configuration of the second feature quantity extraction unit 254 will be described.

Figure 60:
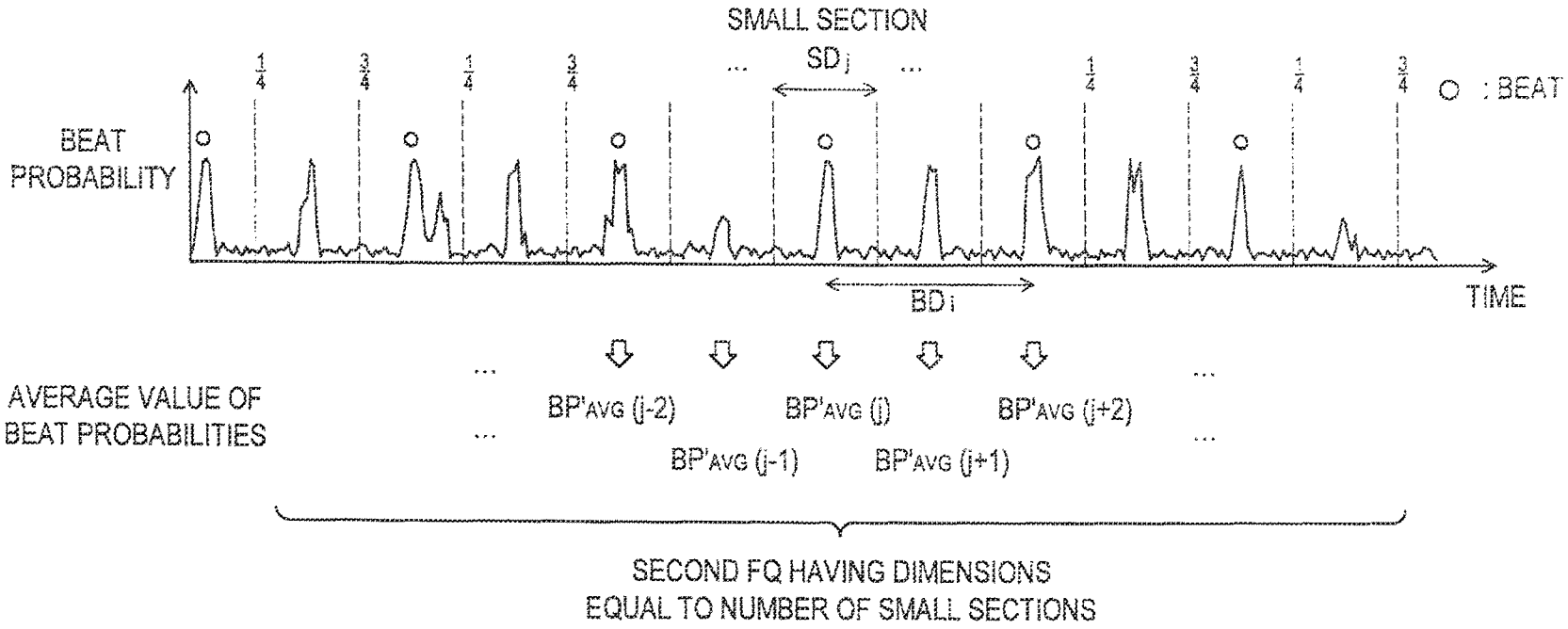
FIG. 60 is an explanatory diagram showing an example of the bar detection method according to the present embodiment.

The second feature quantity extraction unit 254 extracts, for each beat section, a second feature quantity in accordance with the feature of change in the beat probability over the beat section and the preceding and following L sections as the feature quantity used for the calculation of a bar probability described later. For example, the second feature quantity extraction unit 254 extracts the second feature quantity by a method as shown in FIG. 60. The beat probability input from the beat probability computation unit 162 is shown along the time axis in FIG. 60. Furthermore, 6 beats detected by analyzing the beat probability as well as a focused beat section $BD_i$ are also shown in the figure. The second feature quantity extraction unit 254 computes, with respect to the beat probability, the average value of the beat probability for each of a small section $SD_j$ having a specific duration and included in a beat section over the focused beat section $BD_i$ and the preceding and following L sections.

For example, as shown in FIG. 60, to detect mainly a meter whose note value (M of N/M meter) is 4, it is preferable that the small sections are divided from each other by lines dividing a beat interval at positions ¼ and ¾ of the beat interval. In this case, L×4+1 pieces of the average values of the beat probability will be computed for one focused beat section $BD_i$. Accordingly, the second feature quantity extracted by the second feature quantity extraction unit 254 will have L×4+1 dimensions for each focused beat section. Also, the duration of the small section is ½ that of the beat interval. Moreover, to appropriately detect a bar in the music piece, it is desired to analyze the feature of the audio signal over at least several bars. It is therefore preferable that the value of L defining the range of the beat probability used for the extraction of the second feature quantity is 8 beats, for example.

When L is 8, the second feature quantity extracted by the second feature quantity extraction unit 254 is 33-dimensional for each focused beat section.

The second feature quantity extracted in this manner is input to the bar probability calculation unit 256 from the second feature quantity extraction unit 254.

As described above, the first feature quantity and the second feature quantity are input to the bar probability calculation unit 256. Thus, the bar probability calculation unit 256 computes the bar probability for each beat by using the first feature quantity and the second feature quantity. The bar probability here means a collection of probabilities of respective beats being the Y-th beat in an X meter. In the subsequent explanation, each ordinal in each meter is made to be the subject of the discrimination, where each meter is any of a ¼ meter, a ⅔ meter, a ¾ meter and a 4/4 meter, for example. In this case, there are 10 separate sets of X and Y, namely, (1, 1), (2, 1), (2, 2), (3, 1), (3, 2), (3, 3), (4, 1), (4, 2), (4, 3), and (4, 4). Accordingly, 10 types of bar probabilities are computed.

Moreover, the probability values computed by the bar probability calculation unit 256 are corrected by the bar probability correction unit 258 described later taking into account the structure of the music piece. Accordingly, the probability values computed by the bar probability calculation unit 256 are intermediary data yet to be corrected. A bar probability formula learnt in advance by a logistic regression analysis is used for the computation of the bar probability by the bar probability calculation unit 256, for example. For example, a bar probability formula used for the calculation of the bar probability is generated by a method as shown in FIG. 61. Moreover, a bar probability formula is generated for each type of the bar probability described above. For example, when presuming that the ordinal of each beat in a ¼ meter, a ⅔ meter, a ¾ meter and a 4/4 meter is to be discriminated, 10 separate bar probability formulae are to be generated.

First, a plurality of pairs of the first feature quantity and the second feature quantity which are extracted by analyzing the audio signal and whose correct meters (X) and correct ordinals of beats (Y) are known are provided as independent variables for the logistic regression analysis. Next, dummy data for predicting, the generation probability for each of the provided pairs of the first feature quantity and the second feature quantity by the logistic regression analysis is provided. For example, when learning a formula for discriminating a first beat in a ¼ meter to compute the probability of a beat being the first beat in a ¼ meter, the value of the dummy data will be a true value (1) if the known meter and ordinal are (1, 1), and a false value (0) for any other case. Also, when learning a formula for discriminating a first beat in ⅔ meter to compute the probability of a beat being the first beat in a ⅔ meter, for example, the value of the dummy data will be a true value (1) if the known meter and ordinal are (2, 1), and a false value (0) for any other case. The same can be said for other meters and ordinals.

Figure 62:
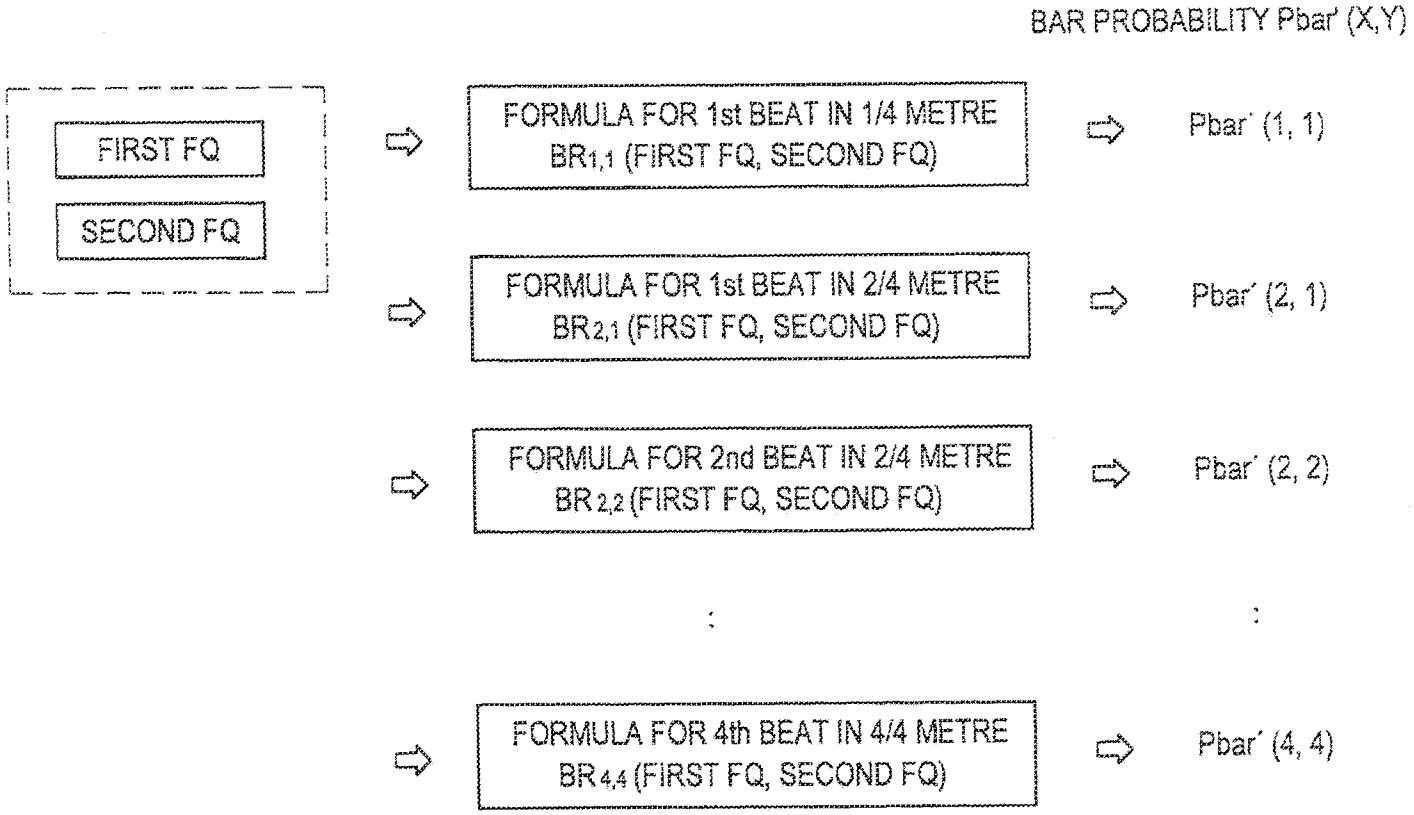
FIG. 62 is an explanatory diagram showing an example of the bar detection method according to the present embodiment.

By performing the logistic regression analysis by using a sufficient number of pairs of the independent variable and the dummy data as described above, 10 types of bar probability formulae for computing the bar probability from a pair of the first feature quantity and the second feature quantity are obtained in advance. Then, the bar probability calculation unit 256 applies the bar probability formula to a pair of the first feature quantity and the second feature quantity input from the first feature quantity extraction unit 252 and the second feature quantity extraction unit 254, and computes the bar probabilities for respective beat sections. For example, the bar probability is computed by a method as shown in FIG. 62. As shown in FIG. 62, the bar probability calculation unit 256 applies the formula for discriminating a first beat in a ¼ meter obtained in advance to a pair of the first feature quantity and the second feature quantity extracted for a focused beat section, and calculates a bar probability $P_{bar}'$ (1, 1) of a beat being the first beat in a ¼ meter. Also, the bar probability calculation unit 256 applies the formula for discriminating a first beat in a ⅔ meter obtained in advance to the pair of the first feature quantity and the second feature quantity extracted for the focused beat section, and calculates a bar probability $P_{bar}'$ (2, 1) of a beat being the first beat in a ⅔ meter. The same can be said for other meters and ordinals.

The bar probability calculation unit 256 repeats the calculation of the bar probability for all the beats, and computes the bar probability for each beat. The bar probability computed for each beat by the bar probability calculation unit 256 is input to the bar probability correction unit 258 (refer to FIG. 55).

The bar probability correction unit 258 corrects the bar probabilities input from the bar probability calculation unit 256, based on the similarity probabilities between beat sections input from the structure analysis unit 202. For example, let us assume that the bar probability of an i-th focused beat being a Y-th beat in an X meter, where the bar probability is yet to be corrected, is $P_{bar}'$ (i, x, y), and the similarity probability between an i-th beat section and a j-th beat section is SP(i, j). In this case, a bar probability after correction $P_{bar}$(i, x, y) is given by the following equation (11), for example.

[Equation 10]

$$P_{bar}(i, x, y) = \sum_j P'_{bar}(j, x, y) \cdot \left( \frac{SP(i, j)}{\sum_k SP(i, k)} \right) \tag{11}$$

As described above, the bar probability after correction $P_{bar}$(i, x, y) is a value obtained by weighting and summing the bar probabilities before correction by using normalized similarity probabilities as weights where the similarity probabilities are those between a beat section corresponding to a focused beat and other beat sections. By such a correction of probability values, the bar probabilities of beats of similar sound contents will have closer values compared to the bar probabilities before correction. The bar probabilities for respective beats corrected by the bar probability correction unit 258 are input to the bar determination unit 260 (refer to FIG. 55).

Figure 63:
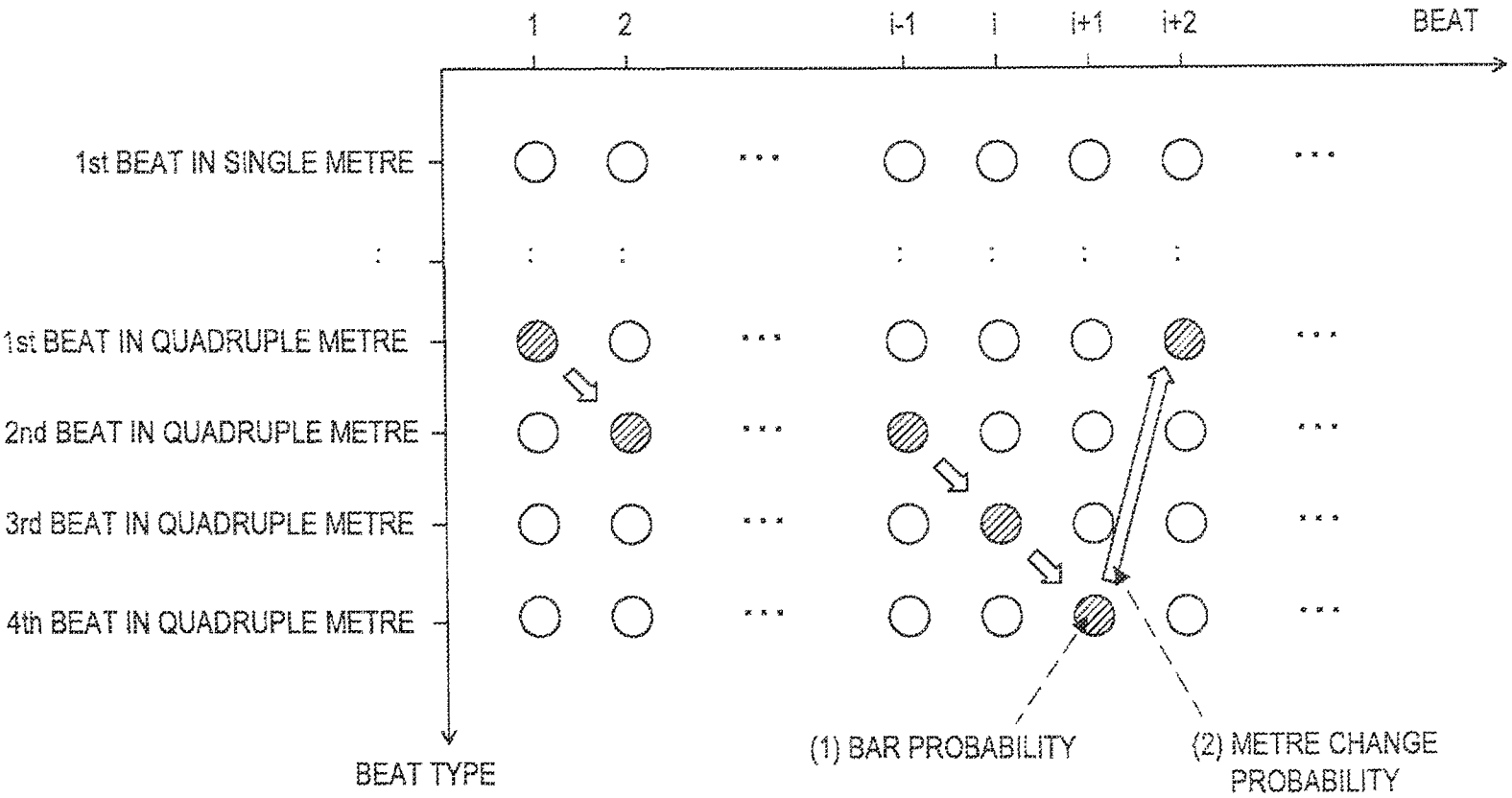
FIG. 63 is an explanatory diagram showing an example of the bar detection method according to the present embodiment.

The bar determination unit 260 determines a likely bar progression by a path search, based on the bar probabilities input from the bar probability correction unit 258, the bar probabilities indicating the probabilities of respective beats being a Y-th beat in an X meter. The Viterbi algorithm is used as the method of path search by the bar determination unit 260, for example. The path search is performed by the bar determination unit 260 by a method as shown in FIG. 63, for example. As shown in FIG. 63, beats are arranged sequentially on the time axis (horizontal axis). Furthermore, the types of beats (Y-th beat in X meter) for which the bar probabilities have been computed are used for the observation sequence (vertical axis). The bar determination unit 260 takes, as the subject node of the path search, each of all the pairs of a beat input from the bar probability correction unit 258 and a type of beat.

With regard to the subject node as described, the bar determination unit 260 sequentially selects, along the time axis, any of the nodes. Then, the bar determination unit 260 evaluates a path formed from a series of selected nodes by using two evaluation values, (1) bar probability and (2) meter change probability. Moreover, at the time of the selection of nodes by the bar determination unit 260, it is preferable that restrictions described below are imposed, for example. As a first restriction, skipping of beat is prohibited. As a second restriction, transition from a meter to another meter in the middle of a bar, such as transition from any of the first to third beats in a quadruple meter or the first or second beat in a triple meter, or transition from a meter to the middle of a bar of another meter is prohibited. As a third restriction, transition whereby the ordinals are out of order, such as from the first beat to the third or fourth beat, or from the second beat to the second or fourth beat, is prohibited.

Now, (1) bar probability, among the evaluation values used for the evaluation of a path by the bar determination unit 260, is the bar probability described above that is computed by correcting the bar probability by the bar probability correction unit 258. The bar probability is given to each of the nodes shown in FIG. 63. On the other hand, (2) meter change probability is an evaluation value given to the transition between nodes. The meter change probability is predefined for each set of a type of beat before change and a type of beat after change by collecting, from a large number of common music pieces, the occurrence probabilities for changes of meters during the progression of bars.

For example, an example of the meter change probability is shown in FIG. 64. In FIG. 64, 16 separate meter change probabilities derived based on four types of meters before change and four types of meters after change are shown. In this example, the meter change probability for a change from a quadruple meter to a single meter is 0.05, the meter change probability from the quadruple meter to a duple meter is 0.03, the meter change probability from the quadruple meter to a triple meter is 0.02, and the meter change probability from the quadruple meter to the quadruple meter (i.e. no change) is 0.90. As in this example, the possibility of the meter changing in the middle of a music piece is generally not high. Furthermore, regarding the single meter or the duple meter, in case the detected position of a bar is shifted from its correct position due to a detection error of the bar, the meter change probability may serve to automatically restore the position of the bar. Thus, the value of the meter change probability between the single meter or the duple meter and another meter is preferably set to be higher than the meter change probability between the triple meter or the quadruple meter and another meter.

Figure 65:
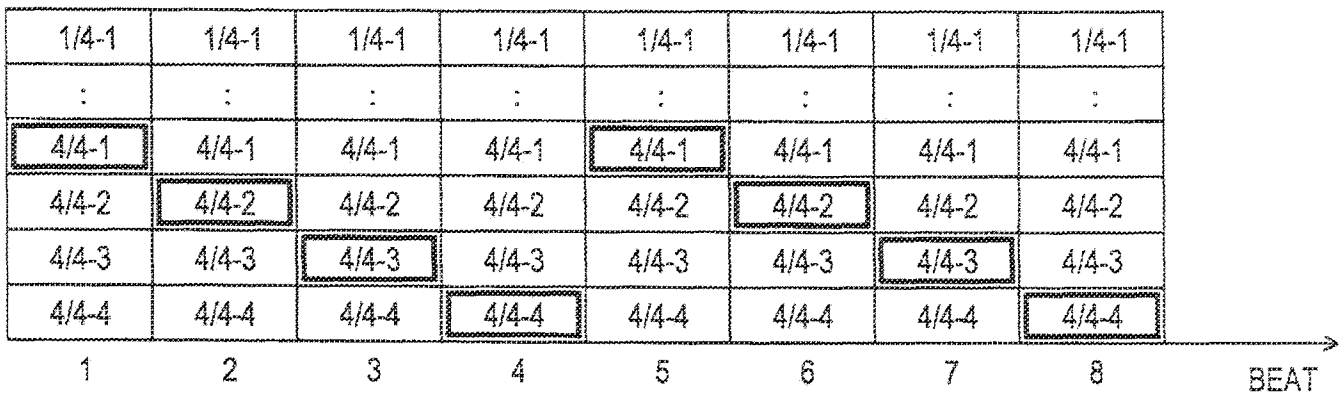
FIG. 65 is an explanatory diagram showing an example of the bar detection method according to the present embodiment.

The bar determination unit 260 sequentially multiplies with each other (1) bar probability of each node included in a path and (2) meter change probability given to the transition between nodes, with respect to each path representing the bar progression. Then, the bar determination unit 260 determines the path for which the multiplication result as the path evaluation value is the largest as the maximum likelihood path representing a likely bar progression. For example, a bar progression as shown in FIG. 65 is obtained based on the maximum likelihood path determined by the bar determination unit 260. In the example of FIG. 65, the bar progression determined to be the maximum likelihood path by the bar determination unit 260 is shown for the first to eighth beat (see thick-line box). In this example, the type of each beat is, sequentially from the first beat, first beat in quadruple meter, second beat in quadruple meter, third beat in quadruple meter, fourth beat in quadruple meter, first beat in quadruple meter, second beat in quadruple meter, third beat in quadruple meter, and fourth beat in quadruple meter. The bar progression which is determined by the bar determination unit 260 is input to the bar redetermination unit 262.

Now, in a common music piece, it is rare that a triple meter and a quadruple meter are present in a mixed manner for the types of beats. Taking this circumstance into account, the bar redetermination unit 262 first decides whether a triple meter and a quadruple meter are present in a mixed manner for the types of beats appearing in the bar progression input from the bar determination unit 260. In case a triple meter and a quadruple meter are present in a mixed manner for the type of beats, the bar redetermination unit 262 excludes the less frequently appearing meter from the subject of search and searches again for the maximum likelihood path representing the bar progression. According to the path re-search process by the bar redetermination unit 262 as described, recognition errors of bars (types of beats) which might partially occur in a result of the path search can be reduced.

Heretofore, the bar detection unit 208 has been described. The bar progression detected by the bar detection unit 208 is input to the chord progression estimation unit 210 (refer to FIG. 2).

(Chord Progression Estimation Unit 210)

Figure 66:
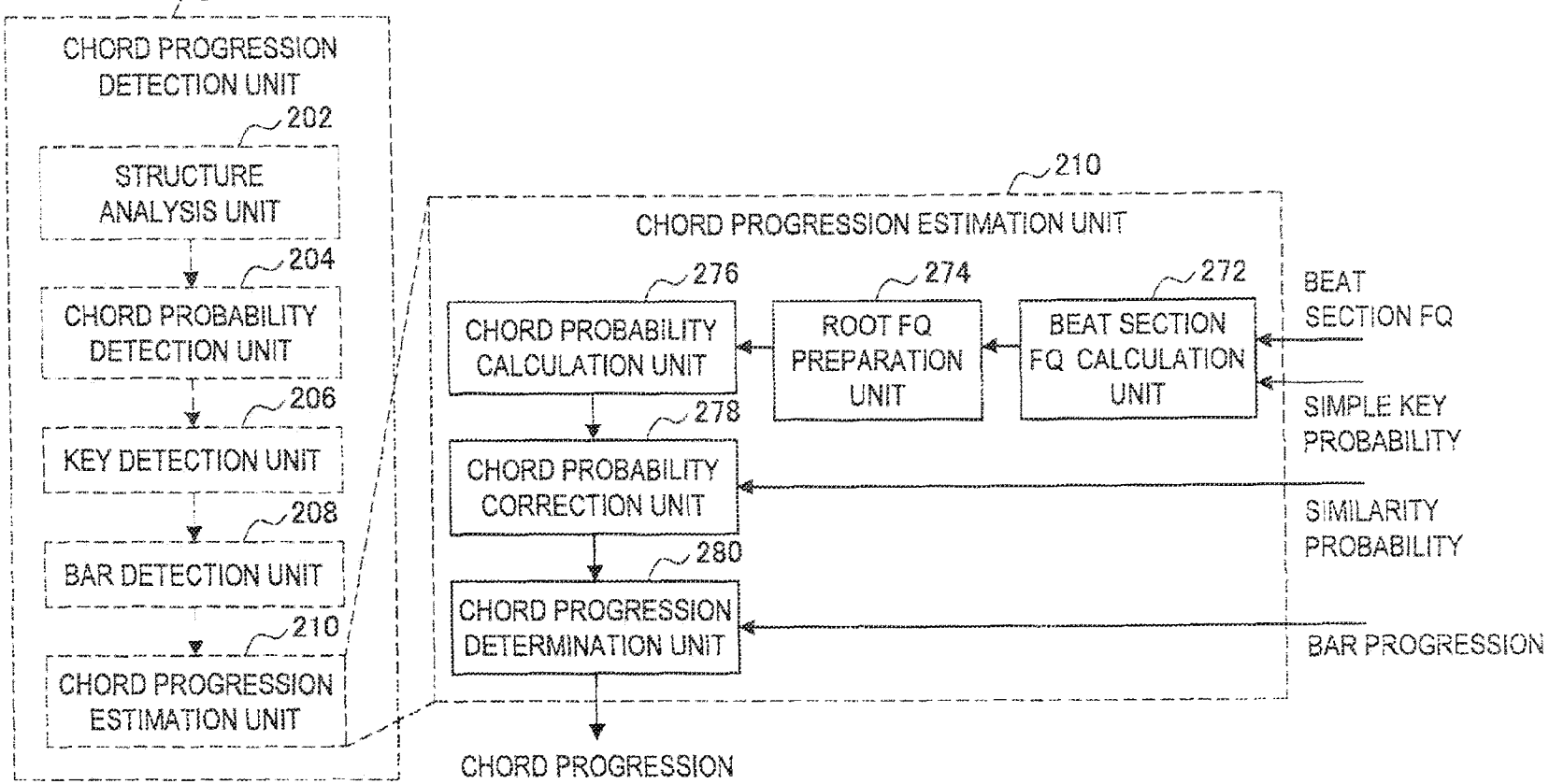
FIG. 66 is an explanatory diagram showing an example of a chord progression estimation method according to the present embodiment.

Next, the chord progression estimation unit 210 will be described. The simple key probability for each beat, the similarity probability between beat sections and the bar progression are input to the chord progression estimation unit 210. Thus, the chord progression estimation unit 210 determines a likely chord progression formed from a series of chords for each beat section based on these input values. As shown in FIG. 66, the chord progression estimation unit 210 includes a beat section feature quantity calculation unit 272, a root feature quantity preparation unit 274, a chord probability calculation unit 276, a chord probability correction unit 278, and a chord progression determination unit 280.

As with the beat section feature quantity calculation unit 232 of the chord probability detection unit 204, the beat section feature quantity calculation unit 272 first calculates energies-of-respective-12-notes. However, the beat section feature quantity calculation unit 272 may obtain and use the energies-of-respective-12-notes computed by the beat section feature quantity calculation unit 232 of the chord probability detection unit 204. Next, the beat section feature quantity calculation unit 272 generates an extended beat section feature quantity including the energies-of-respective-12-notes of a focused beat section and the preceding and following N sections as well as the simple key probability input from the key detection unit 206. For example, the beat section feature quantity calculation unit 272 generates the extended beat section feature quantity by a method as shown in FIG. 67.

Figure 67:
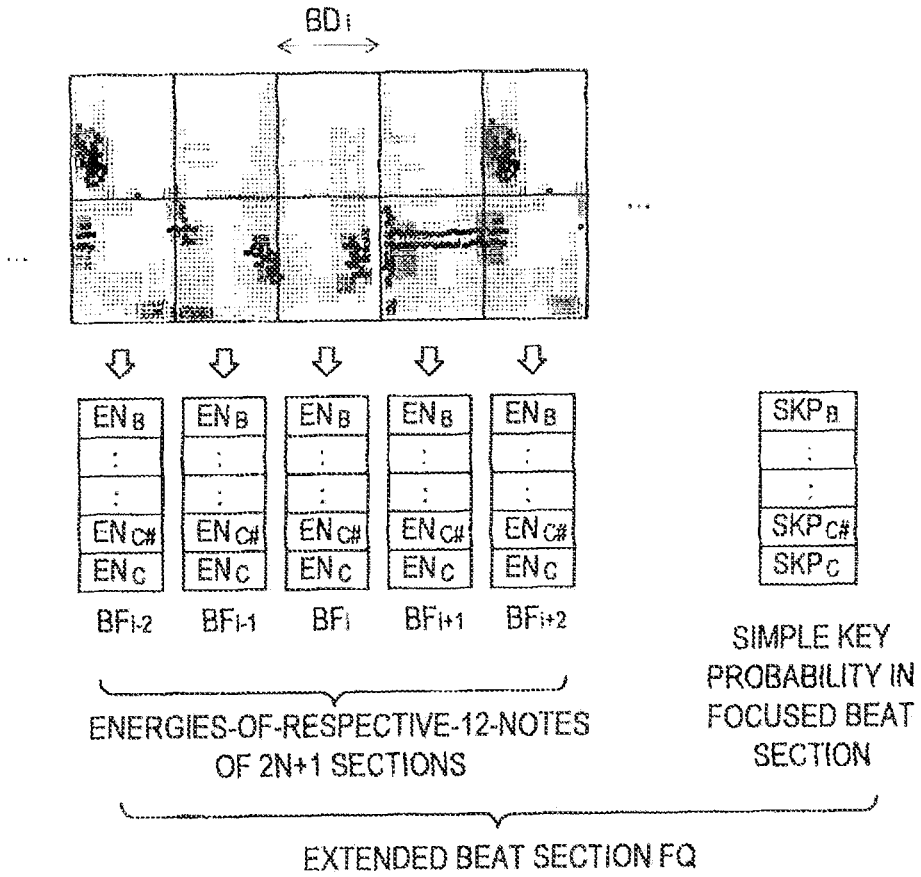
FIG. 67 is an explanatory diagram showing an example of the chord progression estimation method according to the present embodiment.

As shown in FIG. 67, the beat section feature quantity calculation unit 272 extracts the energies-of-respective-12-notes, $BF_{i-2}$, $BF_{i-1}$, $BF_i$, $BF_{i+1}$ and $BF_{i+2}$, respectively of a focused beat section $BD_i$ and the preceding and following N sections, for example. "N" here is 2, for example. Also, the simple key probability ($SKP_C, \ldots, SKP_B$) of the focused beat section $BD_i$ is obtained. The beat section feature quantity calculation unit 272 generates, for all the beat sections, the extended beat section feature quantities including the energies-of-respective-12-notes of a beat section and the preceding and following N sections and the simple key probability, and inputs the same to the root feature quantity preparation unit 274 (refer to FIG. 66).

Figure 68:
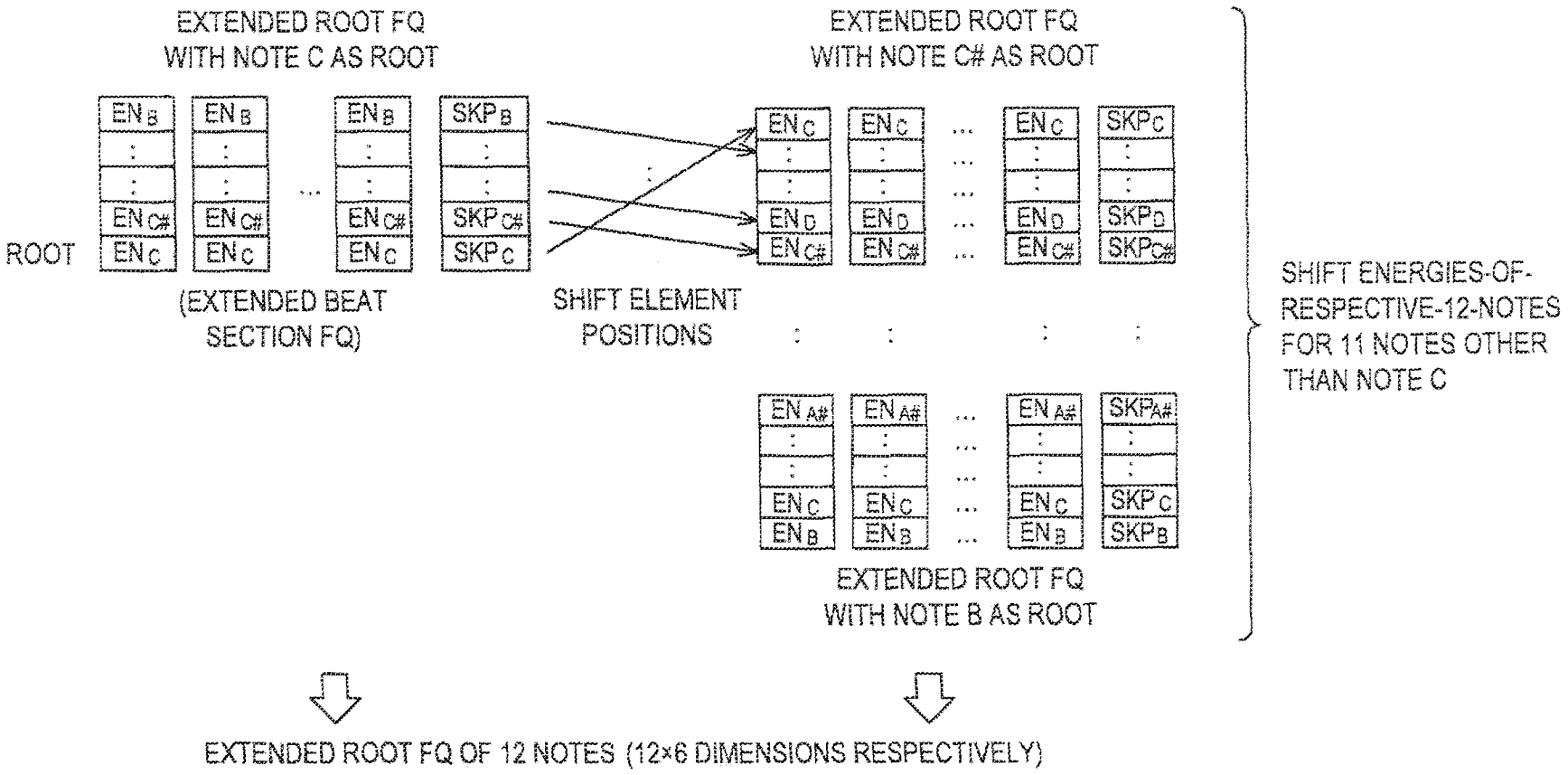
FIG. 68 is an explanatory diagram showing an example of the chord progression estimation method according to the present embodiment.

The root feature quantity preparation unit 274 shifts the element positions of the extended root feature quantity input from the beat section feature quantity calculation unit 272, and generates 12 separate extended root feature quantities. For example, the root feature quantity preparation unit 274 generates the extended beat section feature quantities by a method as shown in FIG. 68. As shown in FIG. 68, the root feature quantity preparation unit 274 takes the extended beat section feature quantity input from the beat section feature quantity calculation unit 272 as an extended root feature quantity with the note C as the root. Next, the root feature quantity preparation unit 274 shifts by a specific number the element positions of the 12 notes of the extended root feature quantity having the note C as the root. By this shifting process, 11 separate extended root feature quantities, each having any of the note C# to the note B as the root, are generated. Moreover, the number of shifts by which the element positions are shifted is the same as the number of shifts used by the root feature quantity preparation unit 234 of the chord probability detection unit 204.

The root feature quantity preparation unit 274 performs the extended root feature quantity generation process as described for all the beat sections, and prepares extended root feature quantities to be used for the recalculation of the chord probability for each section. The extended root feature quantities generated by the root feature quantity preparation unit 274 are input to the chord probability calculation unit 276 (refer to FIG. 66).

The chord probability calculation unit 276 calculates, for each beat section, a chord probability indicating the probability of each chord being played, by using the root feature quantities input from the root feature quantity preparation unit 274. "Each chord" here means each of the chords distinguished by the root (C, C#, D, . . . ), the number of constituent notes (a triad, a 7th chord, a 9th chord), the tonality (major/minor), or the like, for example. An extended chord probability formula obtained by a learning process according to a logistic regression analysis is used for the computation of the chord probability, for example. For example, the extended chord probability formula to be used for the recalculation of the chord probability by the chord probability calculation unit 276 is generated by a method as shown in FIG. 69. Moreover, the learning of the extended chord probability formula is performed for each type of chord as in the case for the chord probability formula. That is, a learning process is performed for each of an extended chord probability formula for a major chord, an extended chord probability formula for a minor chord, an extended chord probability formula for a 7th chord and an extended chord probability formula for a 9th chord, for example.

First, a plurality of extended root feature quantities (for example, 12 separate 12×6-dimensional vectors described by using FIG. 68), respectively for a beat section whose correct chord is known, are provided as independent variables for the logistic regression analysis. Furthermore, dummy data for predicting the generation probability by the logistic regression analysis is provided for each of the extended root feature quantities for respective beat sections. For example, when learning the extended chord probability formula for a major chord, the value of the dummy data will be a true value (1) if a known chord is a major chord, and a false value (0) for any other case. Also, when learning the extended chord probability formula for a minor chord, the value of the dummy data will be a true value (1) if a known chord is a minor chord, and a false value (0) for any other case. The same can be said for the 7th chord and the 9th chord.

Figure 70:
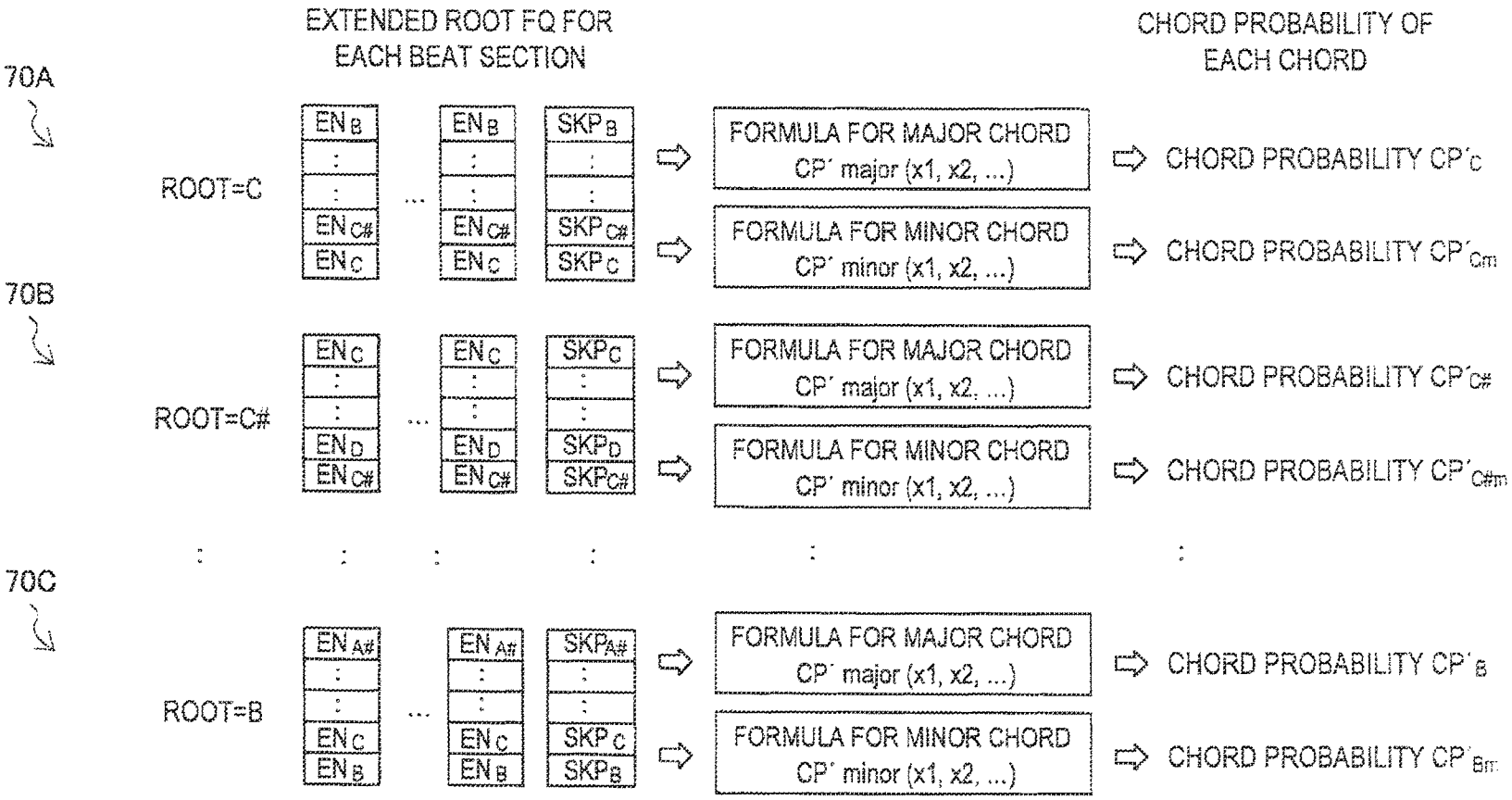
FIG. 70 is an explanatory diagram showing an example of the chord progression estimation method according to the present embodiment.

By performing the logistic regression analysis for a sufficient number of the extended root feature quantities, each for a beat section, by using the independent variables and the dummy data as described above, an extended chord probability formula for recalculating each chord probability from the root feature quantity is obtained. When the extended chord probability formula is generated, the chord probability calculation unit 276 applies the extended chord probability formula to the extended root feature quantity input from the extended root feature quantity preparation unit 274, and sequentially computes the chord probabilities for respective beat sections. For example, the chord probability calculation unit 276 recalculates the chord probability by a method as shown in FIG. 70.

In FIG. 70(A), an extended root feature quantity with the note C as the root, among the extended root feature quantities for each beat section, is shown. The chord probability calculation unit 276 applies the extended chord probability formula for a major chord to the extended root feature quantity with the note C as the root, for example, and calculates a chord probability $CP'_C$ of the chord being "C" for the beat section. Furthermore, the chord probability calculation unit 276 applies the extended chord probability formula for a minor chord to the extended root feature quantity with the note C as the root, and recalculates a chord probability $CP'_{Cm}$ of the chord being "Cm" for the beat section. In a similar manner, the chord probability calculation unit 276 applies the extended chord probability formula for a major chord and the extended chord probability formula for a minor chord to the extended root feature quantity with the note C# as the root, and recalculates a chord probability $CP'_{C\#}$ and a chord probability $CP'_{C\#m}$ (B). The same can be said for the recalculation of a chord probability $CP'_B$, a chord probability $CP'_{Bm}$ (C), and chord probabilities for other types of chords (including 7th, 9th and the like).

The chord probability calculation unit 276 repeats the recalculation process for the chord probabilities as described above for all the focused beat sections, and outputs the recalculated chord probabilities to the chord probability correction unit 278 (refer to FIG. 66).

The chord probability correction unit 278 corrects the chord probability recalculated by the chord probability calculation unit 276, based on the similarity probabilities between beat sections input from the structure analysis unit 202. For example, let us assume that the chord probability for a chord X in an i-th focused beat section is $CP'_x(i)$, and the similarity probability between the i-th beat section and a j-th beat section is SP(i, j). Then, a chord probability after correction $CP''_x(i)$ is given by the following equation (12).

[Equation 11]

$$CP''_X(i) = \sum_j CP'_X(j) \cdot \left( \frac{SP(i, j)}{\sum_k SP(i, k)} \right) \tag{12}$$

That is, the chord probability after correction $CP''_x(i)$ is a value obtained by weighting and summing the chord probabilities by using normalized similarity probabilities where each of the similarity probabilities between a beat section corresponding to a focused beat and another beat section is taken as a weight. By such a correction of probability values, the chord probabilities of beat sections with similar sound contents will have closer values compared to before correction. The chord probabilities for respective beat sections corrected by the chord probability correction unit 278 are input to the chord progression determination unit 280 (refer to FIG. 66).

Figure 71:
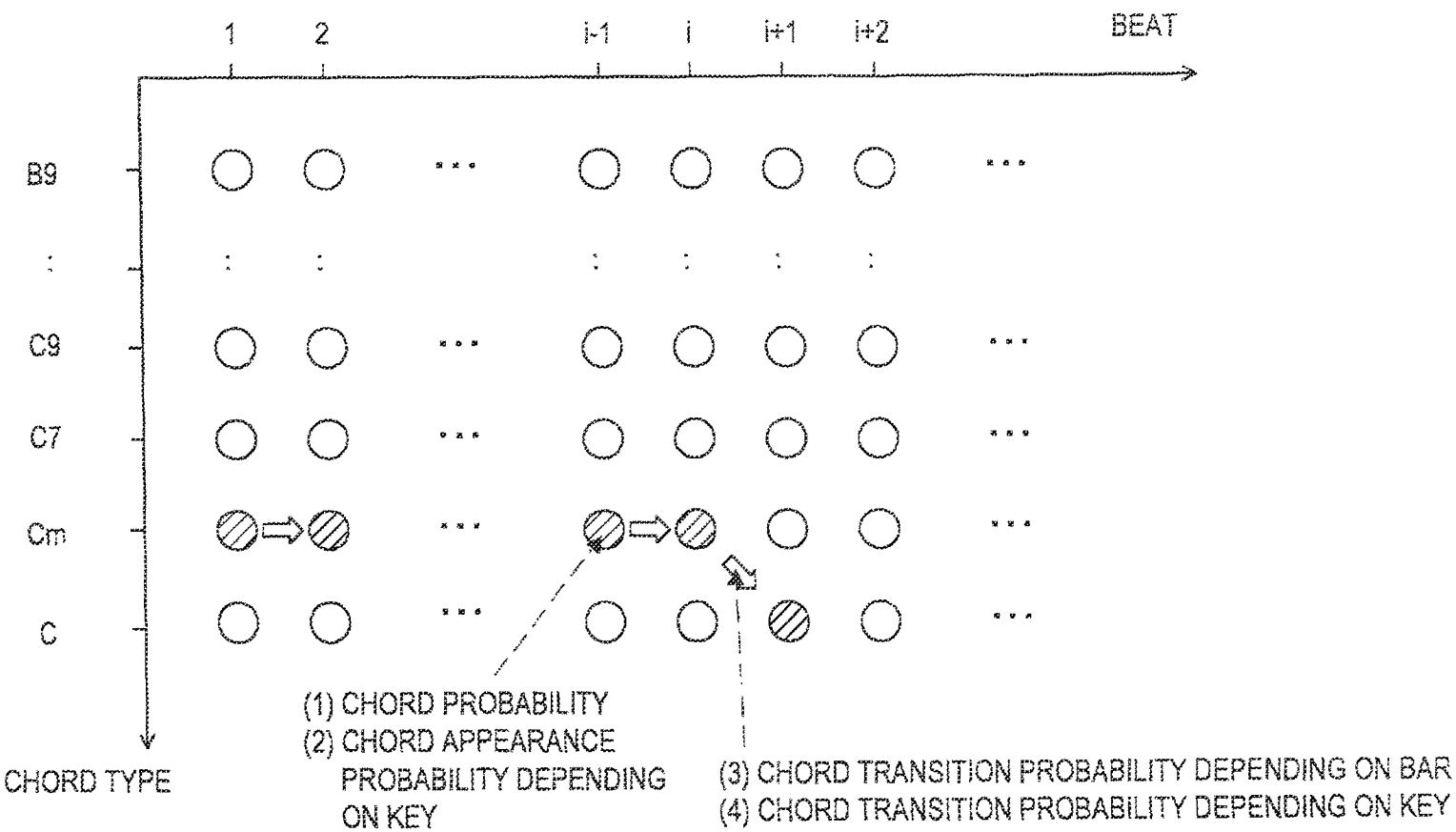
FIG. 71 is an explanatory diagram showing an example of the chord progression estimation method according to the present embodiment.

The chord progression determination unit 280 determines a likely chord progression by a path search, based on the chord probabilities for respective beat positions input from the chord probability correction unit 278. The Viterbi algorithm can be used as the method of path search by the chord progression determination unit 280, for example. The path search is performed by a method as shown in FIG. 71, for example. As shown in FIG. 71, beats are arranged sequentially on the time axis (horizontal axis). Furthermore, the types of chords for which the chord probabilities have been computed are used for the observation sequence (vertical axis). That is, the chord progression determination unit 280 takes, as the subject node of the path search, each of all the pairs of a beat section input from the chord probability correction unit 278 and a type of chord.

With regard to the node as described, the chord progression determination unit 280 sequentially selects, along the time axis, any of the nodes. Then, the chord progression determination unit 280 evaluates a path formed from a series of selected nodes by using four evaluation values, (1) chord probability, (2) chord appearance probability depending on the key, (3) chord transition probability depending on the bar, and (4) chord transition probability depending on the key. Moreover, skipping of beat is not allowed at the time of selection of a node by the chord progression determination unit 280.

Among the evaluation values used for the evaluation of a path by the chord progression determination unit 280, (1) chord probability is the chord probability described above corrected by the chord probability correction unit 278. The chord probability is given to each node shown in FIG. 71. Furthermore, (2) chord appearance probability depending on the key is an appearance probability for each chord depending on a key specified for each beat section according to the key progression input from the key detection unit 206. The chord appearance probability depending on the key is predefined by aggregating the appearance probabilities for chords for a large number of music pieces, for each type of key used in the music pieces. Generally, the appearance probability is high for each of chords "C," "F," and "G" in a music piece whose key is C. The chord appearance probability depending on the key is given to each node shown in FIG. 71.

Furthermore, (3) chord transition probability depending on the bar is a transition probability for a chord depending on the type of a beat specified for each beat according to the bar progression input from the bar detection unit 208. The chord transition probability depending on the bar is predefined by aggregating the chord transition probabilities for a number of music pieces, for each pair of the types of adjacent beats in the bar progression of the music pieces. Generally, the probability of a chord changing at the time of change of the bar (beat after the transition is the first beat) or at the time of transition from a second beat to a third beat in a quadruple meter is higher than the probability of a chord changing at the time of other transitions. The chord transition probability depending on the bar is given to the transition between nodes. Furthermore, (4) chord transition probability depending on the key is a transition probability for a chord depending on a key specified for each beat section according to the key progression input from the key detection unit 206. The chord transition probability depending on the key is predefined by aggregating the chord transition probabilities for a large number of music pieces, for each type of key used in the music pieces. The chord transition probability depending on the key is given to the transition between nodes.

Figure 72:
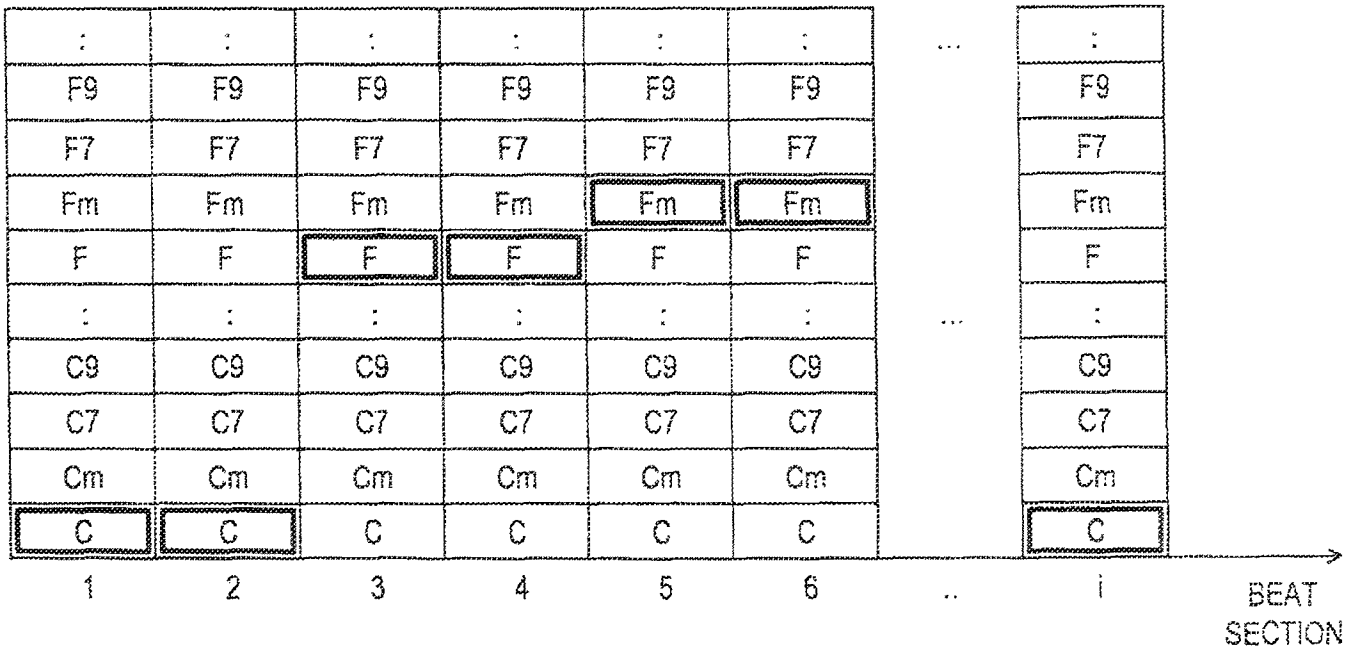
FIG. 72 is an explanatory diagram showing an example of the chord progression estimation method according to the present embodiment.

The chord progression determination unit 280 sequentially multiplies with each other the evaluation values of the above-described (1) to (4) for each node included in a path, with respect to each path representing the chord progression described by using FIG. 71. Then, the chord progression determination unit 280 determines the path whose multiplication result as the path evaluation value is the largest as the maximum likelihood path representing a likely chord progression. For example, the chord progression determination unit 280 can obtain a chord progression as shown in FIG. 72 by determining the maximum likelihood path. In the example of FIG. 72, the chord progression determined by the chord progression determination unit 280 to be the maximum likelihood path for first to sixth beat sections and an i-th beat section is shown (see thick-line box). According to this example, the chords of the beat sections are "C," "C," "F," "F," "Fm," "Fm," . . . , "C" sequentially from the first beat section.

Heretofore, the configuration of the chord progression detection unit 134 has been described. As described above, the chord progression is detected from the music data by the processing by the structure analysis unit 202 through the chord progression estimation unit 210. The chord progression extracted in this manner is input to the capture range determination unit 110 (refer to FIG. 2).

(2-4-3. Configuration Example of Instrument Sound Analysis Unit 136)

Next, the configuration of the instrument sound analysis unit 136 will be described. The instrument sound analysis unit 136 is means for computing presence probability of instrument sound indicating which instrument is being played at a certain timing. Moreover, the instrument sound analysis unit 136 computes the presence probability of instrument sound for each combination of the sound sources separated by the sound source separation unit 104. To estimate the presence probability of instrument sound, the instrument sound analysis unit 136 first generates calculation formulae for computing the presence probabilities of various types of instrument sounds by using the feature quantity calculation formula generation apparatus 10 (or another learning algorithm). Then, the instrument sound analysis unit 136 computes the presence probabilities of various types of instrument sounds by using the calculation formulae generated for respective types of the instrument sounds.

Figure 73:
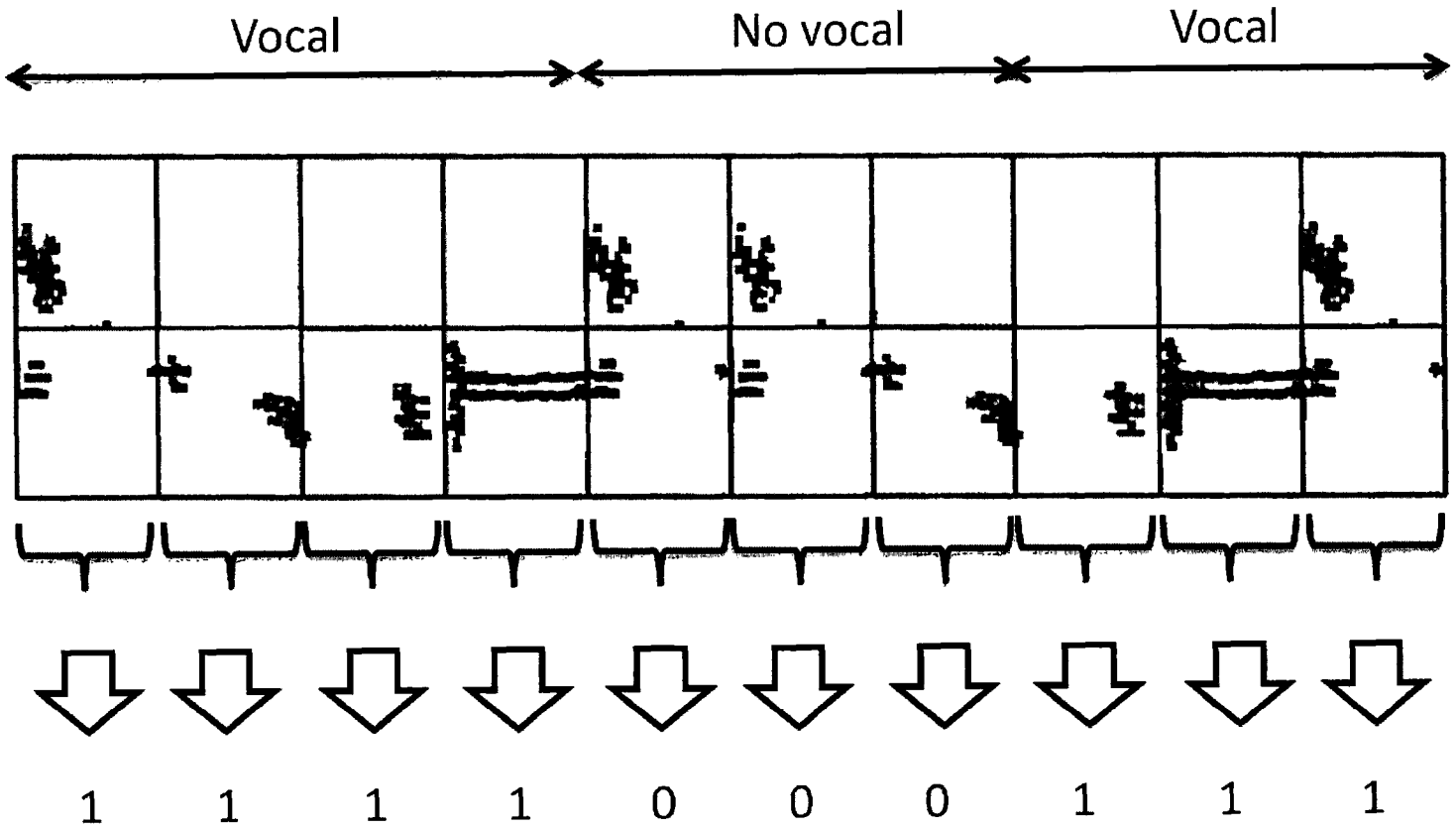
FIG. 73 is an explanatory diagram showing an example of an instrument sound analysis method according to the present embodiment.

To generate a calculation formula for computing the presence probability of an instrument sound, the instrument sound analysis unit 136 prepares a log spectrum labeled in time series in advance. For example, the instrument sound analysis unit 136 captures partial log spectra from the labeled log spectrum in units of specific time (for example, about 1 second) as shown in FIG. 73, and generates a calculation formula for computing the presence probability by using the captured partial log spectra. A log spectrum of music data for which the presence or absence of vocals is known in advance is shown as an example in FIG. 73. When the log spectrum as described is supplied, the instrument sound analysis unit 136 determines capture sections in units of the specific time, refers to the presence or absence of vocals in each capture section, and assigns a label 1 to a section with vocals and assigns a label 0 to a section with no vocals. Moreover, the same can be said for other types of instrument sounds.

Figure 74:
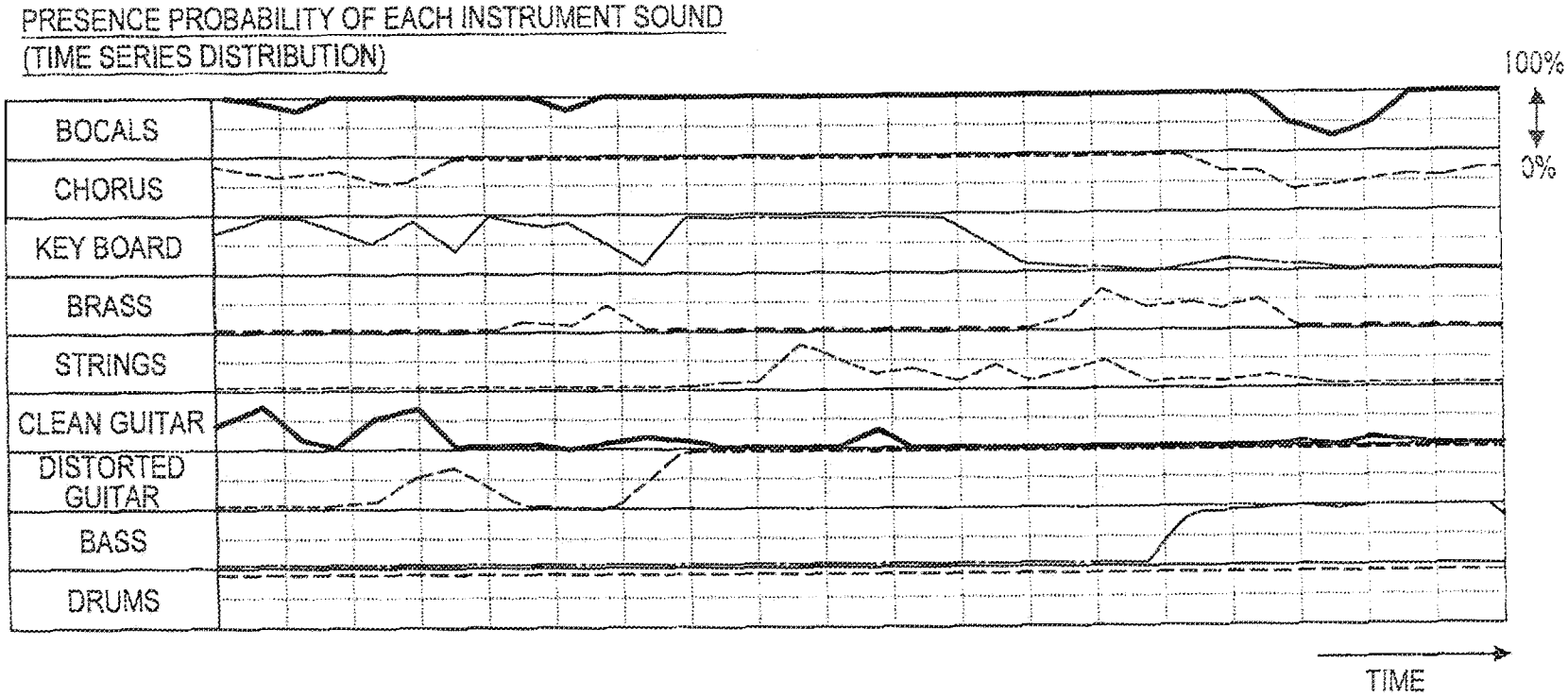
FIG. 74 is an explanatory diagram showing an example of the instrument sound analysis method according to the present embodiment.

The partial log spectra in time series captured in this manner are input to the feature quantity calculation formula generation apparatus 10 as evaluation data. Furthermore, the label for each instrument sound assigned to each partial log spectrum is input to the feature quantity calculation formula generation apparatus 10 as teacher data. By providing the evaluation data and the teacher data as described, a calculation formula can be obtained which outputs, when a partial log spectrum of an arbitrary treated piece is input, whether or not each instrument sound is included in the capture section corresponding to the input partial log spectrum. Accordingly, the instrument sound analysis unit 136 inputs the partial log spectrum to calculation formulae corresponding to various types of instrument sounds while shifting the time axis little by little, and converts the output values to probability values according to a probability distribution computed at the time of learning processing by the feature quantity calculation formula generation apparatus 10. Then, by recording the probability values computed in time series, the instrument sound analysis unit 136 obtains a time series distribution of presence probability for each instrument sound. A presence probability of each instrument sound as shown in FIG. 74, for example, is computed by the processing by the instrument sound analysis unit 136. The presence probability of each instrument sound computed in this manner is input to the capture range determination unit 110 (refer to FIG. 2).

(2-5. Configuration Example of Capture Range Determination Unit 110)

Figure 75:
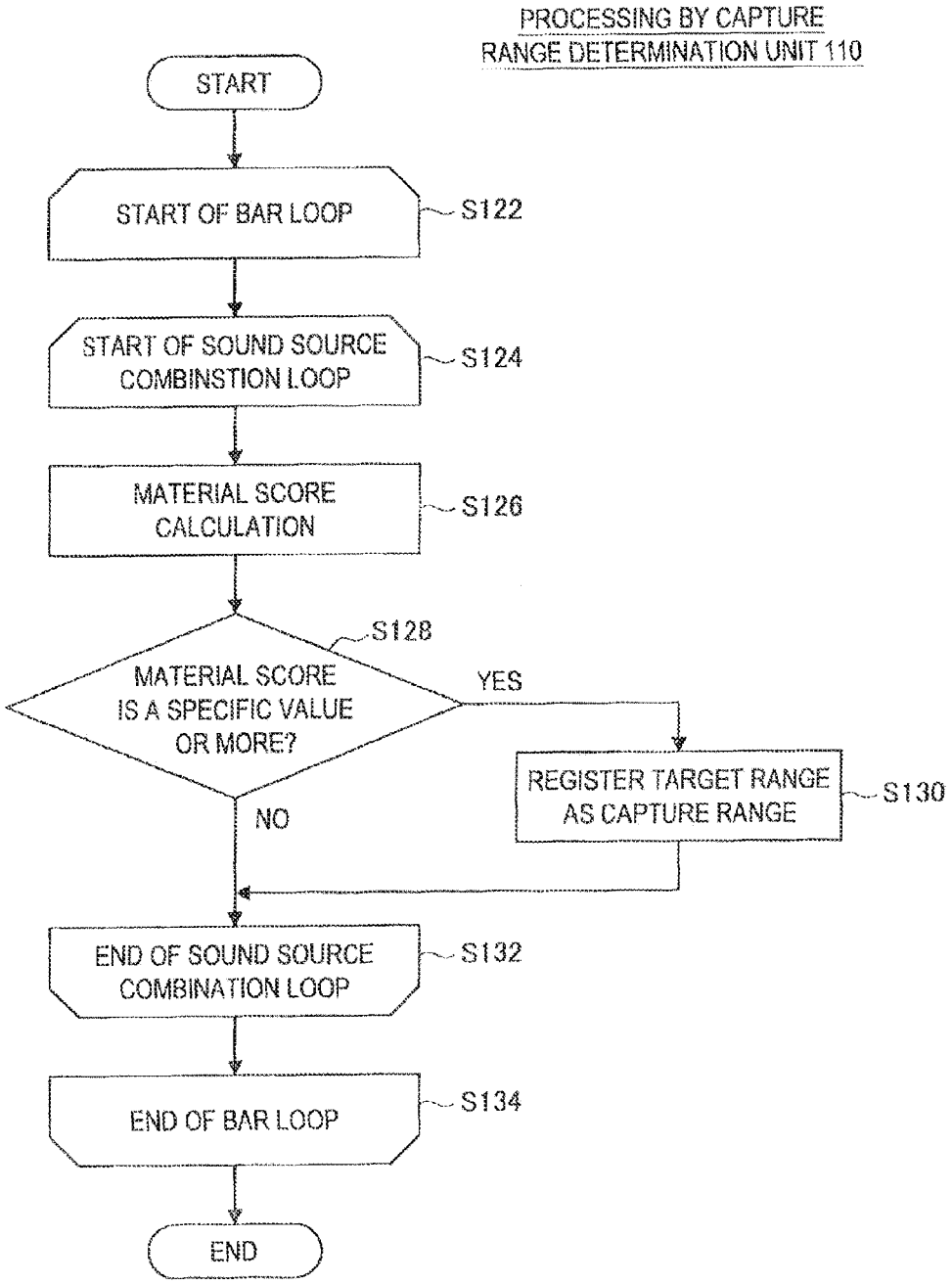
FIG. 75 is an explanatory diagram showing an example of a capture range determination method according to the present embodiment.

Next, the configuration of the capture range determination unit 110 will be described. As described above, the beats, the chord progression, and the presence probability of each instrument sound for the music data are input to the capture range determination unit 110 from the music analysis unit 108. Thus, the capture range determination unit 110 determines a range to be captured as a waveform material by a method as shown in FIG. 75, based on the beats, the chord progression and the presence probability of each instrument sound for the music data. FIG. 75 is an explanatory diagram showing a capture range determination method of the capture range determination unit 110.

As shown in FIG. 75, first, the capture range determination unit 110 starts loop processing relating to bars based on beats detected from music data (S122). Specifically, the capture range determination unit 110 follows the bars while referring to the beats, and repeatedly performs processing within the bar loop for each unit of bar. Here, the beats input from the music analysis unit 108 are used. Next, the capture range determination unit 110 starts loop processing relating to combination of sound sources (S124). Specifically, the music analysis unit 108 performs the processing within the sound source combination loop for each of the combinations (8 types) in relation to the four types of sound sources separated by the sound source separation unit 104. Within the sound source combination loop, whether a range specified by a current bar and a current sound source combination is appropriate for the sound material is decided and, if appropriate, the range is registered as the capture range. In the following, the contents of processing relating to the decision and registration will be described in detail.

First, the capture range determination unit 110 calculates a material score to be used for deciding whether a current bar and a current sound source combination specified in the bar loop and the sound source combination loop are appropriate for the sound material (S126). The material score is computed based on the capture request input from the capture request input unit 102 and the presence probability of each instrument sound included in the music data. More particularly, the presence probabilities of instrument sounds are totalled for a combination of instrument sounds over a number of bars specified as a capture length by the capture request, and the percentage of the total value in the total value of the presence probabilities of all the instrument sounds is computed as the material score.

For example, in case the capture request is for a rhythm loop for two bars, first, the total of the presence probabilities of a drum sound in a current bar to two bars ahead is computed (hereinafter, a total drum probability value). Furthermore, the total of the presence probabilities of all the instruments is computed for the current bar to two bars ahead (hereinafter, a total probability value). After computing these two total values, the capture range determination unit 110 computes a value by dividing the total drum probability value by the total probability value and makes the computation result the material score.

As another example, when the capture request is for an accompaniment of a guitar and strings over four bars, first, the total of the presence probabilities of the guitar sound and the strings sound is computed for the current bar to four bars ahead (hereinafter, a total guitar-strings probability value). Furthermore, the total of the presence probabilities of all the instruments is computed for the current bar to four bars ahead (hereinafter, a total probability value). After computing these two total values, the capture range determination unit 110 computes a value by dividing the total guitar-strings probability value by the total probability value and makes the computation result the material score.

When the material score is calculated in step S126, the capture range determination unit 110 proceeds to the process of step S128. In step S128, it is judged whether or not the material score computed in step S126 is a specific value or more (S128). The specific value used for the decision process in step S128 is determined in a manner depending on the "strictness for capturing" specified by the capture request input from the capture request input unit 102. When the strictness for capturing is specified to be within the range of 0.0 to 1.0, the value of the strictness for capturing can be used as it is as the above-described specific value. In this case, the capture range determination unit 110 compares the material score computed in step S126 and the value of the strictness for capturing, and when the material score is equal to or higher than the value of the strictness for capturing, the capture range determination unit 110 proceeds to the process of step S130. On the other hand, when the material score is lower than the value of the strictness for capturing, the capture range determination unit 110 proceeds to the process of step S132.

In step S130, the capture range determination unit 110 registers as the capture range a target range which is a range having a length specified by the capture request starting from the current bar (S130). When the target range is registered, the capture range determination unit 110 proceeds to the process of step S132. The type of the combination of sound sources is updated in step S132 (S132), and the processing within the sound source combination loop from step S124 to step S132 is again performed. When the processing within the sound source combination loop is over, the capture range determination unit 110 proceeds to the process of step S134. The current bar is updated in step S134 (S134), and the processing within the bar loop from step S122 to step S134 is again performed. Then, when the processing of the bar loop is over, the series of processes by the capture range determination unit 110 is completed.

When the processing by the capture range determination unit 110 is complete, information indicating the range of music data registered as the capture range is input to the waveform capturing unit 112 from the capture range determination unit 110. Then, the capture range determined by the capture range determination unit 110 is captured from the music data and is output as the waveform material by the waveform capturing unit 112.

(2-10. Hardware Configuration (Information Processing Apparatus 100))

Figure 76:
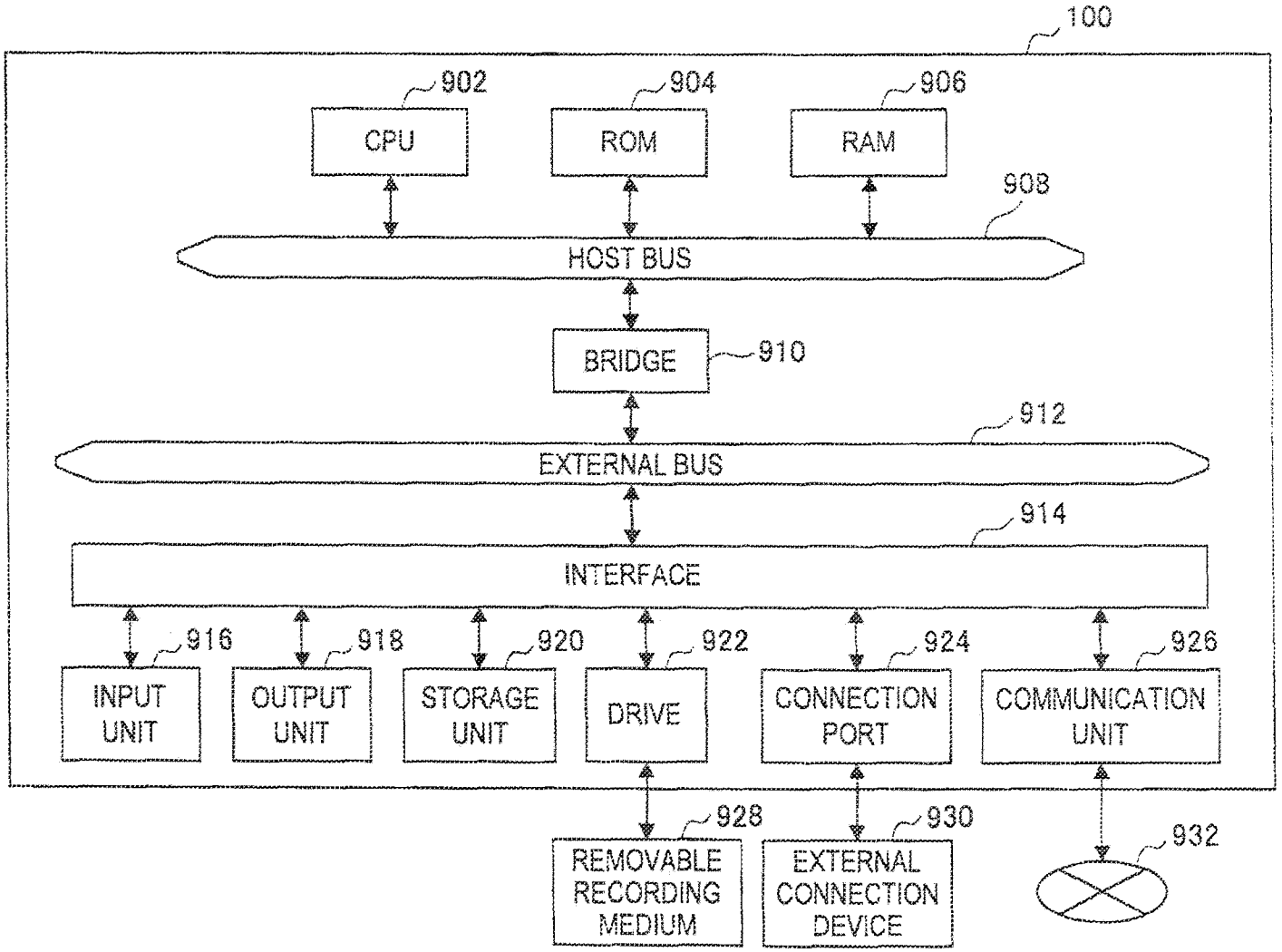
FIG. 76 is an explanatory diagram showing a hardware configuration example of the information processing apparatus according to the present embodiment.

The function of each structural element of the above-described apparatus can be realized by a hardware configuration shown in FIG. 76 and by using a computer program for realizing the above-described function, for example. FIG. 76 is an explanatory diagram showing a hardware configuration of an information processing apparatus capable of realizing the function of each structural element of the above-described apparatus. The mode of the information processing apparatus is arbitrary, and includes modes such as a mobile information terminal such as a personal computer, a mobile phone, a PHS or a PDA, a game machine, or various types of information appliances. Moreover, the PHS is an abbreviation for Personal Handy-phone System. Also, the PDA is an abbreviation for Personal Digital Assistant.

As shown in FIG. 76, the information processing apparatus 100 includes a CPU 902, a ROM 904, a RAM 906, a host bus 908, a bridge 910, an external bus 912, and an interface 914. Furthermore, the information processing apparatus 10 includes an input unit 916, an output unit 918, a storage unit 920, a drive 922, a connection port 924, and a communication unit 926. Moreover, the CPU is an abbreviation for Central Processing Unit. Also, the ROM is an abbreviation for Read Only Memory. Furthermore, the RAM is an abbreviation for Random Access Memory.

The CPU 902 functions as an arithmetic processing unit or a control unit, for example, and controls an entire operation of the structural elements or some of the structural elements on the basis of various programs recorded on the ROM 904, the RAM 906, the storage unit 920, or a removal recording medium 928. The ROM 904 stores, for example, a program loaded on the CPU 902 or data or the like used in an arithmetic operation. The RAM 906 temporarily or perpetually stores, for example, a program loaded on the CPU 902 or various parameters or the like arbitrarily changed in execution of the program. These structural elements are connected to each other by, for example, the host bus 908 which can perform high-speed data transmission. The host bus 908 is connected to the external bus 912 whose data transmission speed is relatively low through the bridge 910, for example.

The input unit 916 is, for example, operation means such as a mouse, a keyboard, a touch panel, a button, a switch, or a lever. The input unit 916 may be remote control means (so-called remote control) that can transmit a control signal by using an infrared ray or other radio waves. The input unit 916 includes an input control circuit or the like to transmit information input by using the above-described operation means to the CPU 902 as an input signal.

The output unit 918 is, for example, a display device such as a CRT, an LCD, a PDP, or an ELD. Also, the output unit 918 is a device such an audio output device such as a speaker or headphones, a printer, a mobile phone, or a facsimile that can visually or auditorily notify a user of acquired information. The storage unit 920 is a device to store various data, and includes, for example, a magnetic storage device such as an HDD, a semiconductor storage device, an optical storage device, or a magneto-optical storage device. Moreover, the CRT is an abbreviation for Cathode Ray Tube. Also, the LCD is an abbreviation for Liquid Crystal Display. Furthermore, the PDP is an abbreviation for Plasma Display Panel. Furthermore, the ELD is an abbreviation for Electro-Luminescence Display. Furthermore, the HDD is an abbreviation for Hard Disk Drive.

The drive 922 is a device that reads information recorded on the removal recording medium 928 such as a magnetic disk, an optical disk, a magneto-optical disk, or a semiconductor memory or writes information in the removal recording medium 928. The removal recording medium 928 is, for example, a DVD medium, a Blue-ray medium, or an HD-DVD medium. Furthermore, the removable recording medium 928 is, for example, a compact flash (CF; CompactFlash) (registered trademark), a memory stick, or an SD memory card. As a matter of course, the removal recording medium 928 may be, for example, an IC card on which a non-contact IC chip is mounted. Moreover, the SD is an abbreviation for Secure Digital. Also, the IC is an abbreviation for Integrated Circuit.

The connection port 924 is a port such as an USB port, an IEEE1394 port, a SCSI, an RS-232C port, or a port for connecting an external connection device 930 such as an optical audio terminal. The external connection device 930 is, for example, a printer, a mobile music player, a digital camera, a digital video camera, or an IC recorder. Moreover, the USB is an abbreviation for Universal Serial Bus. Also, the SCSI is an abbreviation for Small Computer System Interface.

The communication unit 926 is a communication device to be connected to a network 932. The communication unit 926 is, for example, a communication card for a wired or wireless LAN, Bluetooth (registered trademark), or WUSB, an optical communication router, an ADSL router, or various communication modems. The network 932 connected to the communication unit 926 includes a wire-connected or wirelessly connected network. The network 932 is, for example, the Internet, a home-use LAN, infrared communication, visible light communication, broadcasting, or satellite communication. Moreover, the LAN is an abbreviation for Local Area Network. Also, the WUSB is an abbreviation for Wireless USB. Furthermore, the ADSL is an abbreviation for Asymmetric Digital Subscriber Line.

(2-6. Conclusion)

Lastly, the functional configuration of the information processing apparatus of the present embodiment, and the effects obtained by the functional configuration will be briefly described.

First, the functional configuration of the information processing apparatus according to the present embodiment can be described as follows. The information processing apparatus is configured from a capture request input unit, a music analysis unit and a capture range determination unit that are described as follows. The capture request input unit is for inputting a capture request including, as information, length of a range to be captured as the sound material, types of instrument sounds and strictness for capturing. Furthermore, the music analysis unit is for analyzing an audio signal and for detecting beat positions of the audio signal and a presence probability of each instrument sound in the audio signal. In this manner, by automatically detecting the beat positions and the presence probability of each instrument sound by the process of analyzing the audio signal, a sound material can be automatically captured from the audio signal of an arbitrary music piece. Also, the capture range determination unit is for determining a capture range for the sound material so that the sound material meets the capture request input by the capture request input unit, by using the beat positions and the presence probability of each instrument sound detected by the music analysis unit. In this manner, being able to know the beat positions makes it possible to determine the capture range by the unit of range having a specific length divided by the beat positions. Furthermore, since the presence probability of each instrument sound is computed for each range, a range in which a desired instrument sound is present can be easily captured. That is, a signal of a range suitable for a desired sound material can be easily captured from an audio signal of a music piece.

Furthermore, the information processing apparatus may further include a material capturing unit for capturing the capture range determined by the capture range determination unit from the audio signal and for outputting the capture range as the sound material. By mixing the sound material captured in this manner with another known music piece while synchronizing the sound material with the beats of the known music piece, the arrangement of the known music piece can be changed, for example. Furthermore, the information processing apparatus may further include a sound source separation unit for separating, in case signals of a plurality of types of sound sources are included in the audio signal, the signal of each sound source from the audio signal. By analyzing the audio signal separated for each sound source, the presence probability of each instrument sound can be detected more accurately.

Furthermore, the music analysis unit may be configured to further detect a chord progression of the audio signal by analyzing the audio signal. In this case, the capture range determination unit determines the capture range meeting the capture request and outputs, along with information on the capture range, a chord progression in the capture range. With the information on the chord progression being provided to a user along with the information on the capture range, it becomes possible to refer to the chord progression at the time of mixing with another known music piece. Moreover, the chord progression may be output by the material capturing unit along with the audio signal of the capture range which is output as the sound material.

Furthermore, the music analysis unit may be configured to generate a calculation formula for extracting information relating to the beat positions and information relating to the presence probability of each instrument sound by using a calculation formula generation apparatus capable of automatically generating a calculation formula for extracting feature quantity of an arbitrary audio signal, and to detect the beat positions of the audio signal and the presence probability of each instrument sound in the audio signal by using the calculation formula, the calculation formula generation apparatus automatically generating the calculation formula by using a plurality of audio signals and the feature quantity of each of the audio signals. The beat positions and the presence probability of each instrument sound can be computed by using the learning algorithm or the like already described. By using a method as described, it becomes possible to automatically extract the beat positions and the presence probability of each instrument sound from an arbitrary audio signal, and automatic capturing process for the sound material as described above is realized.

Furthermore, the capture range determination unit may include a material score computation unit for totalling presence probabilities of instrument sounds of types specified by the capture request for each range of the audio signal and for computing, as a material score, a value obtained by dividing the totalled presence probability by a total of presence probabilities of all instrument sounds in the range, each range having a length of the capture range specified by the capture request. In this case, the capture range determination unit determines, as a capture range meeting the capture request, a range where the material score computed by the material score computation unit is higher than a value of the strictness for capturing. In this manner, whether a capture range is suitable for a desired sound material can be determined based on the above-described material score. Furthermore, the value of the strictness for capturing is specified so as to match with the expression form of the material score, and can be directly compared with the material score.

Furthermore, the sound source separation unit may be configured to separate a signal for foreground sound and a signal for background sound from the audio signal and to also separate from each other a centre signal localized around a centre, a left-channel signal and a right-channel signal in the signal for foreground sound. As already described, the signal for foreground sound is separated as a signal with small phase difference between the left and the right. Also, the signal for background sound is separated as a signal with large phase difference between the left and the right. Also, the centre signal is separated from the signal for foreground sound as a signal with small volume difference between the left and the right. Furthermore, the left-channel signal and the right-channel signal are each separated as a signal with large left volume or right volume.

REMARKS

The above-described waveform capturing unit 112 is an example of the material capturing unit. Also, the feature quantity calculation formula generation apparatus 10 is an example of the calculation formula generation apparatus. A part of the functions of the above-described capture range determination unit 110 is an example of the material score computation unit.

It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP 2008-310721 filed in the Japan Patent Office on Dec. 5, 2008, the entire content of which is hereby incorporated by reference.

What is claimed is:

1. An information processing apparatus comprising:

a music analysis unit for analyzing an audio signal serving as a capture source for a sound material and for detecting beat positions of the audio signal and a presence probability of each instrument sound in the audio signal;

a capture range determination unit for determining a capture range for the sound material by using the beat positions and the presence probability of each instrument sound detected by the music analysis unit; and a sound source separation unit that separates, a signal for foreground sound, a signal for background sound, and a center signal to compute the presence probability of each instrument sound, wherein the sound source separation unit comprises:

a left-channel band division unit for converting a left-channel signal to a frequency domain;

a right-channel band division unit for converting a right-channel signal into the frequency domain;

a left-channel band synthesis unit for extracting a first center signal portion; and a right-channel band synthesis unit for extracting a second center signal portion.

2. The information processing apparatus according to claim 1, further comprising:

a material capturing unit for capturing the capture range determined by the capture range determination unit from the audio signal and for outputting the capture range as the sound material.

3. The information processing apparatus according to claim 1, wherein the sound source separation unit separates the signal of each sound source from a plurality of types of sound sources included in the audio signal.

4. The information processing apparatus according to claim 1, wherein the music analysis unit further detects a chord progression of the audio signal by analyzing the audio signal, and the capture range determination unit determines the capture range for the sound material and outputs, along with information on the capture range, a chord progression in the capture range.

5. The information processing apparatus according to claim 2, wherein the music analysis unit further detects a chord progression of the audio signal by analyzing the audio signal, and the material capturing unit outputs, as the sound material, an audio signal of the capture range, and also outputs a chord progression in the capture range.

6. The information processing apparatus according to claim 1, wherein the music analysis unit generates a calculation formula for extracting information relating to the beat positions and information relating to the presence probability of each instrument sound by using a calculation formula generation apparatus capable of automatically generating a calculation formula for extracting feature quantity of an arbitrary audio signal, and detects the beat positions of the audio signal and the presence probability of each instrument sound in the audio signal by using the calculation formula, the calculation formula generation apparatus automatically generating the calculation formula by using a plurality of audio signals and the feature quantity of each of the audio signals.

7. The information processing apparatus according to claim 2, wherein the sound source separation unit separates the signal for foreground sound and the signal for background sound from the audio signal and also separates from each other the centre signal localized around a centre, the left-channel signal and the right-channel signal in the signal for foreground sound.

8. An information processing apparatus comprising:

a music analysis unit for analyzing an audio signal serving as a capture source for a sound material and for detecting beat positions of the audio signal and a presence probability of each instrument sound in the audio signal;

a capture range determination unit for determining a capture range for the sound material by using the beat positions and the presence probability of each instrument sound detected by the music analysis unit; and a capture request input unit for inputting a capture requesting including, as information, at least one of a length of a range to be captured as the sound material, types of instrument sounds and strictness for capturing, wherein the capture range determination unit determines the capture range for the sound material so that the sound material meets the capture request input by the capture request input unit.

9. The information processing apparatus according to claim 8, wherein the capture range determination unit includes a material score computation unit for totalling presence probabilities of instrument sounds of types specified by the capture request for each range of the audio signal and for computing, as a material score, a value obtained by dividing the totalled presence probability by a total of presence probabilities of all instrument sounds in the range, each range having a length of the capture range specified by the capture request, and determines, as a capture range meeting the capture request, a range where the material score computed by the material score computation unit is higher than a value of the strictness for capturing.

10. A sound material capturing method comprising, when an audio signal serving as a capture source for a sound material is input to an information processing apparatus, the steps of:

using a computer to analyze the audio signal and to detect beat positions of the audio signal and a presence probability of each instrument sound in the audio signal;

using a computer to determine a capture range for the sound material by using the beat positions and the presence probability of each instrument sound detected by the step of analyzing and detecting; and using a computer to separate, from the audio signal, a signal for foreground sound and a signal for background sound to compute the presence probability of each instrument sound, wherein separating the audio signal comprises:

converting a left-channel signal to a frequency domain;

converting a right-channel signal into the frequency domain;

extracting a first center signal portion; and extracting a second center signal portion.

11. A computer program product tangibly embodied as instructions on a non-transitory computer-readable storage medium, the computer program causing a computer to realize: when an audio signal serving as a capture source for a sound material is input, a music analysis function for analyzing the audio signal and for detecting beat positions of the audio signal and a presence probability of each instrument sound in the audio signal;

a capture range determination function for determining a capture range for the sound material by using the beat positions and the presence probability of each instrument sound detected by the music analysis function; and a sound source separation unit for separating a signal for foreground sound, a signal for background sound, and a center signal to compute the presence probability of each instrument sound, wherein the sound source separation unit comprises:

a left-channel band division unit for converting a left-channel signal to a frequency domain;

a right-channel band division unit for converting a right-channel signal into the frequency domain;

a left-channel band synthesis unit for extracting a first center signal portion; and a right-channel band synthesis unit for extracting a second center signal portion.

* * * * *